US006118875A

United States Patent [19]

Møller et al.

[11] Patent Number: 6,118,875

[45] Date of Patent: Sep. 12, 2000

[54] BINAURAL SYNTHESIS, HEAD-RELATED TRANSFER FUNCTIONS, AND USES THEREOF

[76] Inventors: Henrik Møller, Vejgaard Bymidte 83; Dorte Hammershøi, Vesterbro 1,4.mf; Clemen Boje Jensen, Sverigesgade 2, 2. tv.; Michael Friis Sørensen, Korsgade 26, 3.th., all of DK-9000 Aalborg, Denmark

[21] Appl. No.: 08/700,470

[22] PCT Filed: Feb. 27, 1995

[86] PCT No.: PCT/DK95/00089

§ 371 Date: Dec. 27, 1996

§ 102(e) Date: Dec. 27, 1996

[87] PCT Pub. No.: WO95/23493

PCT Pub. Date: Aug. 31, 1995

[30] Foreign Application Priority Data

Feb. 25, 1994 [DK] Denmark ..... 0234/94

[51] Int. Cl.[7] ..... H04R 5/00

[52] U.S. Cl. ..... 381/1; 381/309; 381/310

[58] Field of Search ..... 381/1, 17–23, 381/300, 309, 25–26, 310

[56] References Cited

U.S. PATENT DOCUMENTS

| | | | |
|---|---|---|---|
| 4,199,658 | 4/1980 | Iwahara | 179/1 G |
| 4,741,035 | 4/1988 | Genuit | 381/26 |
| 4,910,779 | 3/1990 | Cooper et al. | 381/1 |
| 4,975,954 | 12/1990 | Cooper et al. | 381/26 |
| 5,208,860 | 5/1993 | Lowe et al. | 381/17 |
| 5,371,799 | 12/1994 | Lowe et al. | 381/17 |
| 5,386,082 | 1/1995 | Higashi | 381/26 |
| 5,440,639 | 8/1995 | Suzuki et al. | 381/17 |
| 5,452,359 | 9/1995 | Inanaga et al. | 381/25 |
| 5,495,534 | 2/1996 | Inanaga et al. | 381/310 |
| 5,511,129 | 4/1996 | Craven et al. | 381/103 |
| 5,521,981 | 5/1996 | Gehring | 381/17 |
| 5,659,619 | 8/1997 | Abel | 381/17 |

FOREIGN PATENT DOCUMENTS 0465662 1/1992 European Pat. Off. ..... H04R 5/033

OTHER PUBLICATIONS

"Virtual reality systems challenge designers and application developers", Tom Williams, Senior Editor, *Computer Design* (Nov. 1994):53–70.

Tucker–Davis Technologies, "Power Dac Price List" (Jul. 1994).

Hellstrom, Per–Anders, "Miniature microphone probe tube measurements in the external auditory canal", *J. Acoust. Soc. Am.* (1993) 93/2:907–919.

(List continued on next page.)

*Primary Examiner*—Curtis A. Kuntz
*Assistant Examiner*—Duc Nguyen
*Attorney, Agent, or Firm*—Klein & Szekeres, LLP

[57] ABSTRACT

A method and apparatus for simulating the transmission of sound from sound sources to the ear canals of a listener encompasses novel head-related transfer functions (HTFs), novel methods of measuring and processing HTFs, and novel methods of changing or maintaining the directions of the sound sources as perceived by the listener. The measurement methods enable the measurement and construction of HTFs for which the time domain descriptions are surprisingly short, and for which the differences between listeners are surprisingly small. The novel HTFs can be exploited in any application concerning the simulation of sound transmission, measurement, simulation, or reproduction. The invention is particularly advantageous in the field of binaural synthesis, specifically, the creation, by means of two sound sources, of the perception in the listener of listening to sound generated by a multichannel sound system. It is also particularly useful in the designing of electronic filters used, for example, in virtual reality systems, and in the designing of an "artificial head" having HTFs that approximate the HTFs of the invention as closely as possible in order to make the best possible representation of humans by the artificial head, thereby making artificial head recordings of optimal quality.

87 Claims, 52 Drawing Sheets

OTHER PUBLICATIONS

Lehnert, H. and Blauert, J., "Aspects of auralization in binaural room simulation", presented at the *93rd Convention 1992 Oct. 1–4 San Francisco*.

Kistler, D.J. "A model of head–related transfer functions based on principal components analysis and minimum–phase reconstruction", *J. Acoust. Soc. Am*, (1992) 91/3:1637–1647.

Divenyi, P. L. and Oliver, S. K., "Resolution of steady–state sound in simulated auditory space", *J. Acoust. Soc. Am.*, (1989) 85/5:2042–2052.

Wightman, F. L and Kistler, D. J., "Headphone simulation of free–field listenting. I: Stimulus synthesis", *J. Acoust. Soc. Am.*, (1989) 85/2:858–887.

Poselt, C. et al. "Generation of binaural signals for research and home entertainment", (1986).

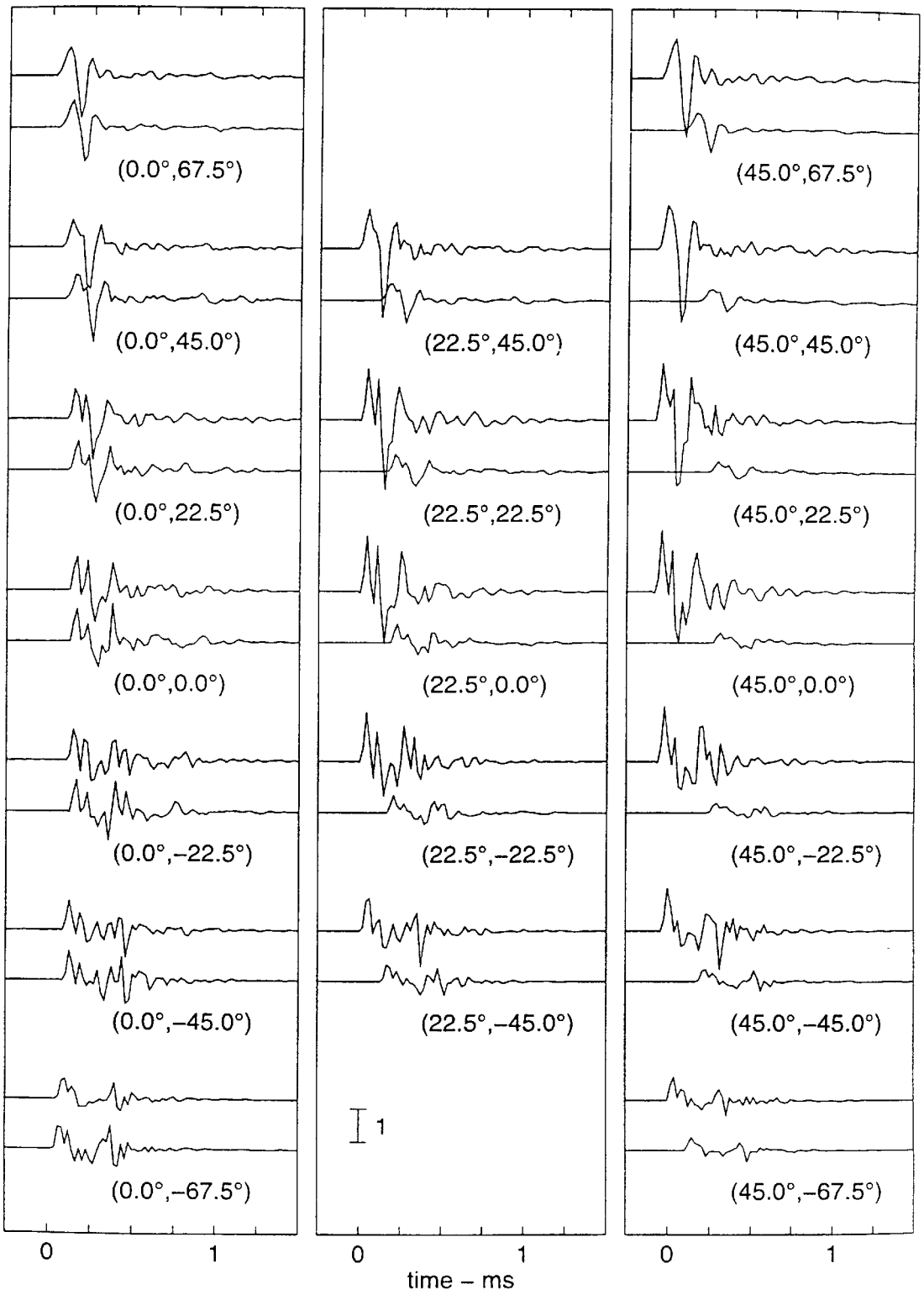
Fig. 1 (1)

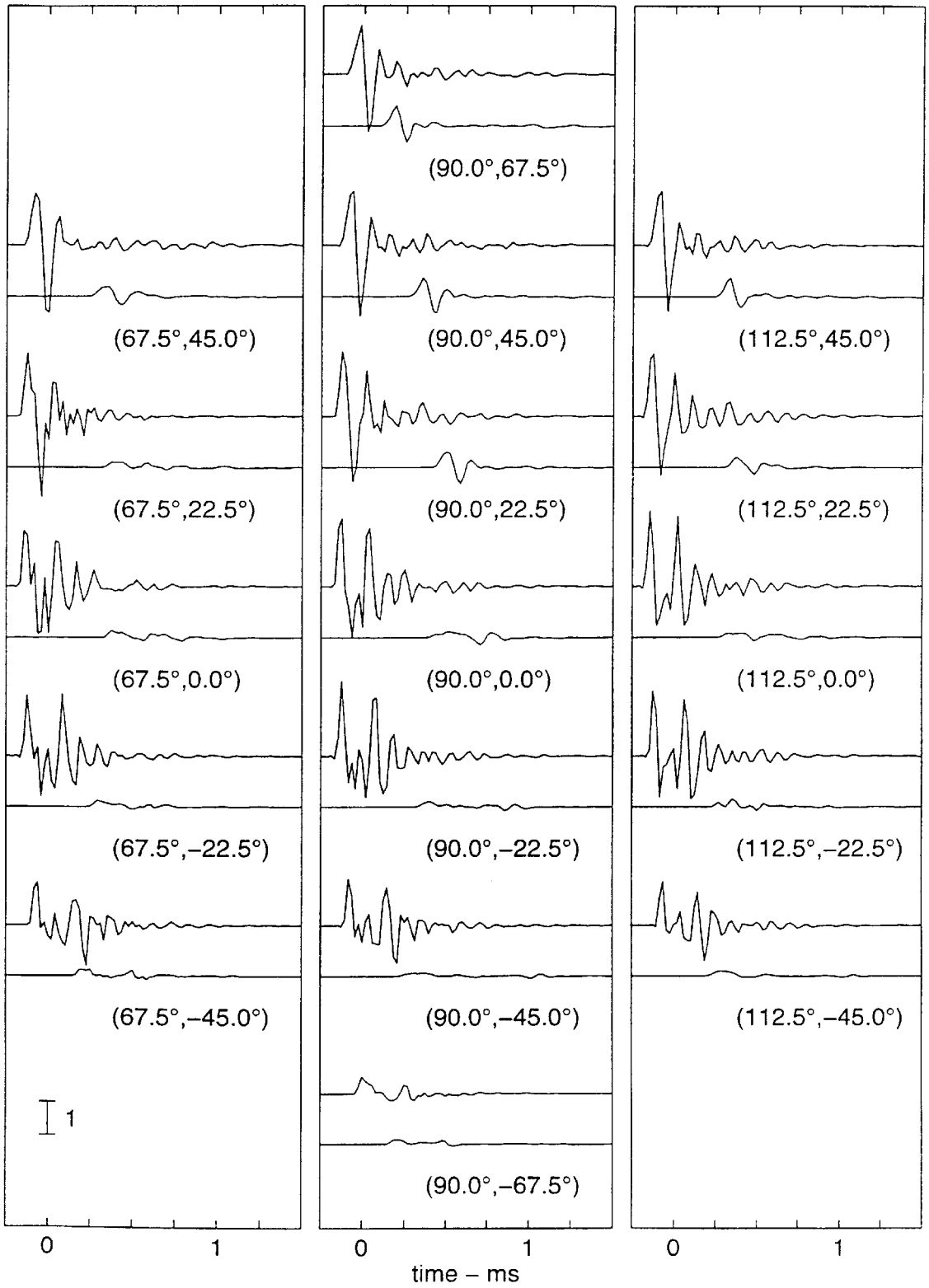
Fig. 1 (2)

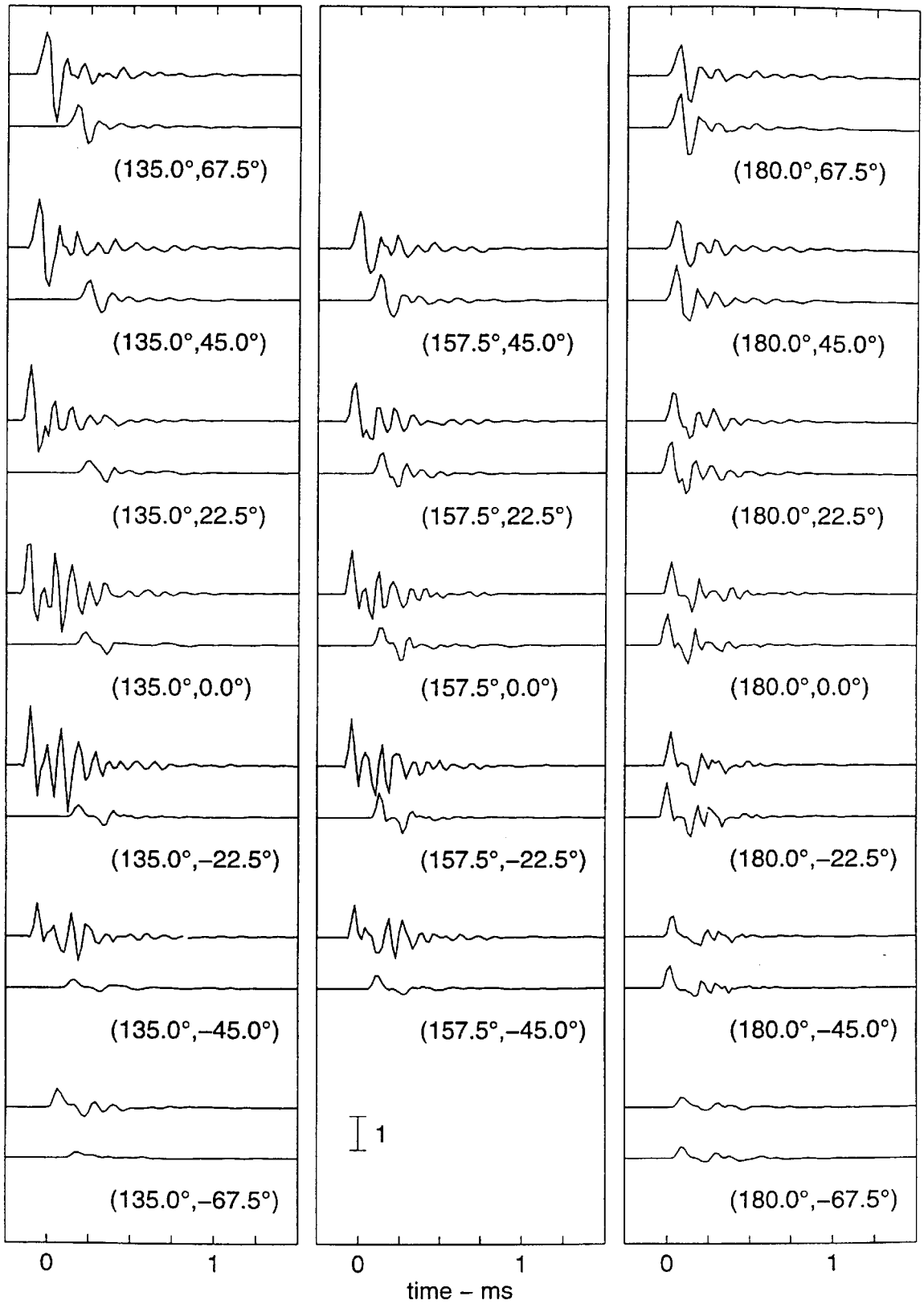
Fig. 1 (3)

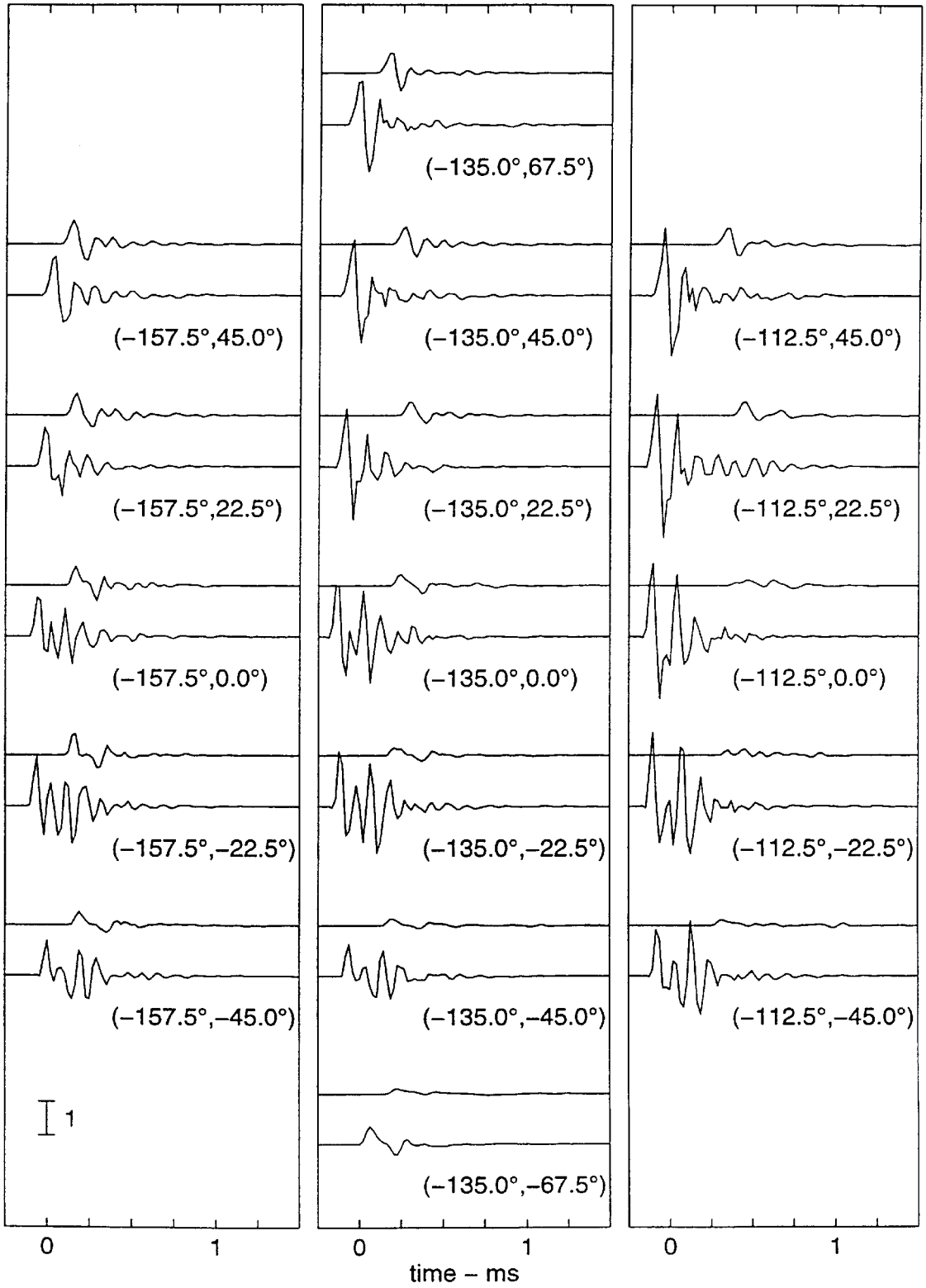
Fig. 1 (4)

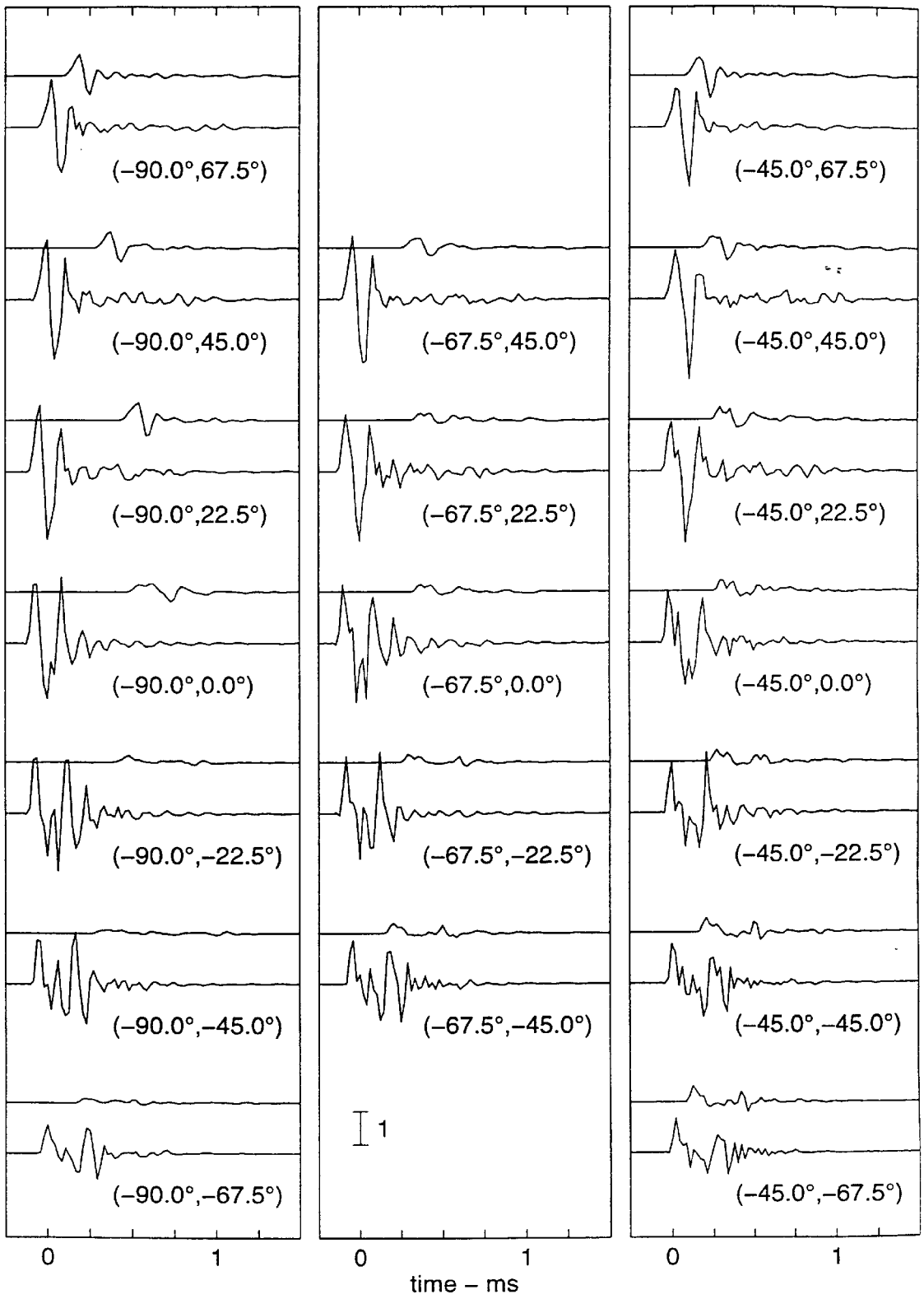
Fig. 1 (5)

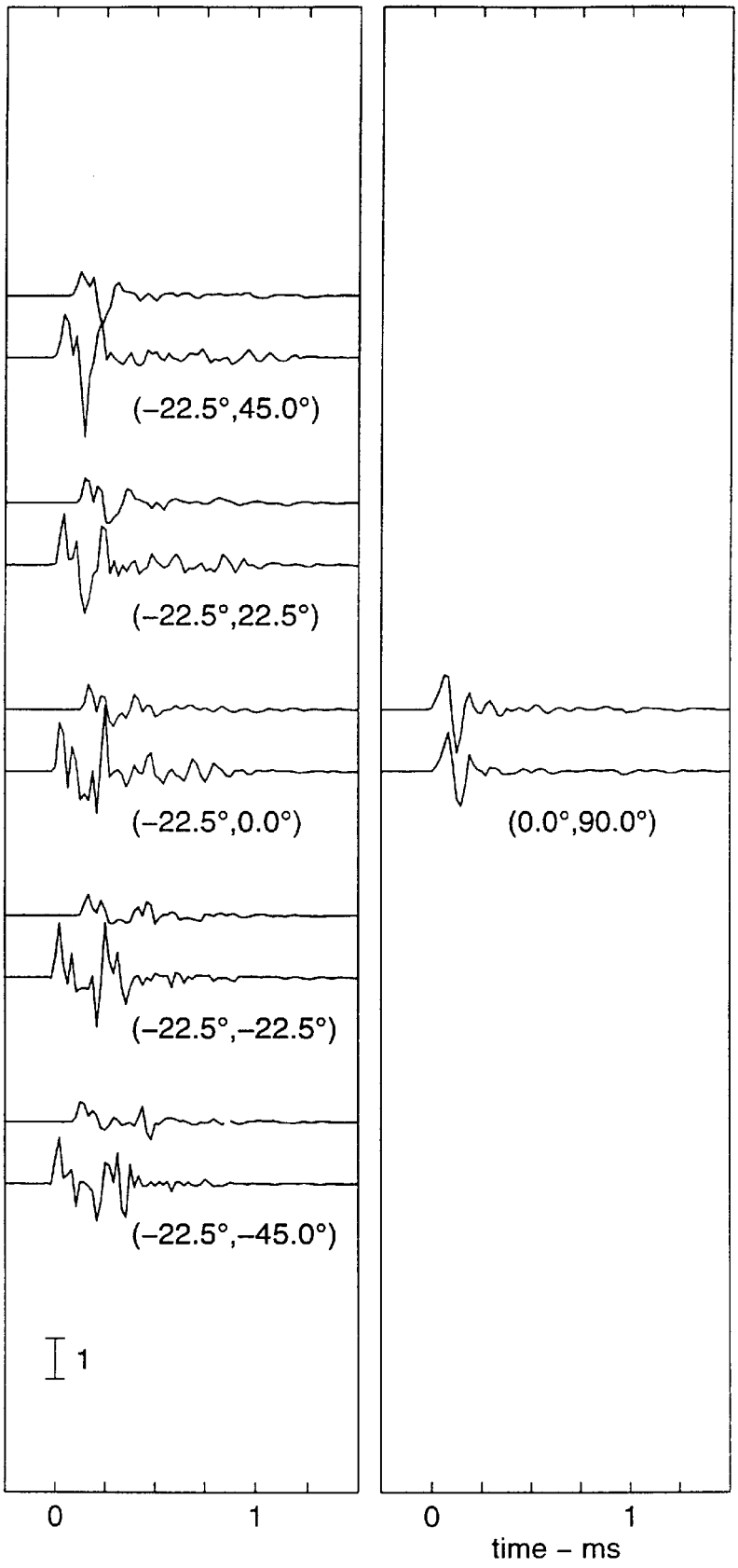
Fig. 1 (6)

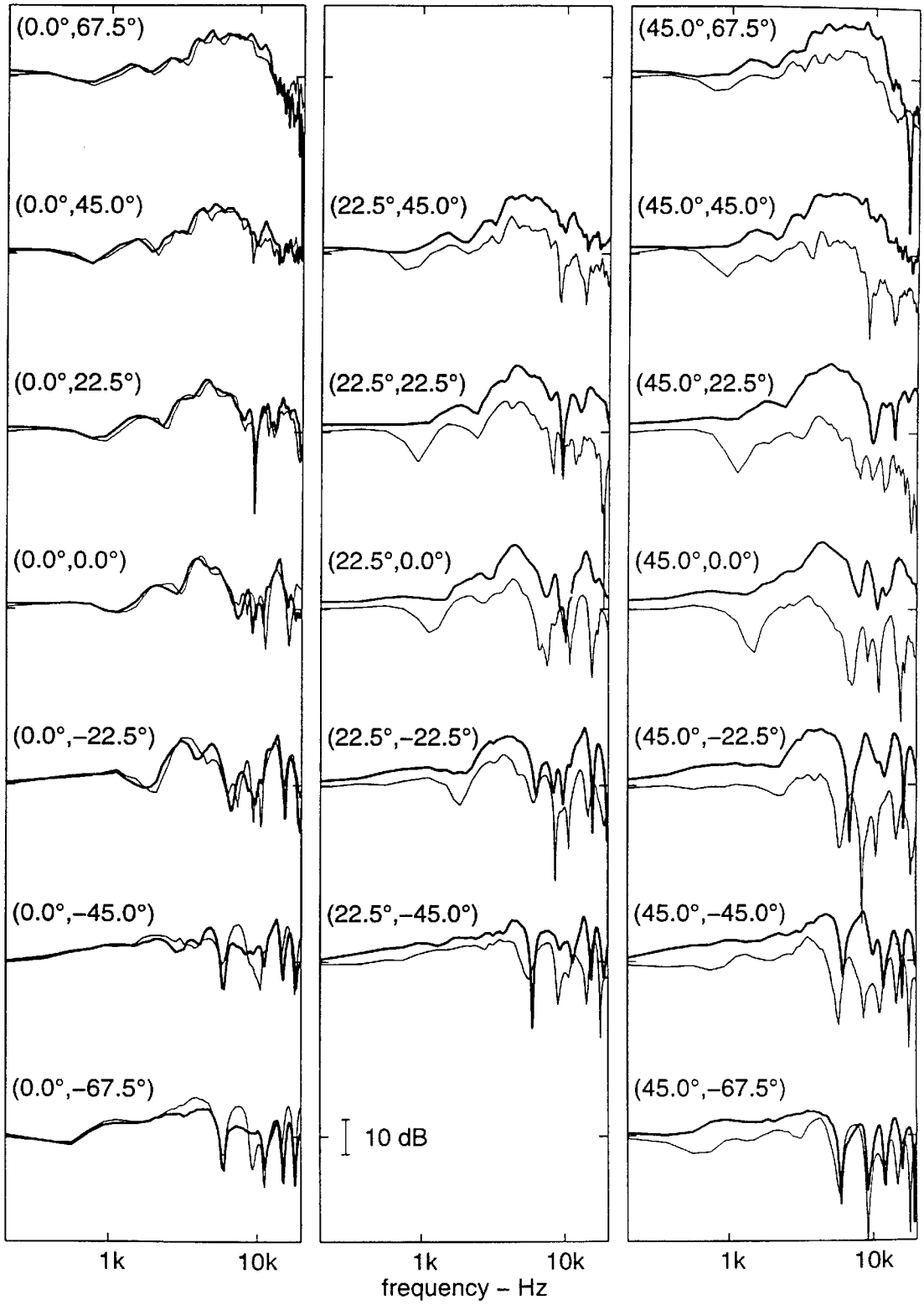
Fig. 1 (7)

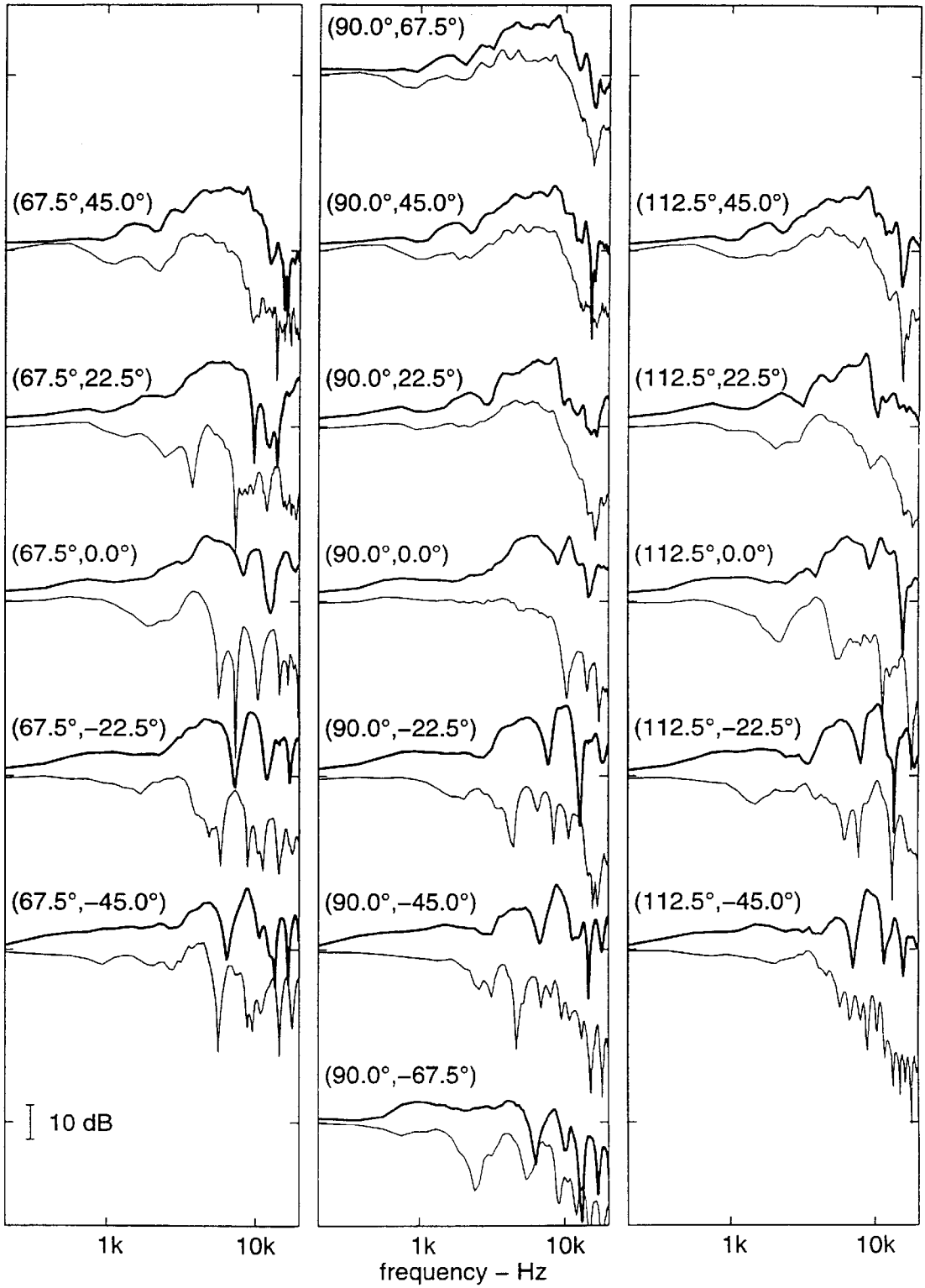
Fig. 1 (8)

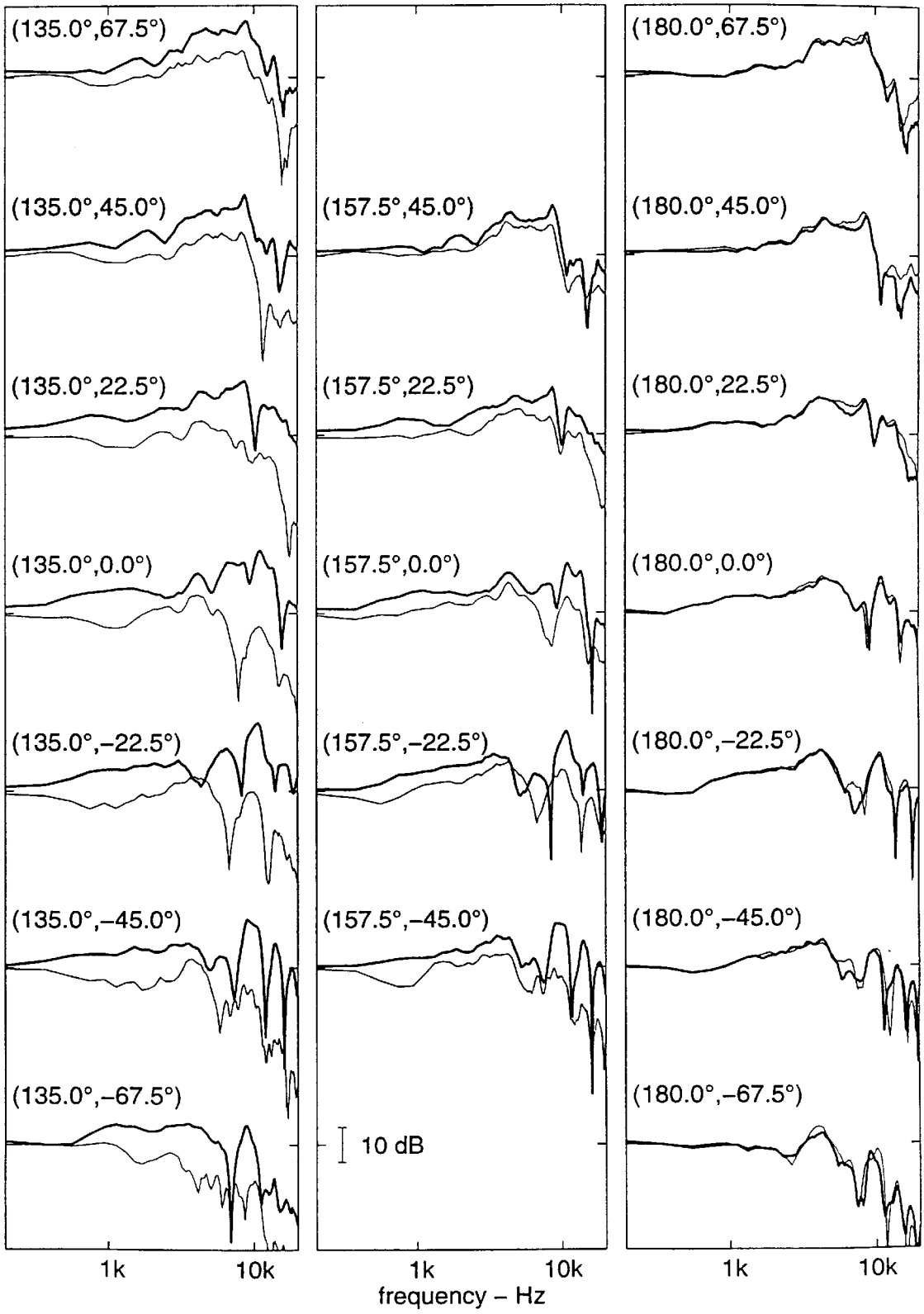
Fig. 1 (9)

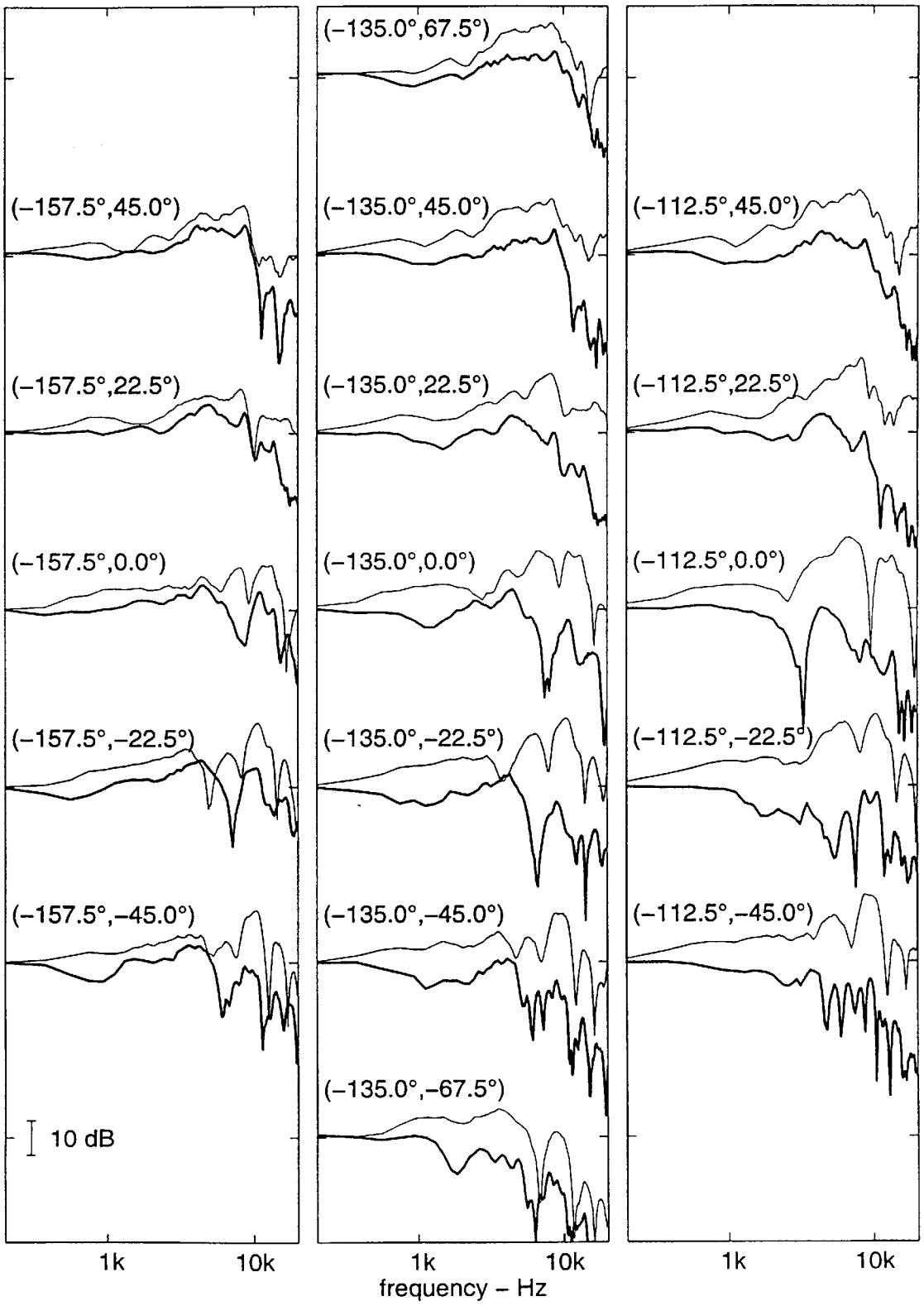
Fig. 1 (10)

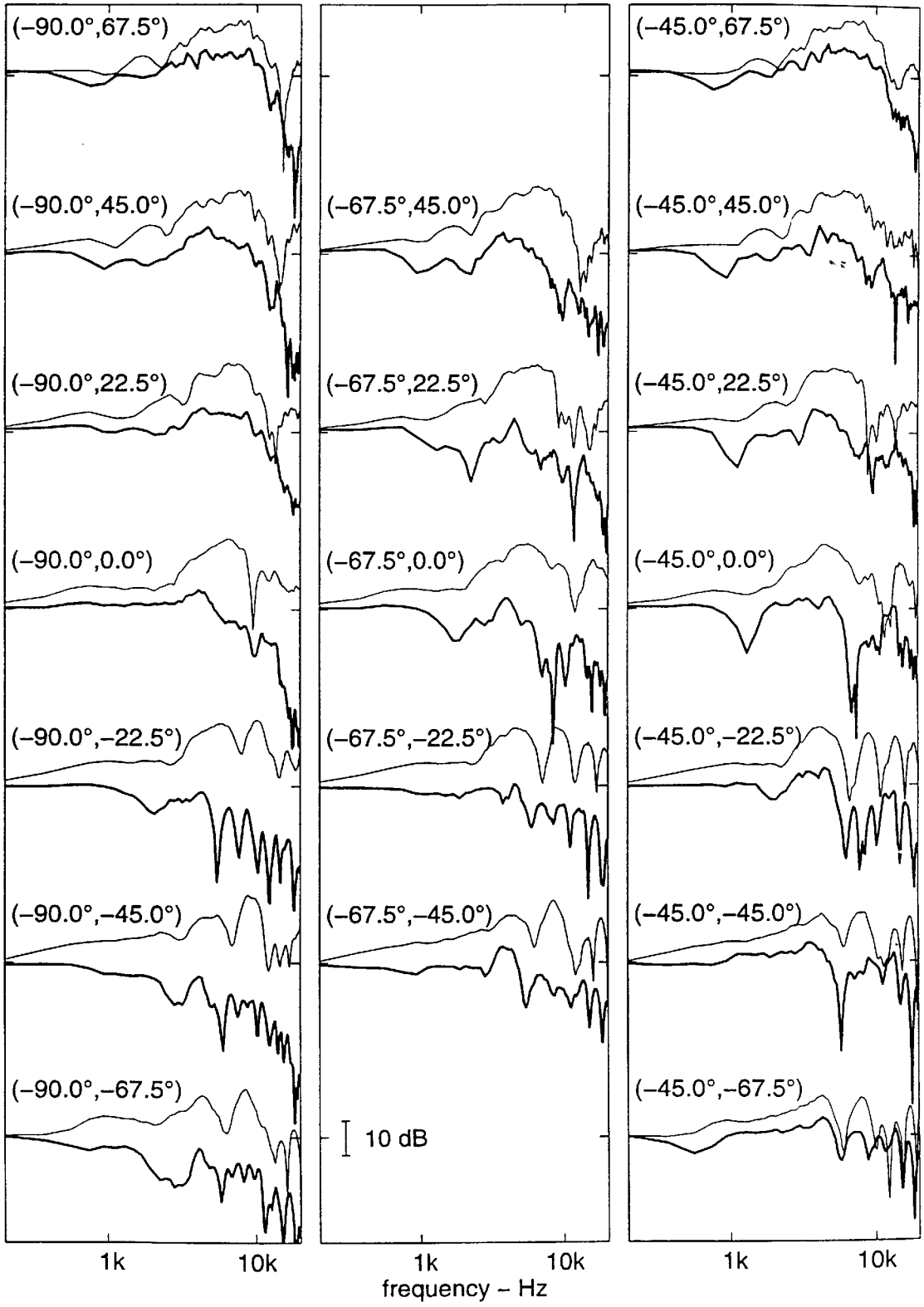
Fig. 1 (11)

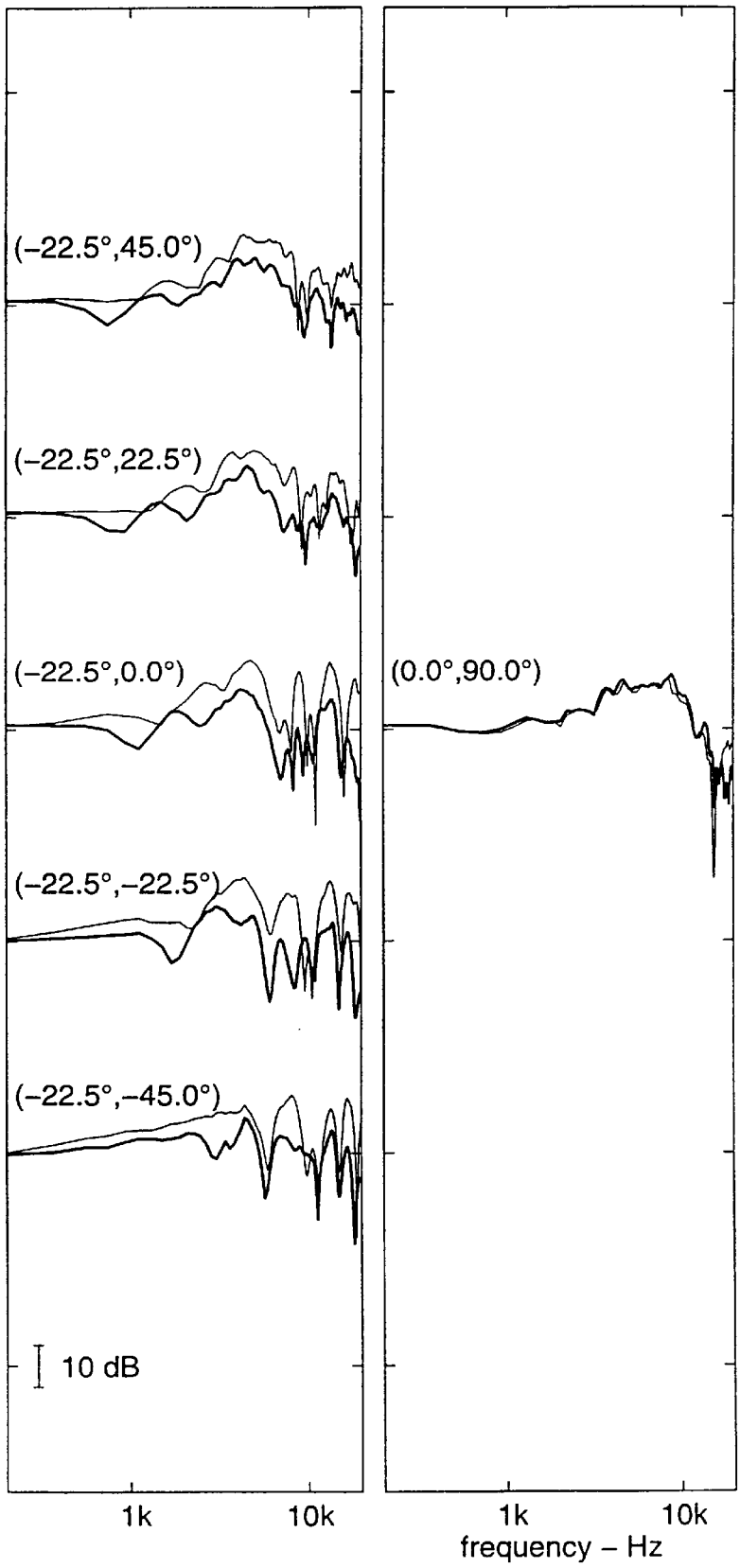
Fig. 1 (12)

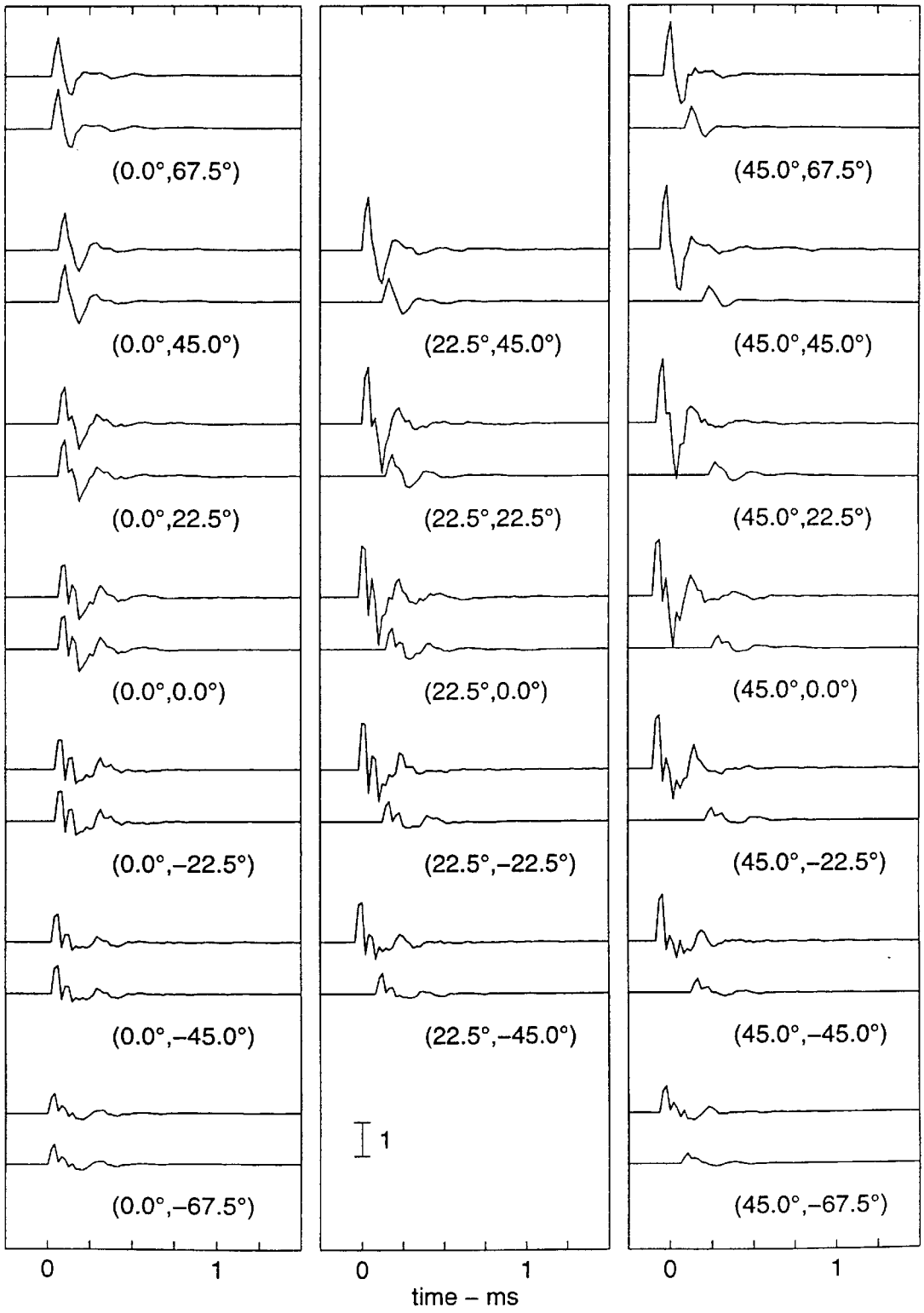
Fig. 2 (1)

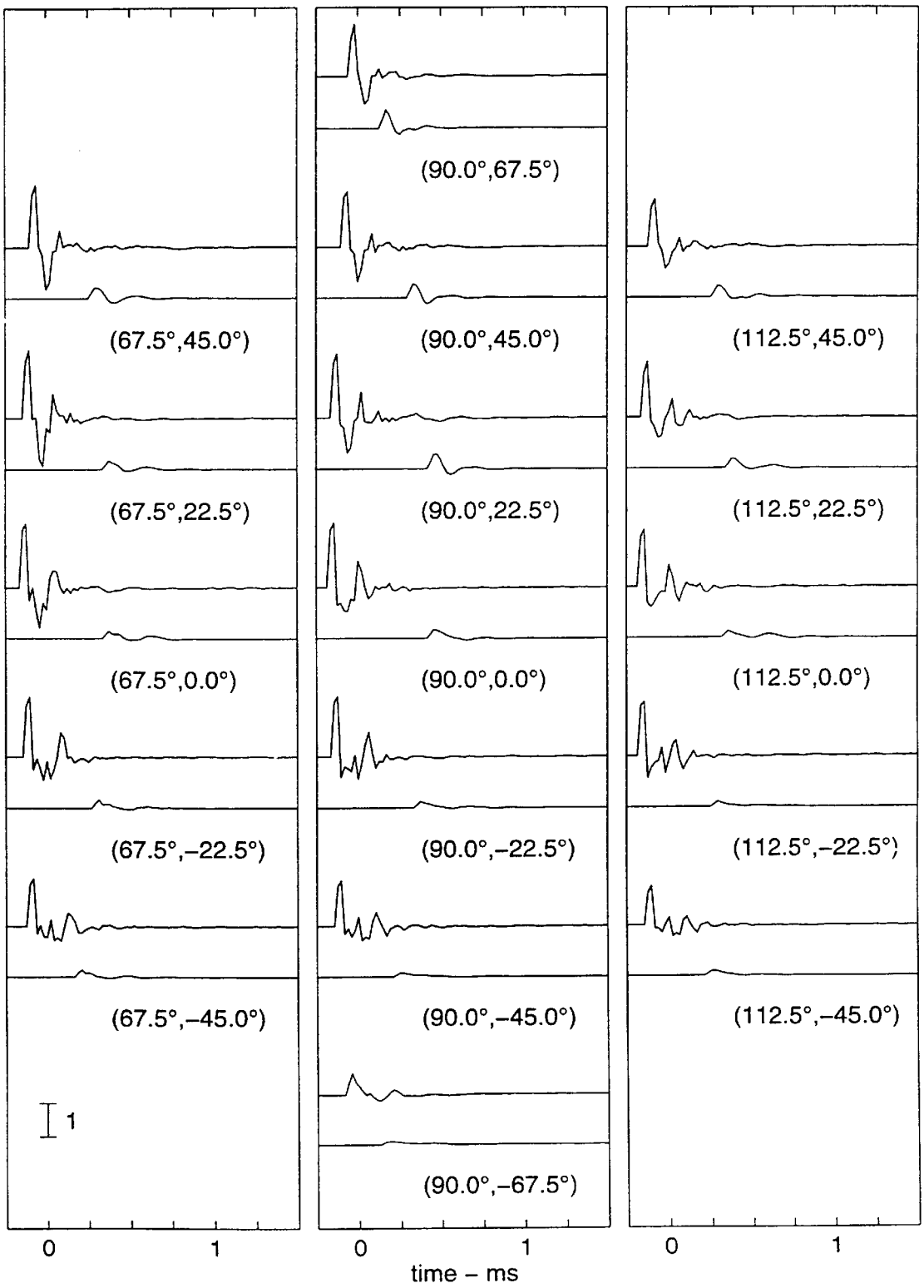
Fig. 2 (2)

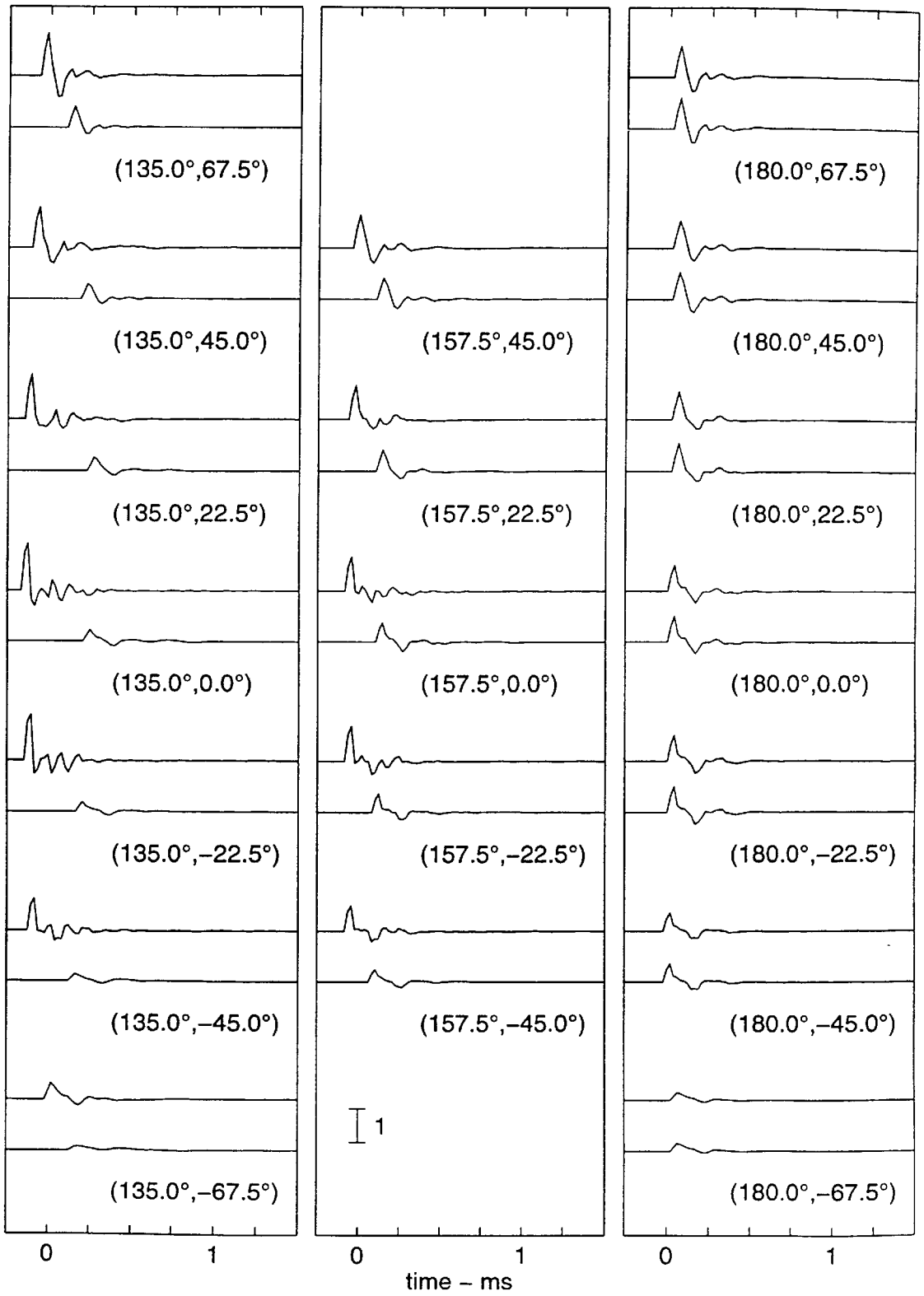
Fig. 2 (3)

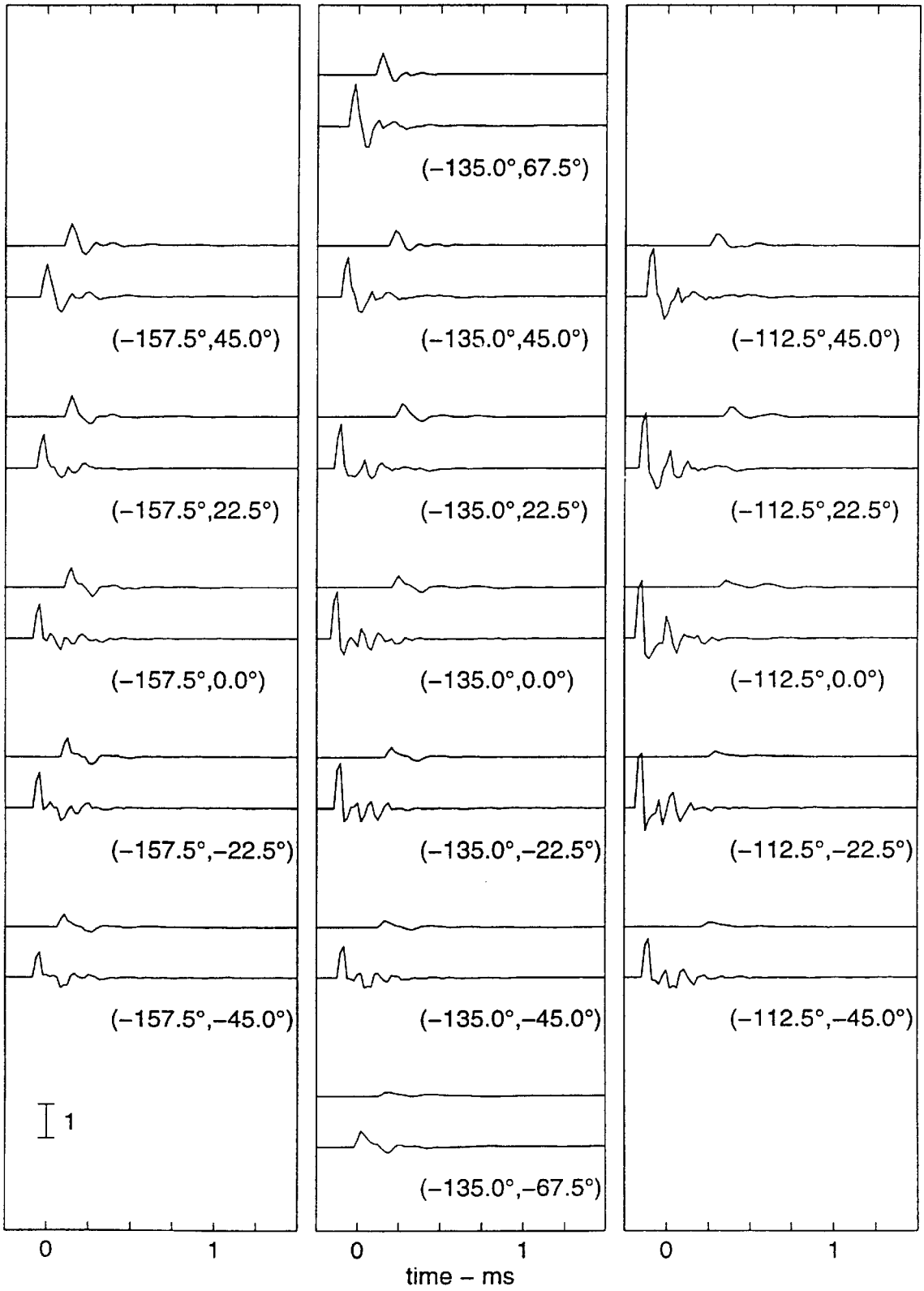
Fig. 2 (4)

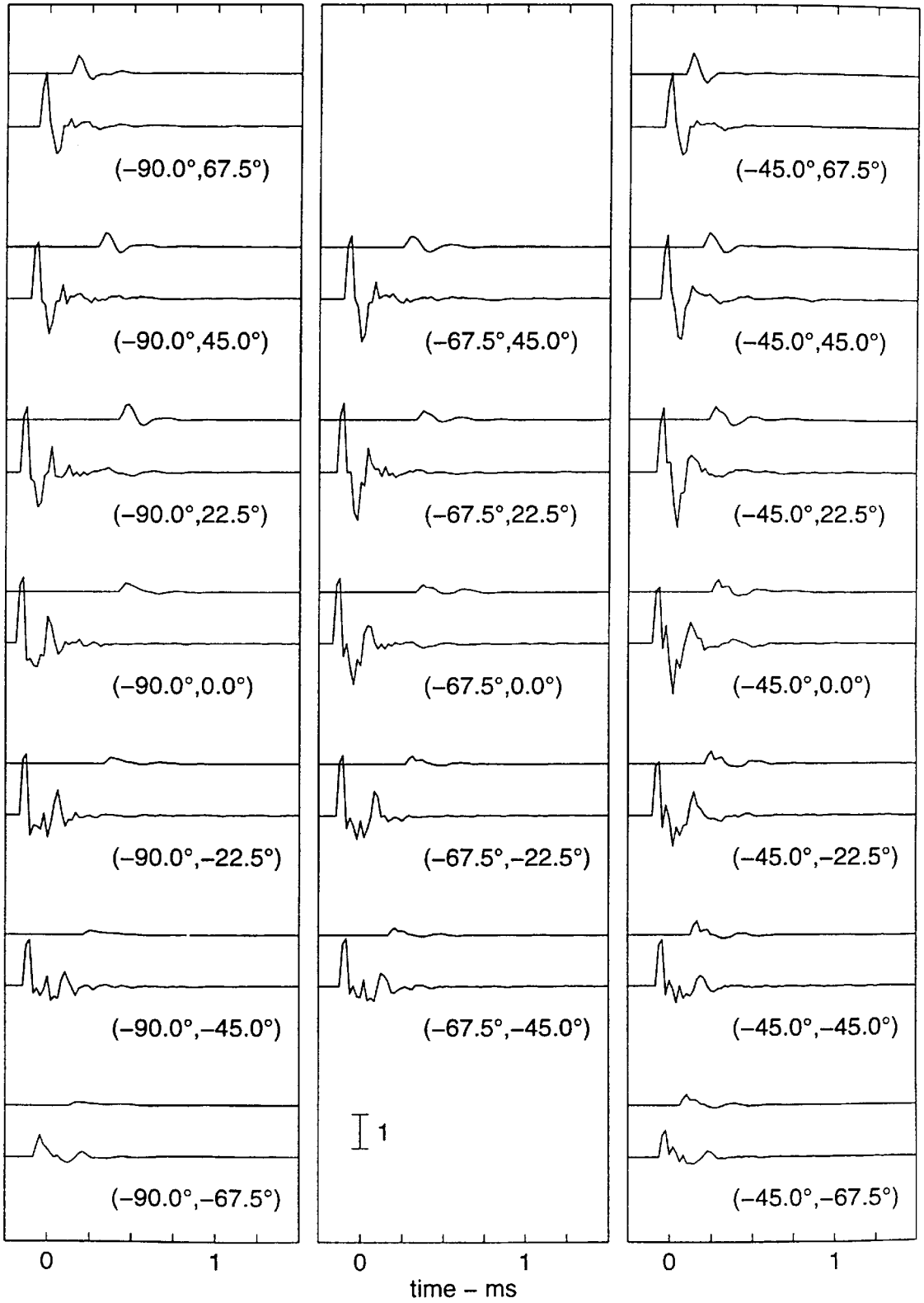
Fig. 2 (5)

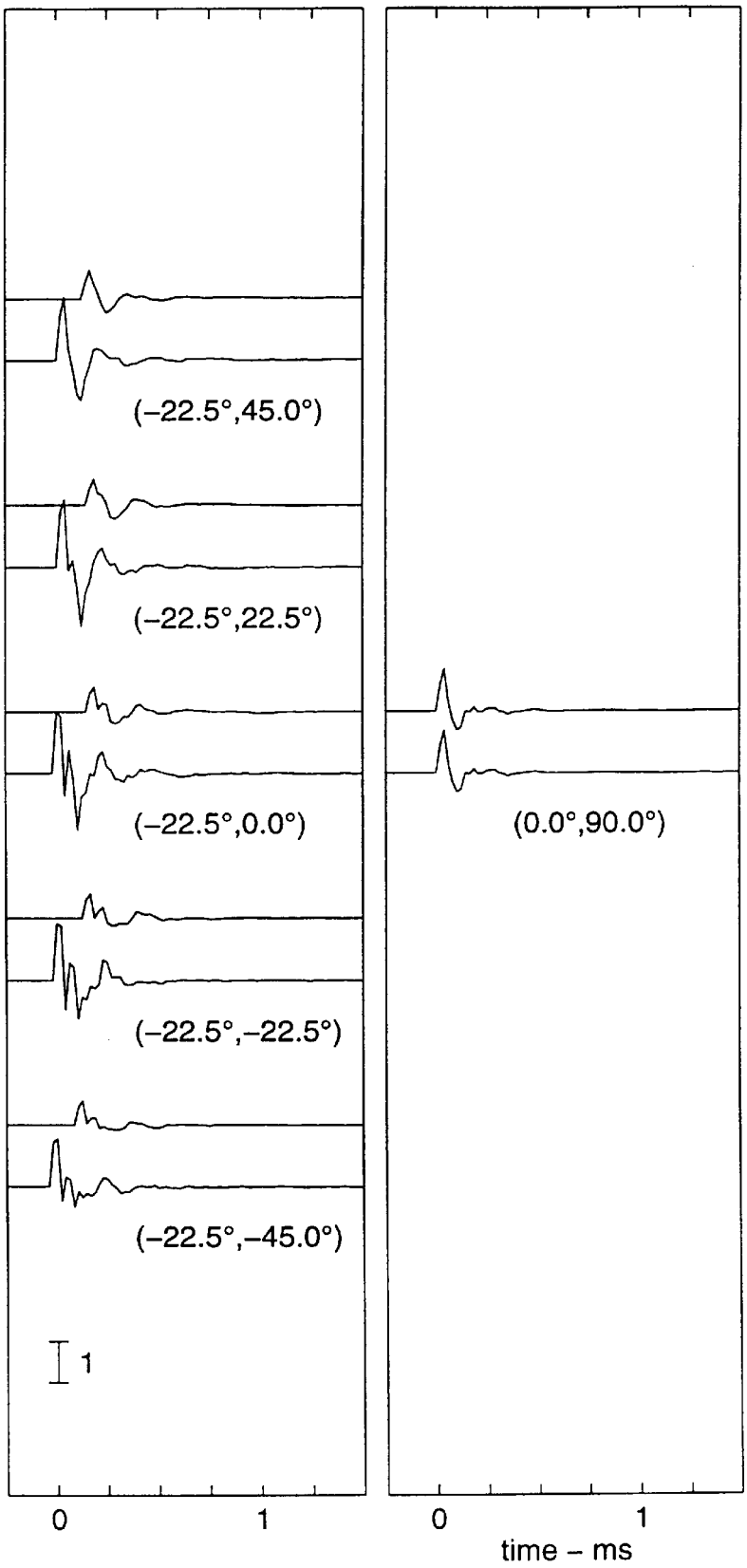
Fig. 2 (6)

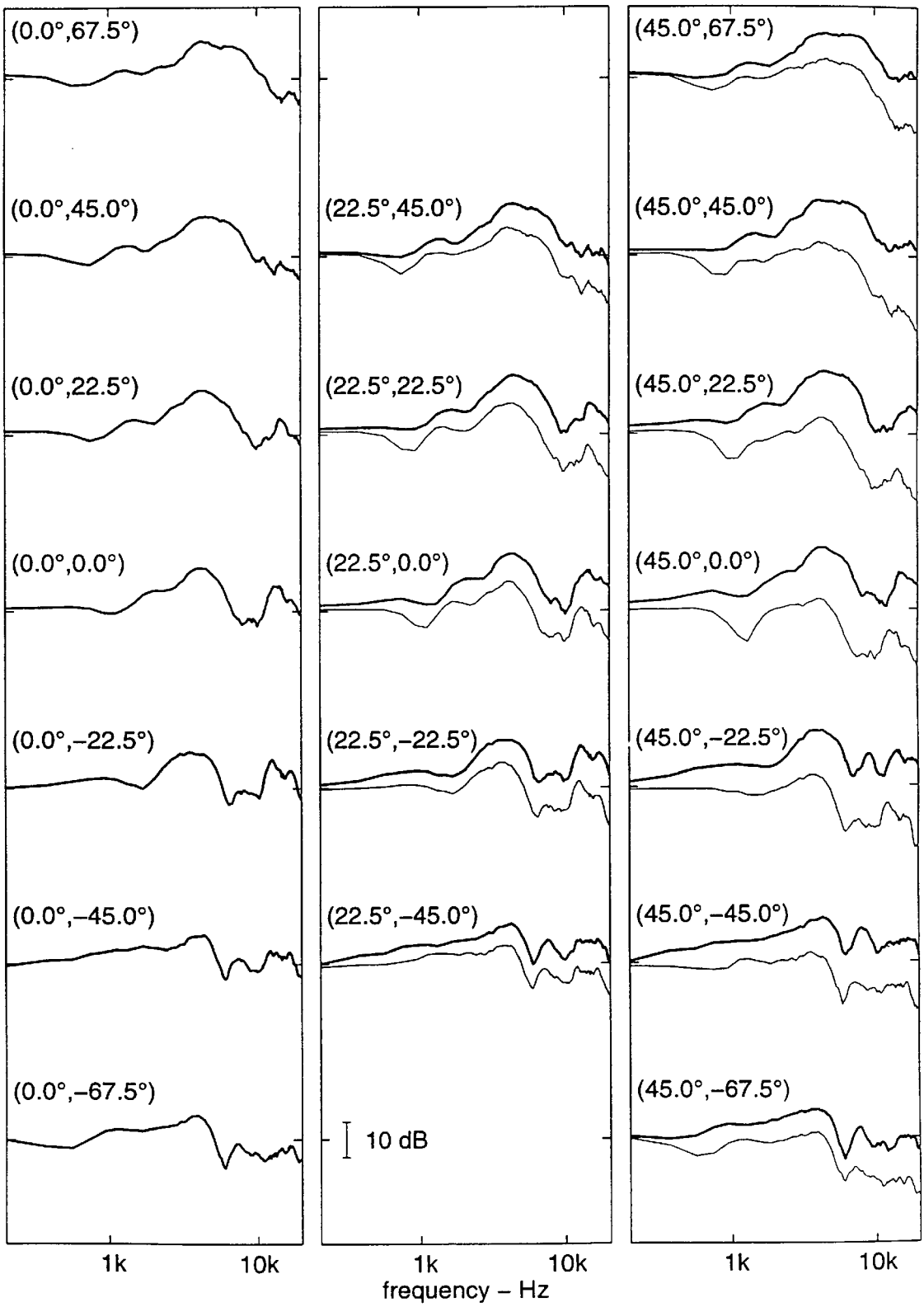
Fig. 2 (7)

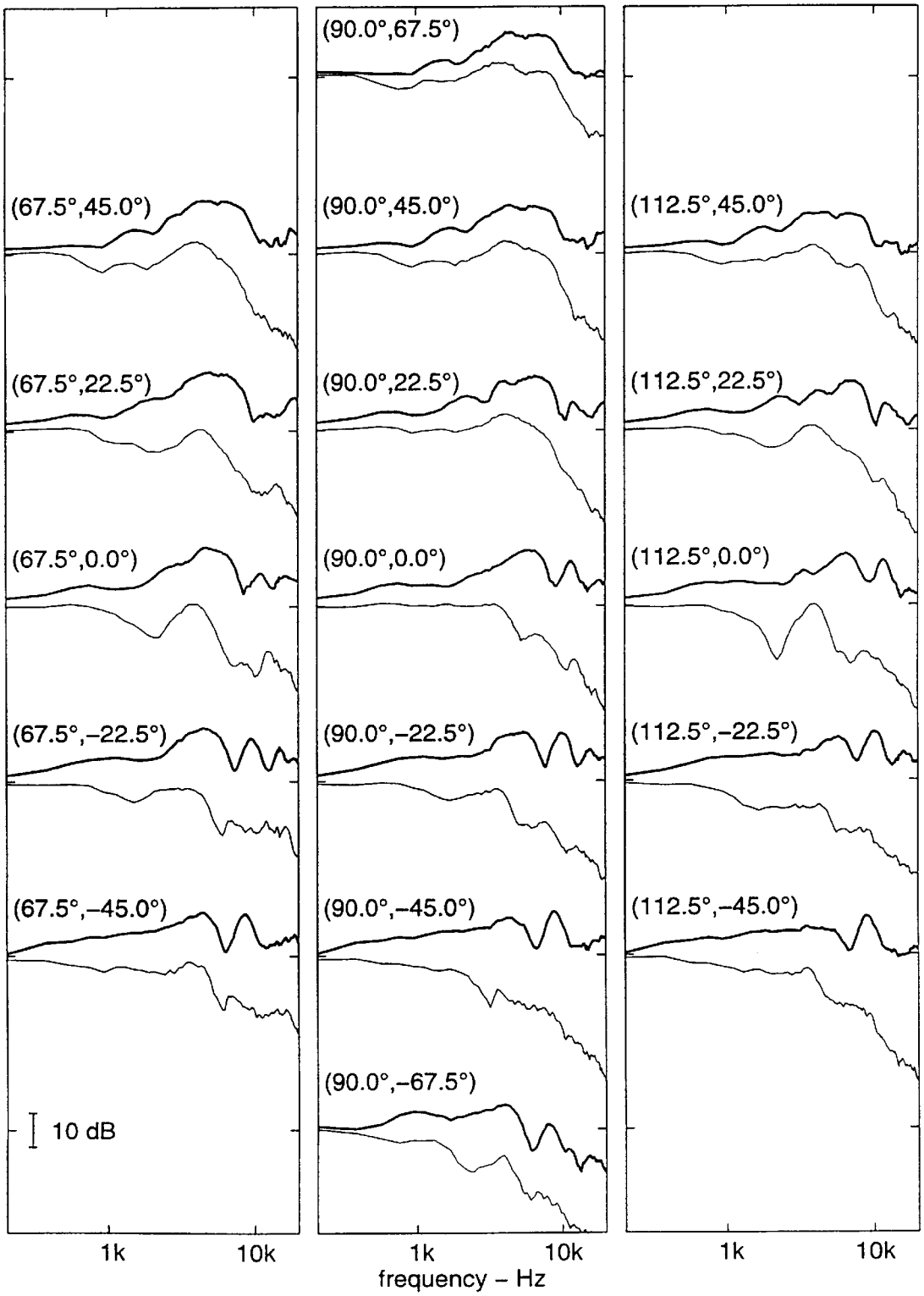
Fig. 2 (8)

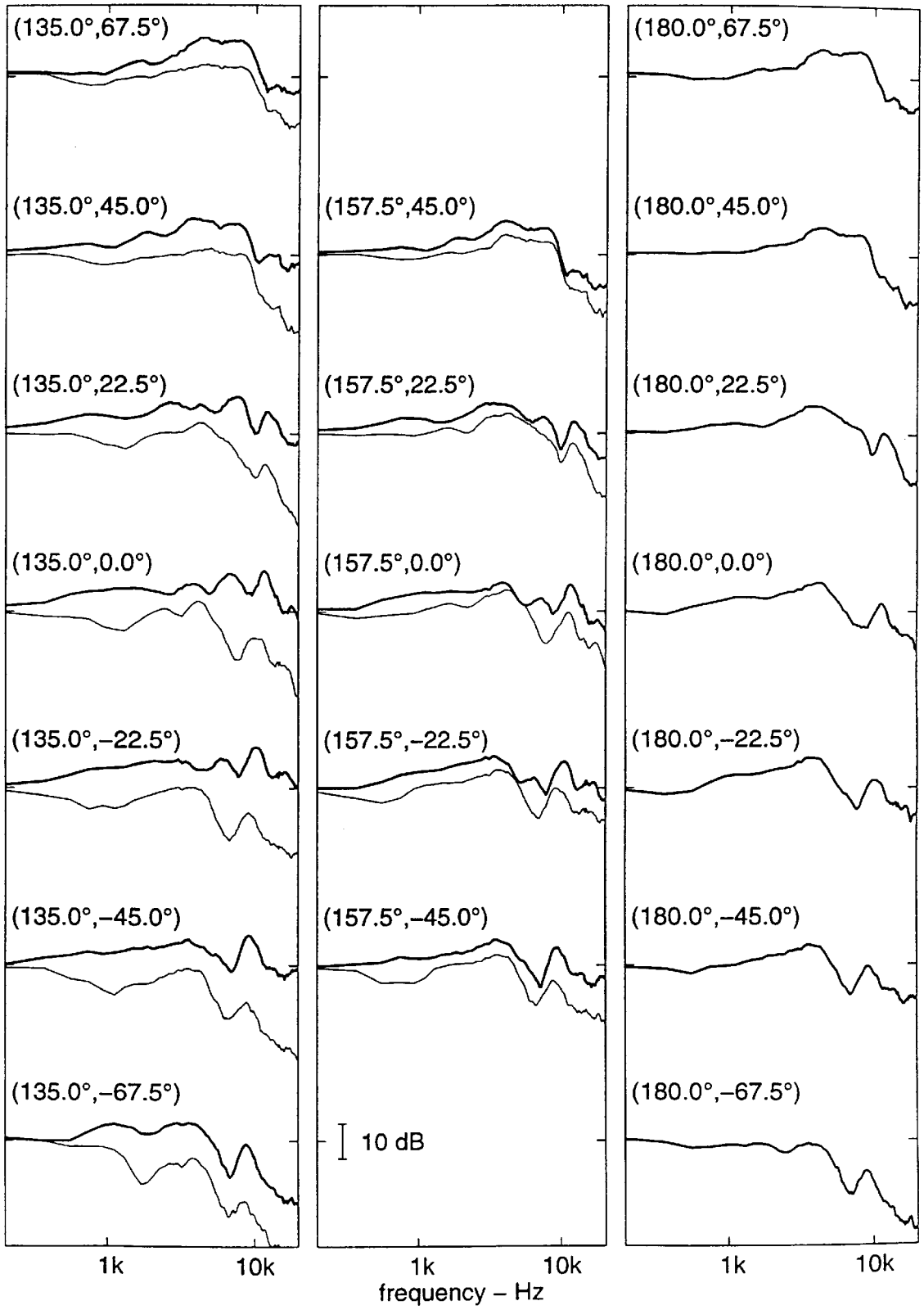
Fig. 2 (9)

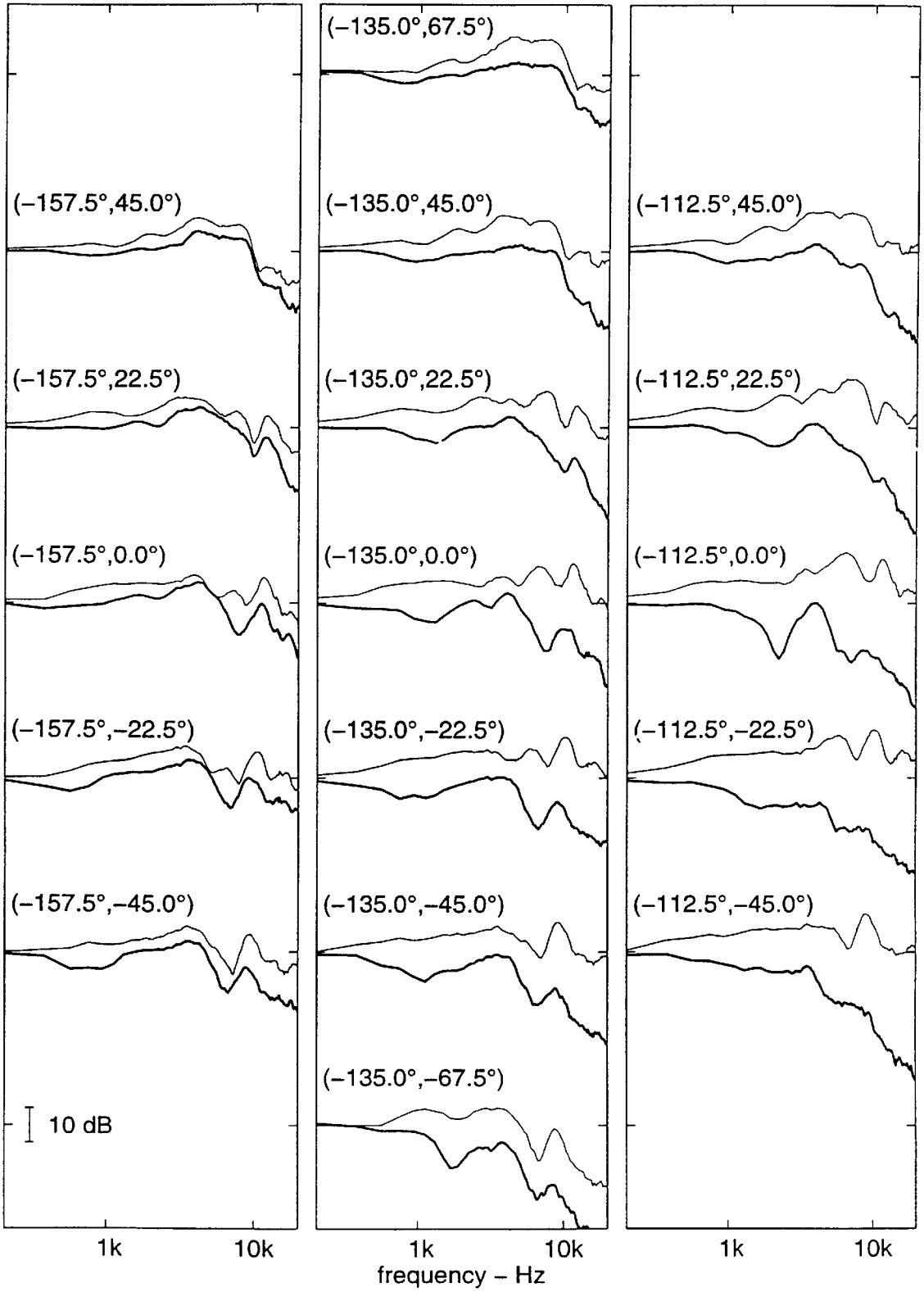
Fig. 2 (10)

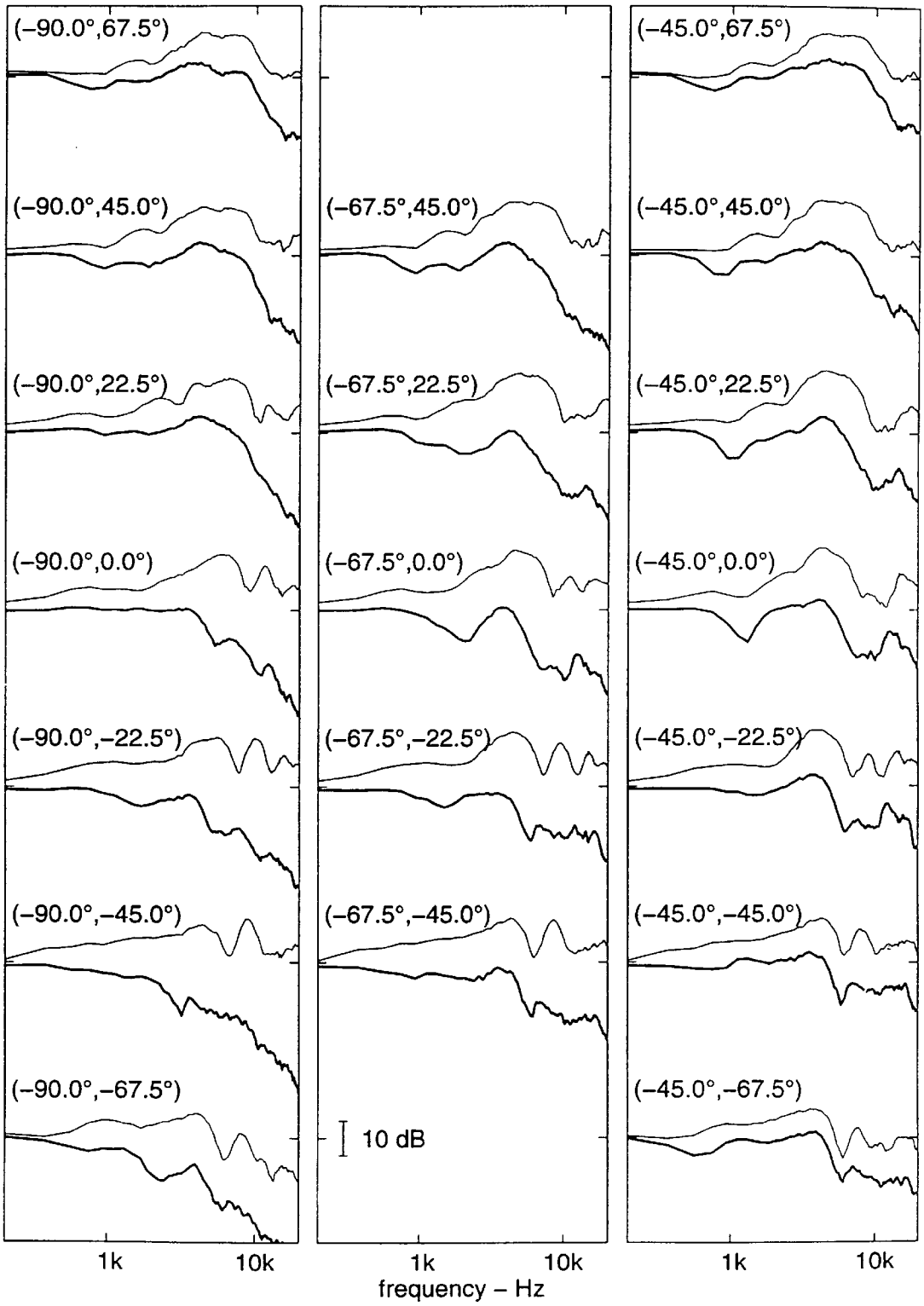
Fig. 2 (11)

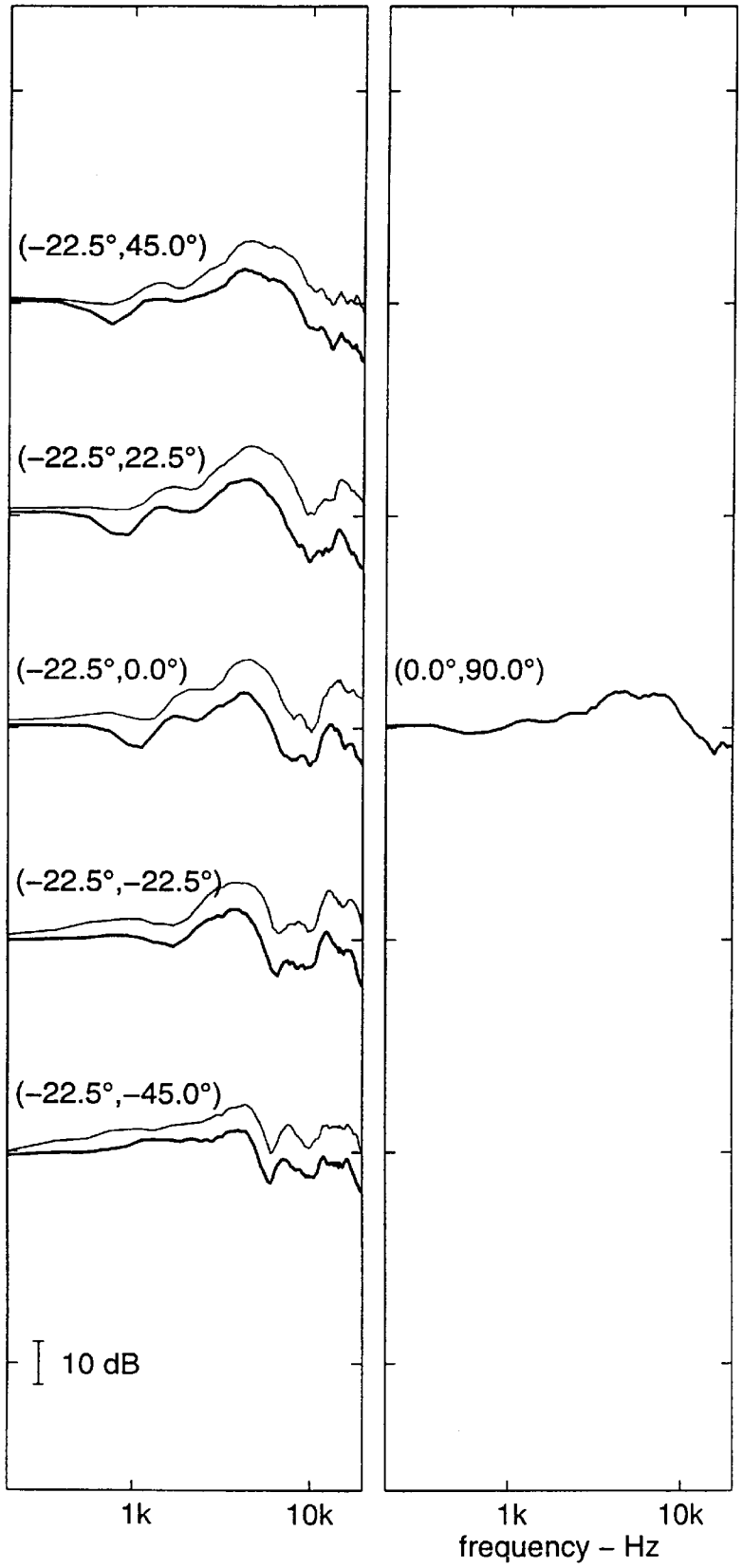
Fig. 2 (12)

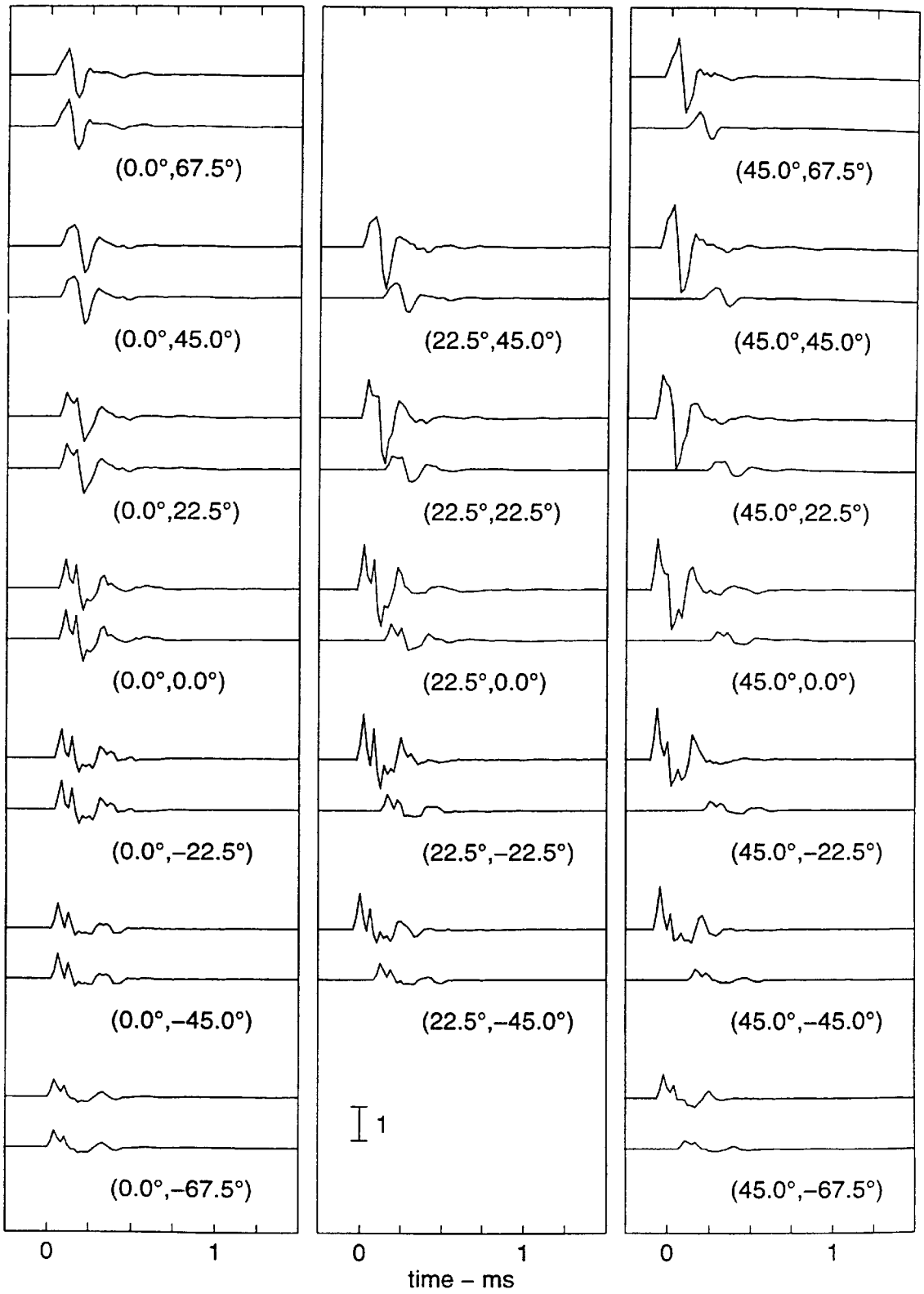
Fig. 3 (1)

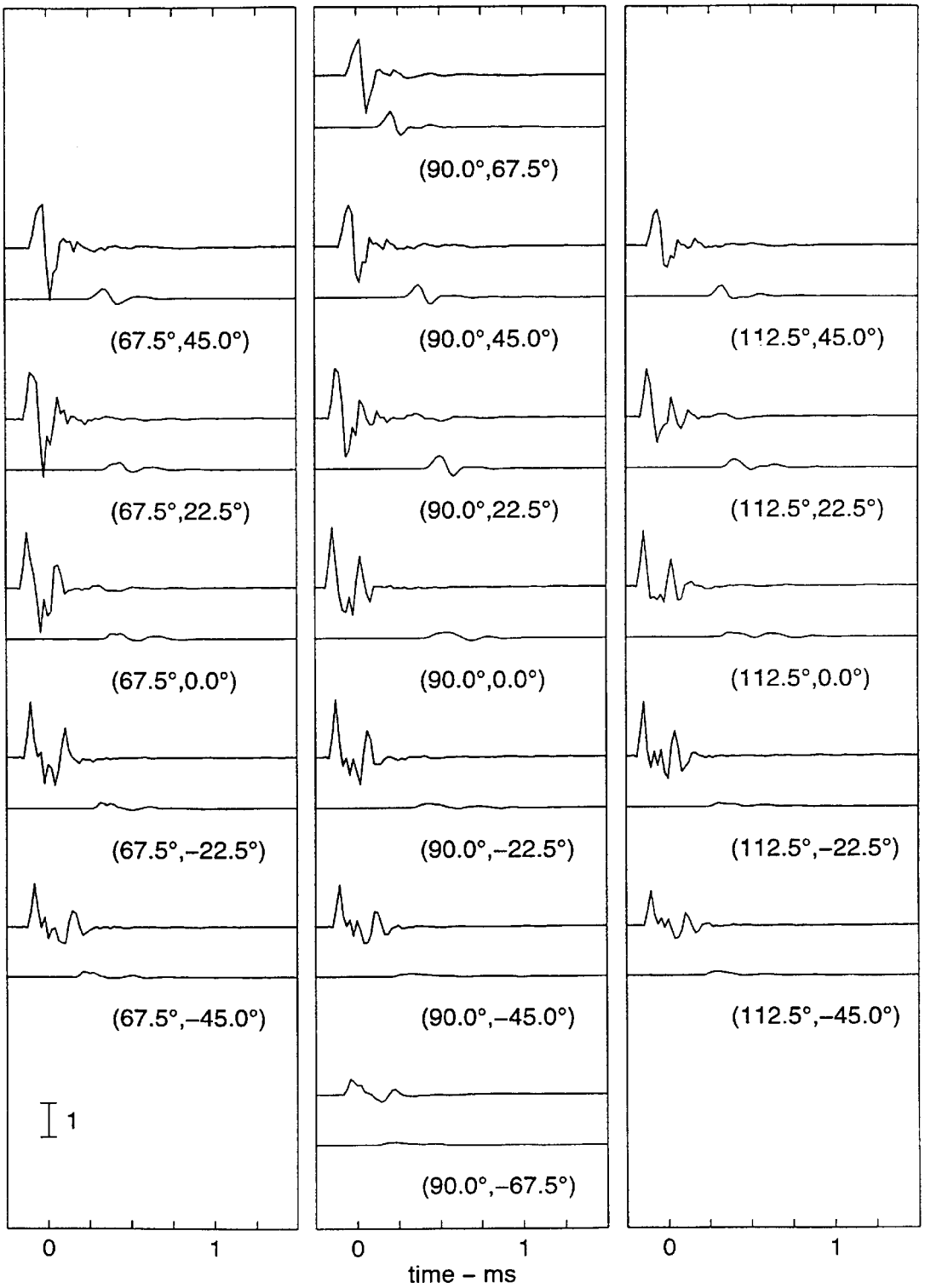
Fig. 3 (2)

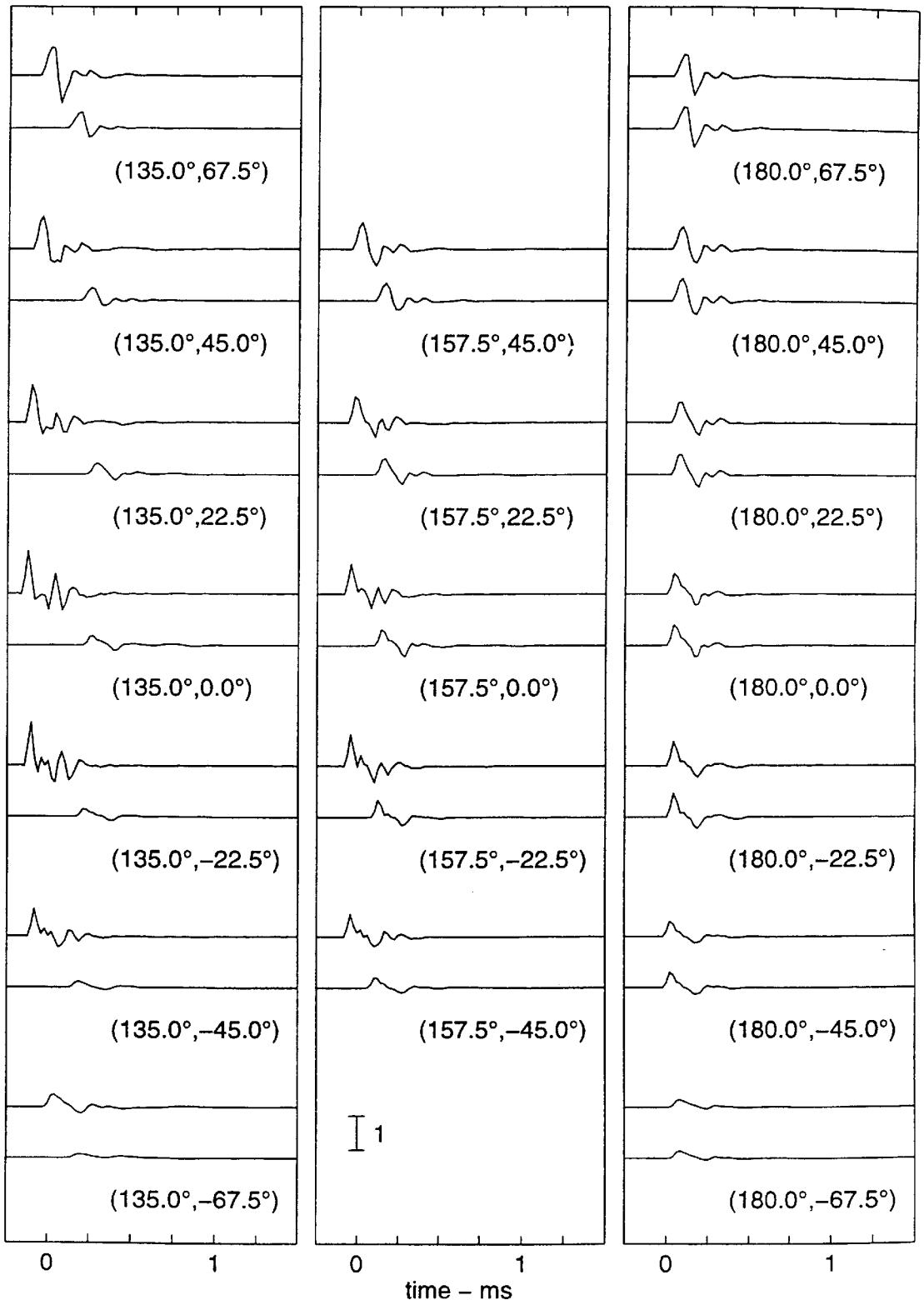
Fig. 3 (3)

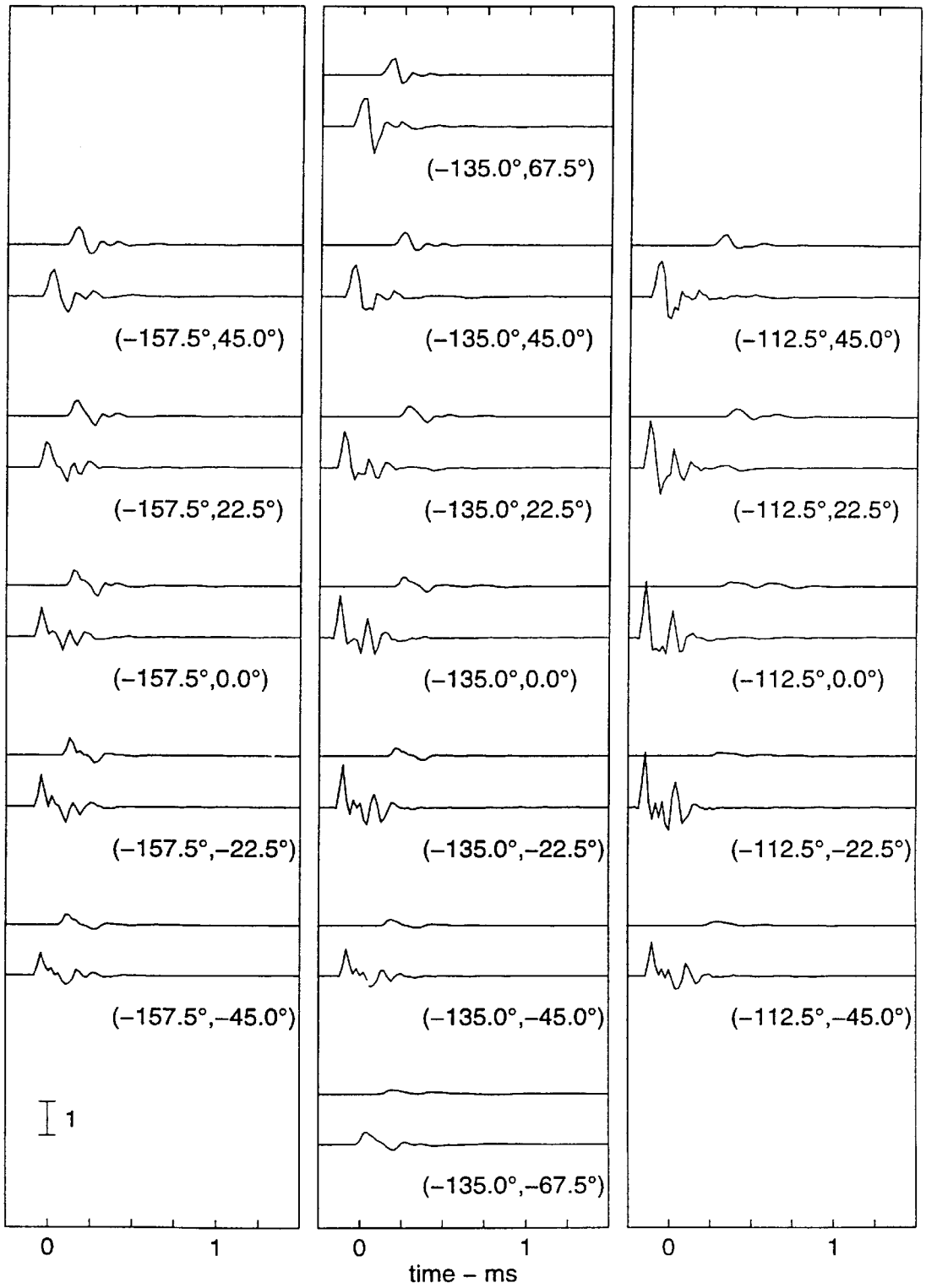
Fig. 3 (4)

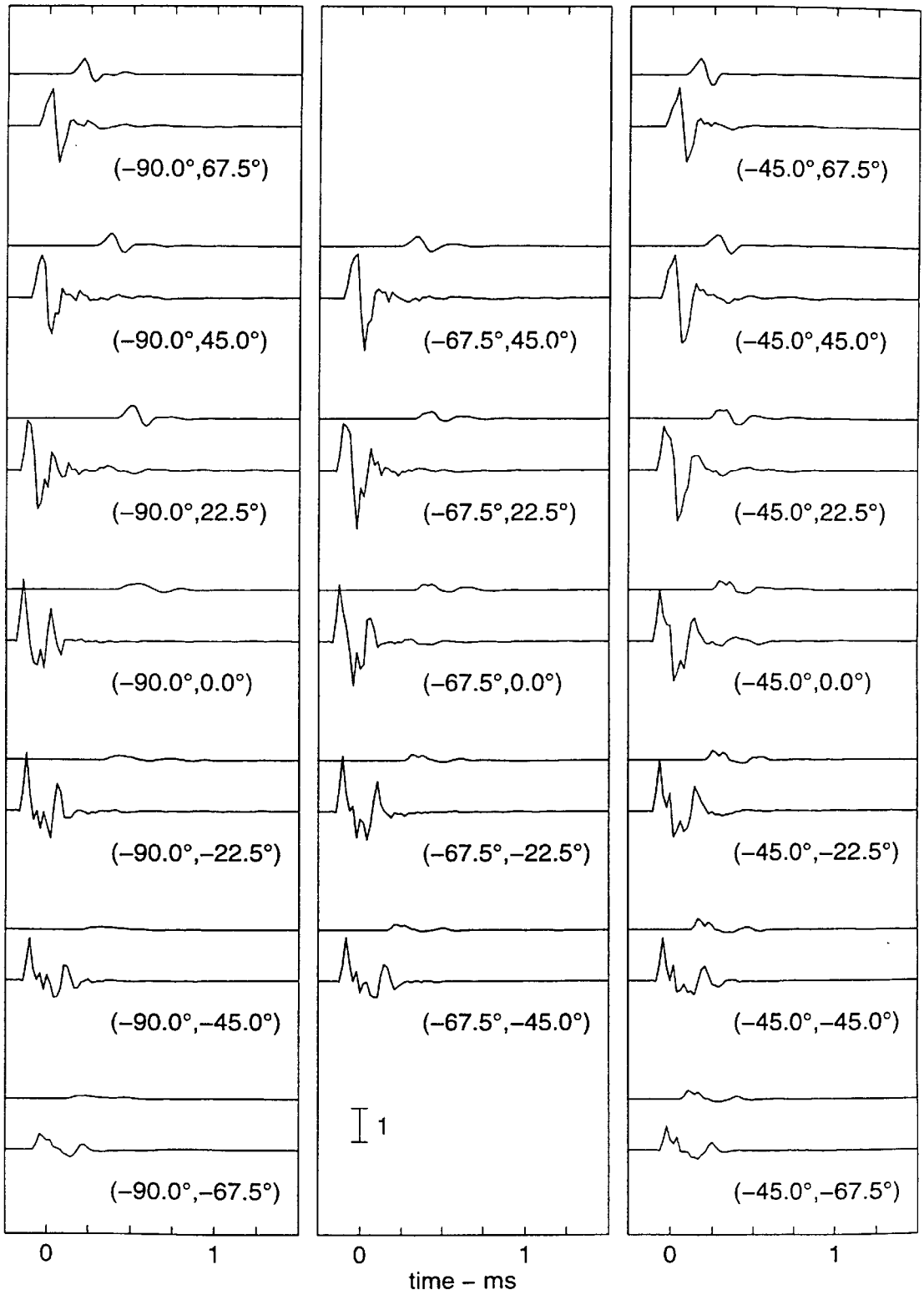
Fig. 3 (5)

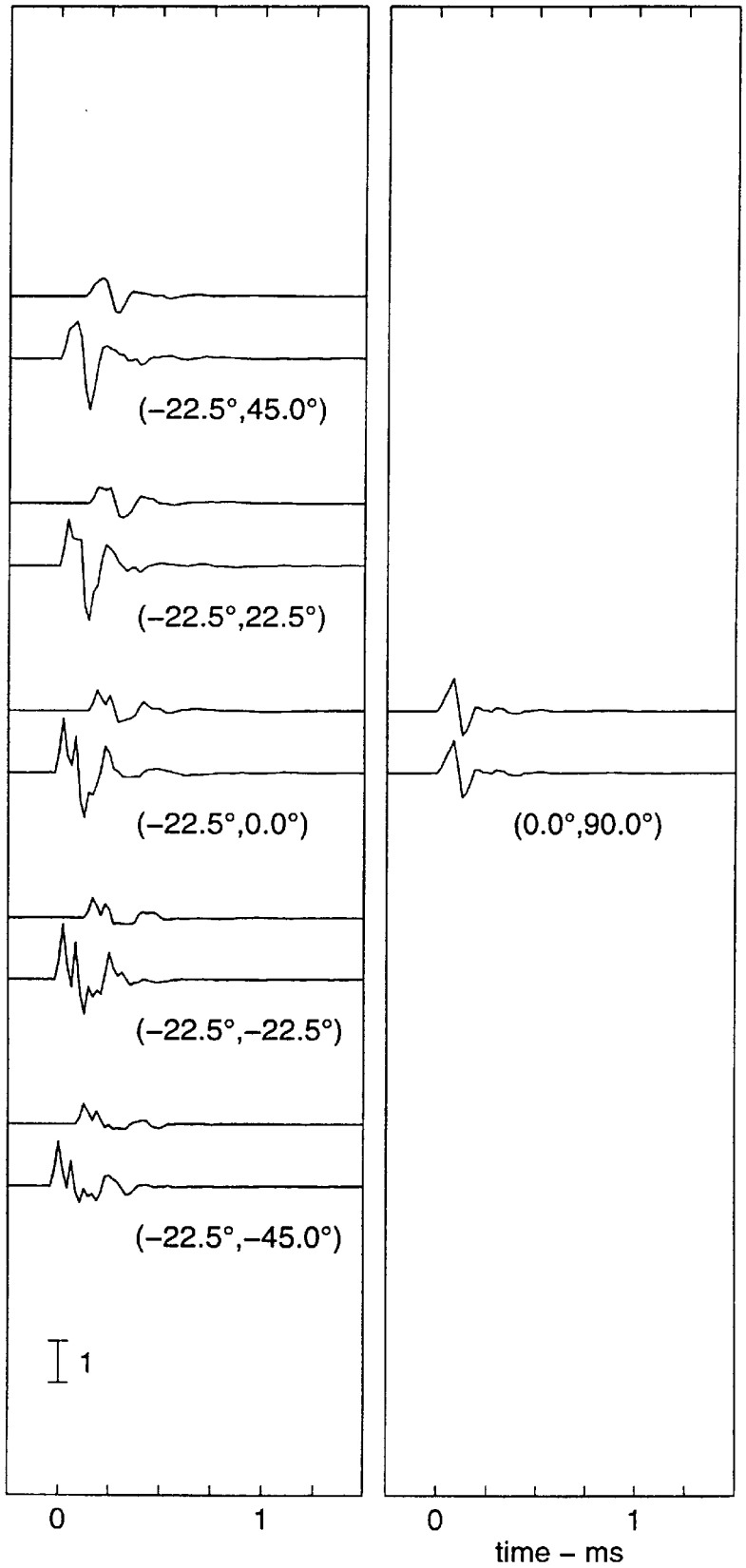
Fig. 3 (6)

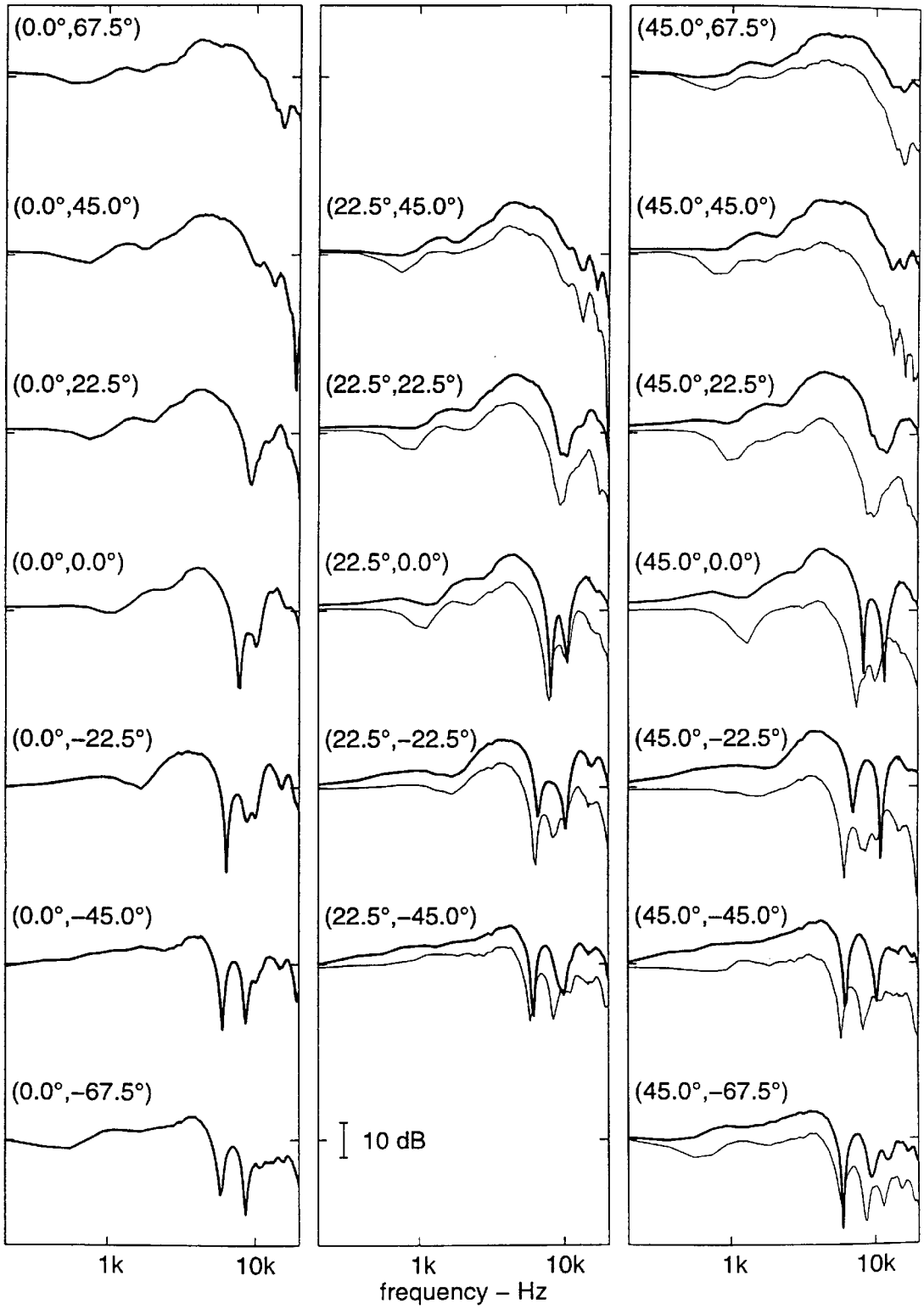
Fig. 3 (7)

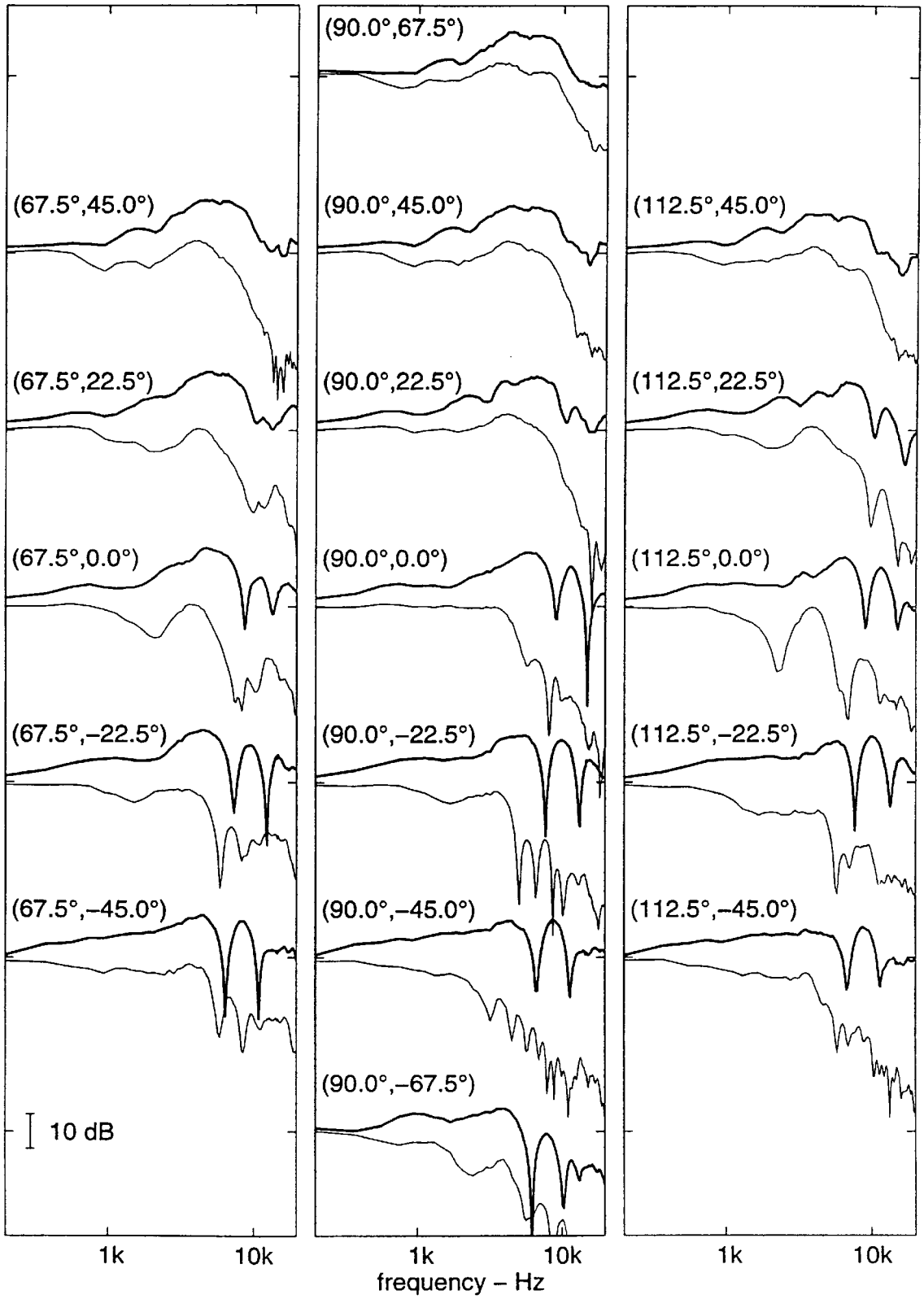
Fig. 3 (8)

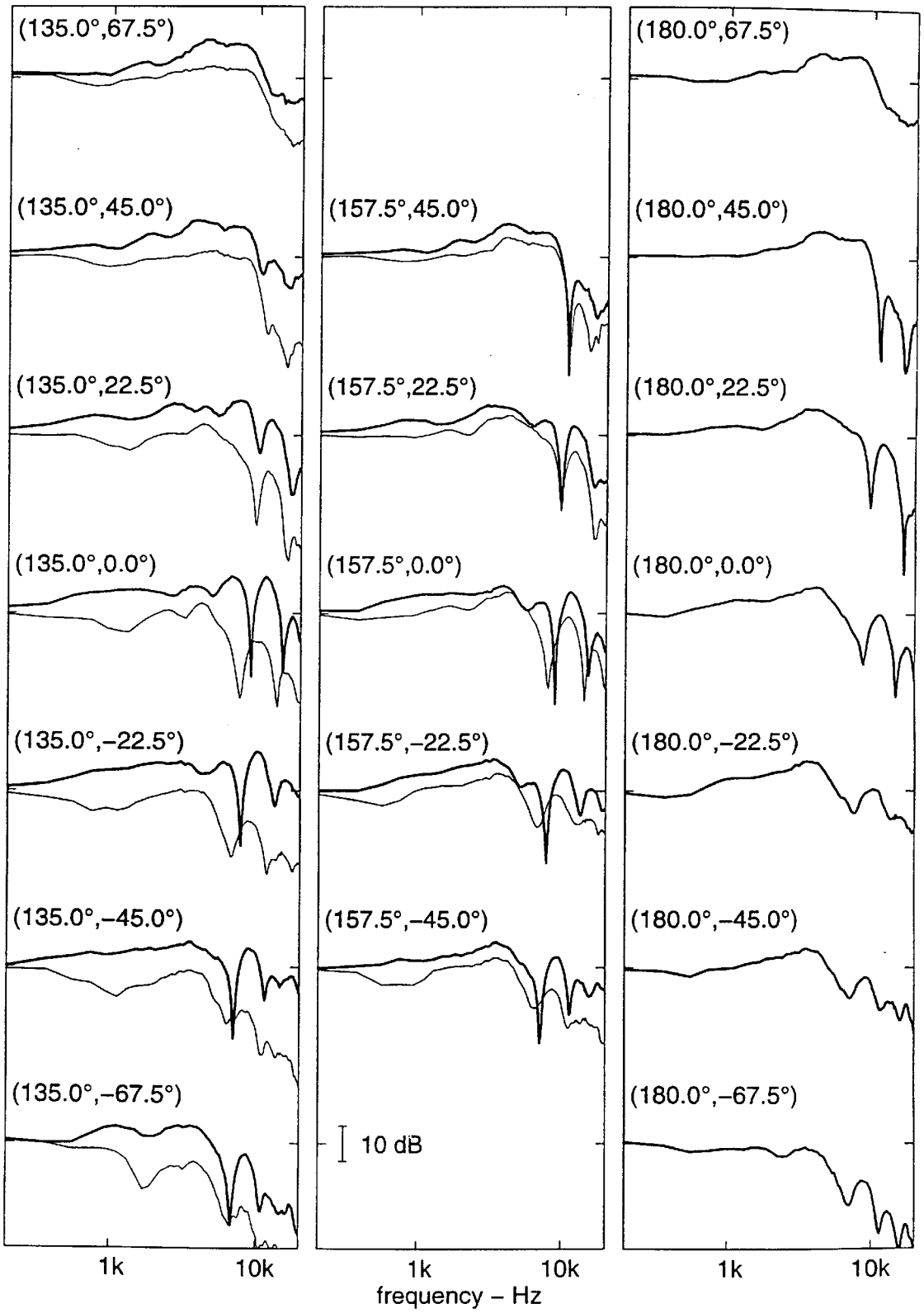
Fig. 3 (9)

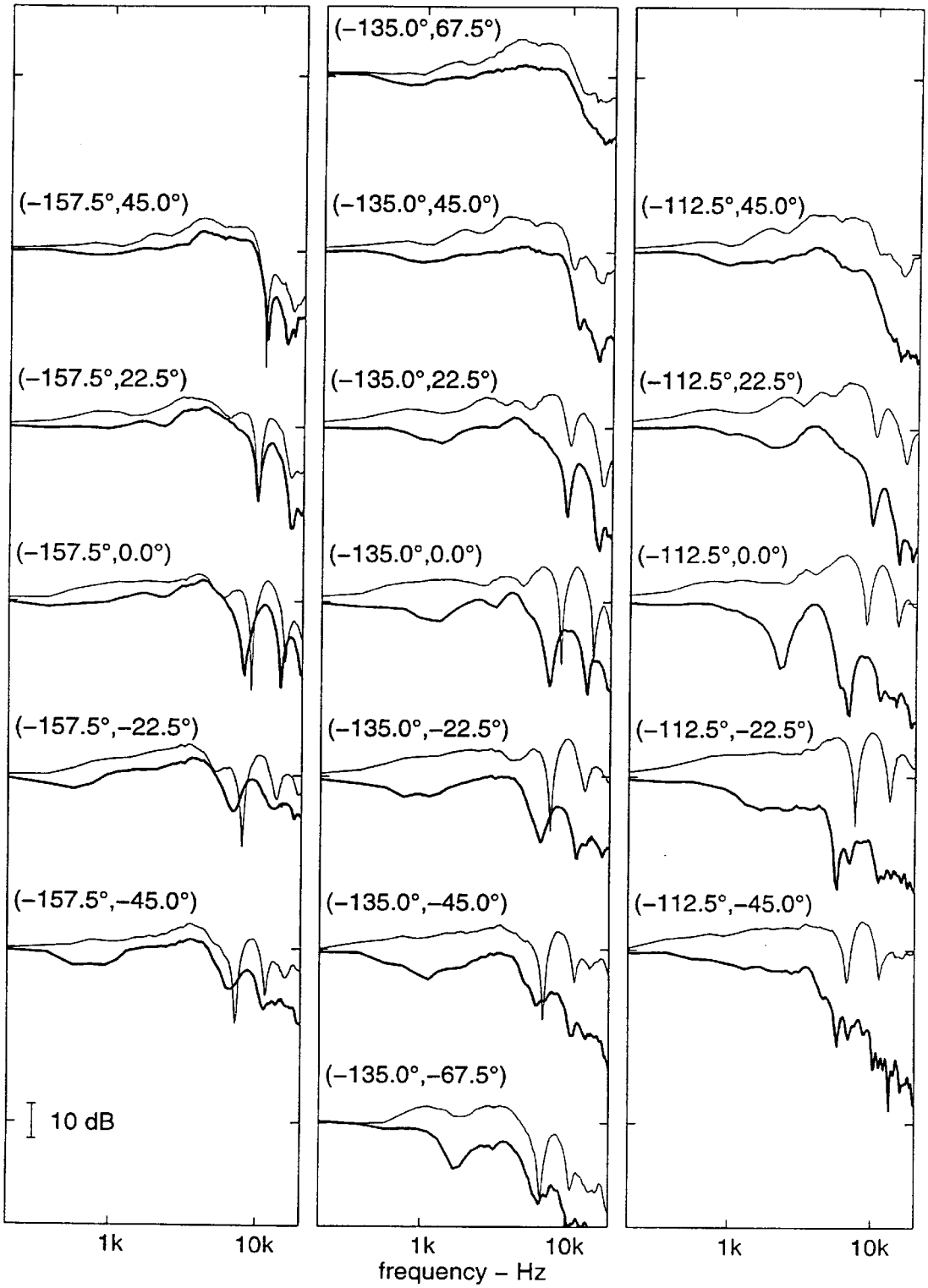
Fig. 3 (10)

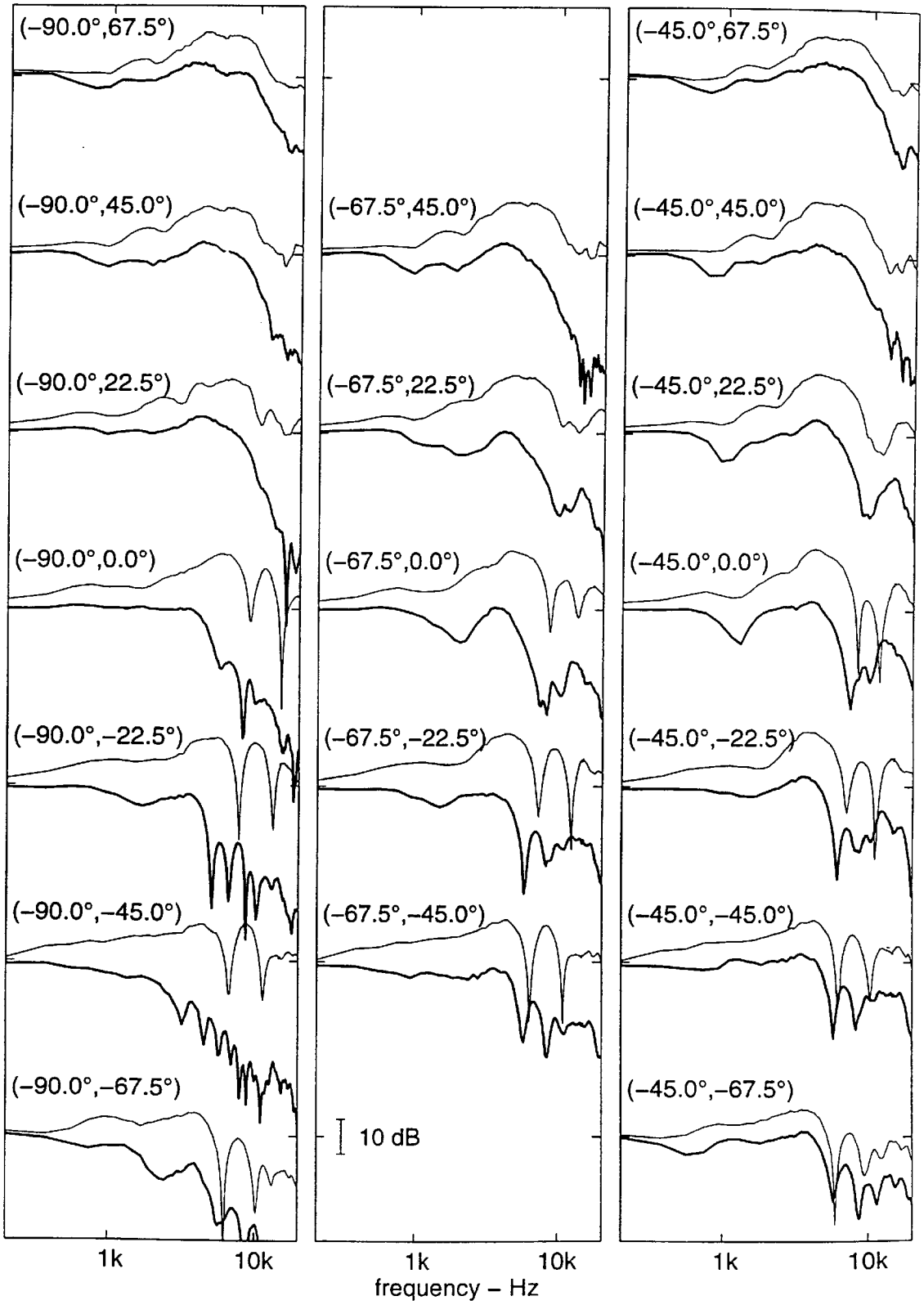
Fig. 3 (11)

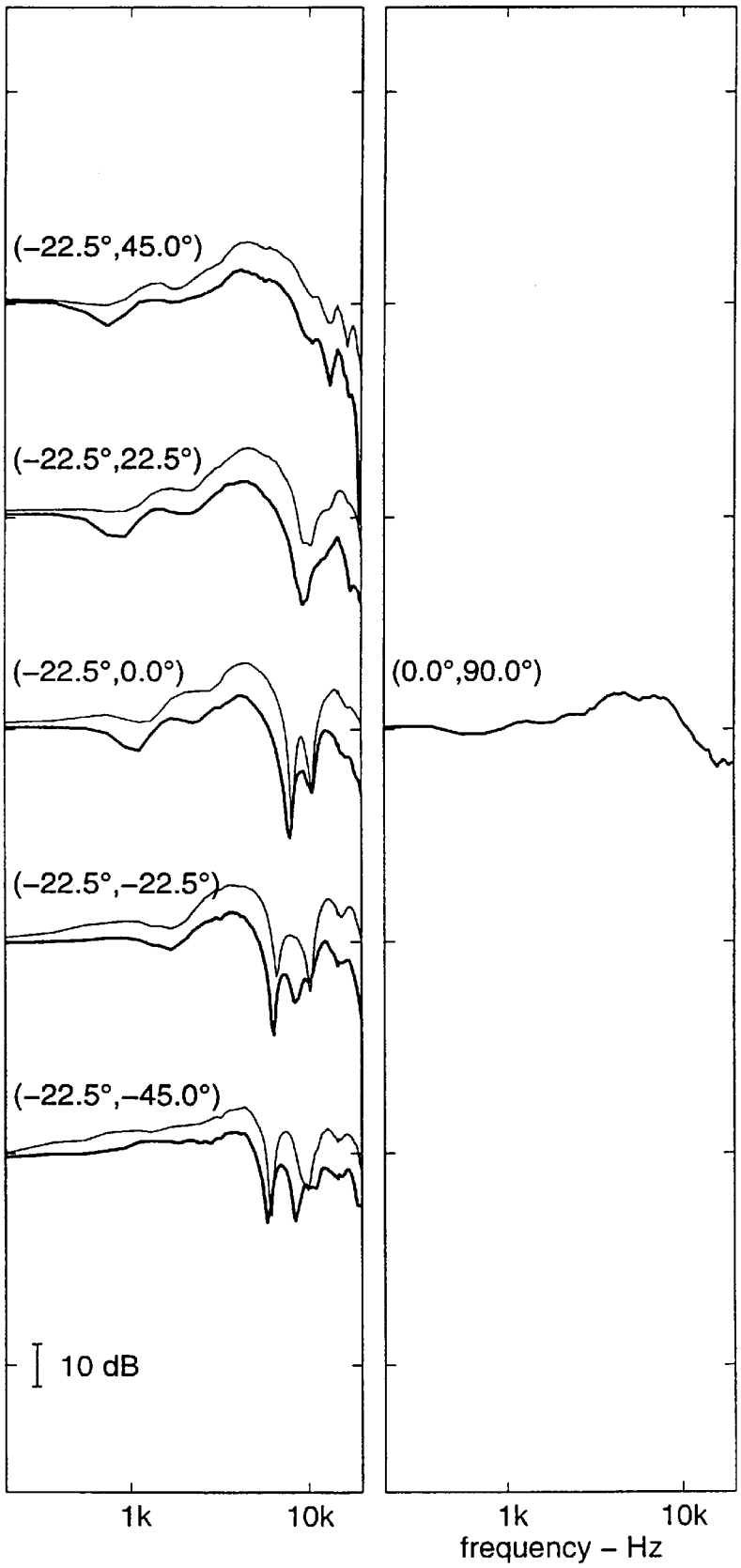
Fig. 3 (12)

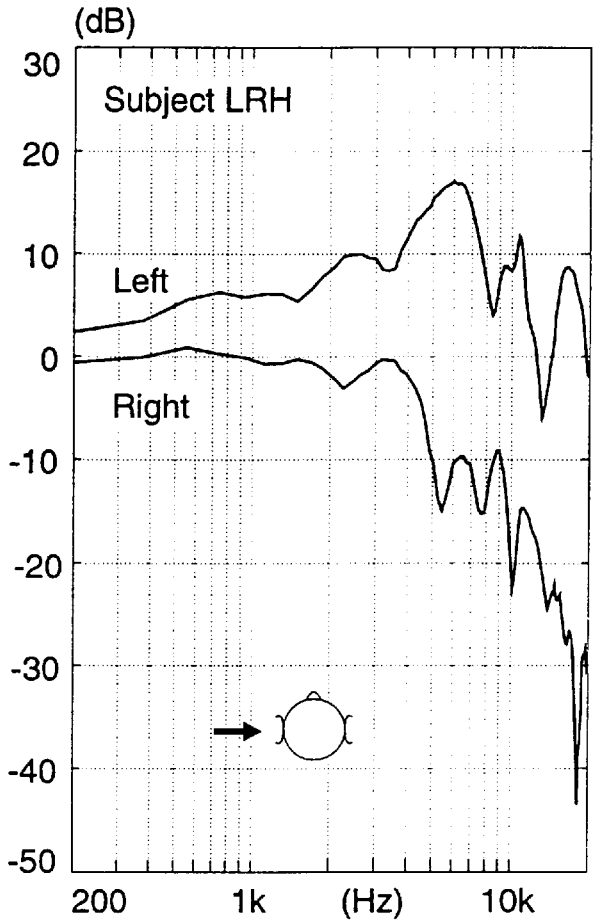
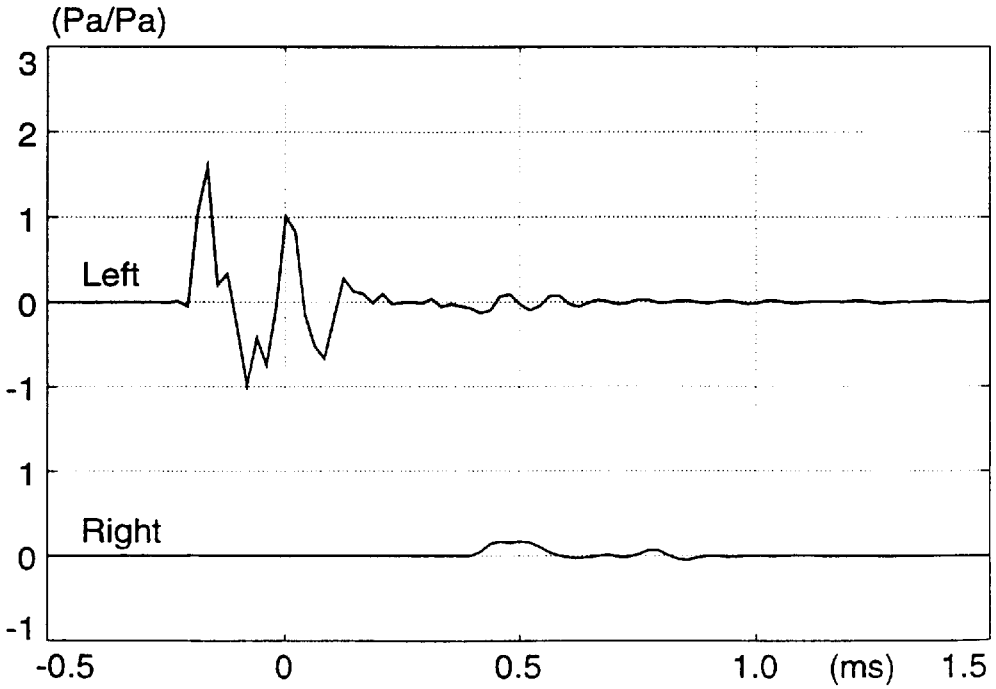
Fig. 7

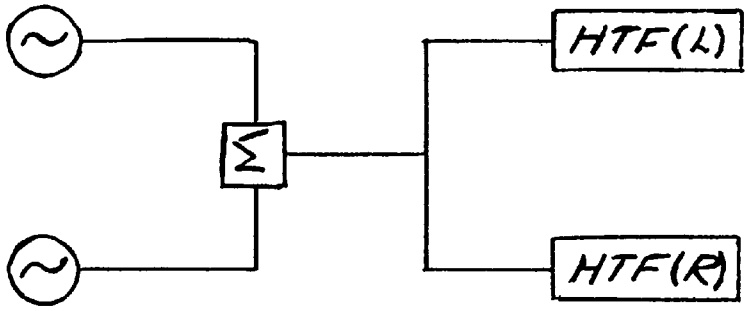
FIG. 25
FIG. 26
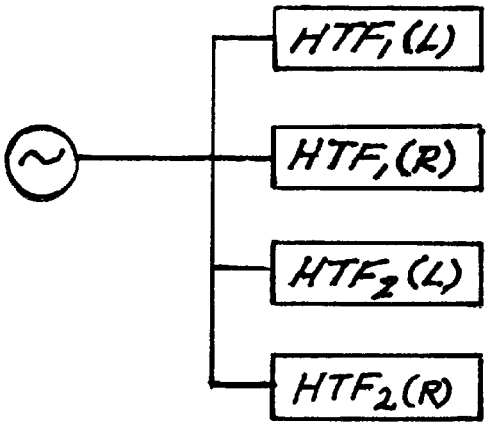
FIG. 27
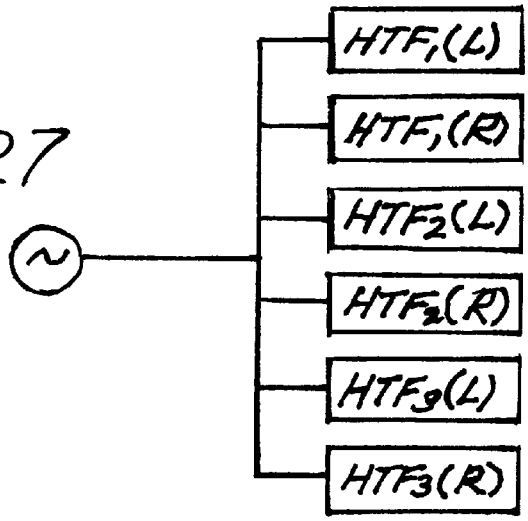

BINAURAL SYNTHESIS, HEAD-RELATED TRANSFER FUNCTIONS, AND USES THEREOF

FIELD OF THE INVENTION

The present invention relates to improved methods and apparatus for simulating the transmission of sound from sound sources to the ear canals of a listener, said sound sources being positioned arbitrarily in three dimensions in relation to the listener. In particular, the invention relates to novel uses of certain Head-related Transfer Functions and the production of such Head-related Transfer Functions, as well as to methods and apparatus using the Head-related Transfer Functions.

BACKGROUND OF THE INVENTION

Human beings detect and localize sound sources in three-dimensional space by means of the human binaural sound localization capability.

The input to the hearing consists of two signals: sound pressures at each of the eardrums. These two sound signals are called binaural sound signals. The term binaural refers to the fact that a set of two signals form the input to the hearing. It is not fully known how the hearing extracts information about distance and direction to a sound source, but it is known that the hearing uses a number of cues in this determination. Among the cues are coloration, interaural time differences, interaural phase differences and interaural level differences. Thorough descriptions of cues to directional hearing are given by J. Blauert: "Räumliches Hören", Hirzel Verlag, Stuttgart, Germany, 1974, and "Spatial Hearing", The MIT Press, Cambridge, Mass., 1983.

This means that if the sound pressures at the eardrums are created exactly as they would have been created by a given spatial sound field, a listener would not be able to distinguish this sound experience from the one he would get from being exposed to the spatial sound field itself.

One known way of approaching this ideal sound reproducing situation is by the artificial head recording technique. An artificial head is a model of a human head where the geometries of a human being which are acoustically relevant especially with respect to diffraction around the body, shoulder, head and ears are modelled as closely as possible. During a recording, e.g. of a concert, two microphones are positioned in the ear canals of the artificial head to sense sound pressures, and the electrical output signals from these microphones are recorded.

When these signals are reproduced, e.g. by headphones, the sound pressures in the ear canals of the artificial head during the concert are reproduced in the ear canals of the listener and the listener will achieve the perception that he was listening to the concert in the concert hall. The signals for the headphones are also called binaural signals.

The term binaural signals designates a set of two signals, left and right, having been coded using transmission characteristics corresponding to the transmission to the two ears of the human listener, for instance to be presented in the left and right ear canals, respectively, of a listener.

The binaural signals may typically be electrical signals, but they may also be, e.g. optical signals, electromagnetic signals or any other type of signal which can be transformed, directly or indirectly, into sound signals in the left and right ears of a human.

The transmission of a sound wave propagating from a sound source positioned at a give n direction and distance in relation to the left and right ears of the listener is described in terms of two transfer functions, one for the left ear and one for the right ear, that include any linear distortion, such as coloration, interaural time differences and interaural spectral differences. These transfer functions change with direction and distance of the sound source in relation to the ears of the listener. It is possible to measure the transfer functions for any direction and distance and simulate the transfer functions, e.g. electronically, e.g. by filters. If such filters are inserted in the signal path between a playback unit such as a tape recorder and headphones used by a listener, the listener will achieve the perception that the sounds generated by the headphones originate from a sound source positioned at the distance and in the direction as defined by the transfer functions of the filters, because of the true reproduction of the sound pressures in the ears.

A set of two such transfer functions, one for the left ear and one for the right ear, is called a Head-related Transfer Function (HTF). Each transfer function is defined as the ratio between a sound pressure p generated by a plane wave at a specific point in or close to the appertaining ear canal ($p_L$ in the left ear canal and $p_R$ in the right ear canal) in relation to a reference. The reference traditionally chosen is the sound pressure $P_1$ generated by a plane wave at a position right in the middle of the head, but with the listener absent. In the frequency domain this HTF is given by:

$$H_L=P_L/P_1,\ H_R=P_R/P_1 \tag{1}$$

where L designates the left ear and R designates the right ear. The time domain representation or description of the HTF, that is the inverse Fourier transform of the HTF, is often called the Head-related Impulse Response (HIR). Thus, the time domain description of the HTF is a set of two impulse responses, one for the left ear and one for the right ear, each of which is the inverse Fourier transform of the corresponding transfer function of the set of two transfer functions of the HTF in the frequency domain.

The HTF depends upon the angle of incidence of the plane wave in relation to the listener. It gives a complete description of the sound transmission to the ears of the listener, including diffraction around the head, reflections from shoulders, reflections in the ear canal, etc.

The definitions given in equation (1) were given by J. Blauert: "Räumliches Hören", Hirzel Verlag, Stuttgart, Germany, 1974.

A tutorial about binaural techniques is given by Henrik Møller: "Fundamentals of Binaural Technology", Applied Acoustics No. 3/4, pp. 171–218, vol. 36, 1992.

As mentioned above, binaural signals may be generated using the artificial head recording and reproducing technique; the artificial head could be substituted with a test person.

Alternatively, binaural signals may be generated by any means that simulate the transmission of sound to the ear canals of humans, such as analog filters, digital filters, signal processors, computers, etc.

U.S. Pat. No. 3,920,904 discloses a method for creating sound pressures at the eardrums of a listener by means of headphones, that correspond to sound pressures which would be created at the eardrums of the listener in a predetermined acoustical environment in response to electrical signals applied to a number of loudspeakers, comprising measurement of the HTFs corresponding to the positioning of the loudspeakers in relation to the listener and simulation of the HTFs with analog electronic filters.

It has also been claimed to be possible to design the simulating filters using a different approach that does not include a measurement of HTFs but relies on knowledge of specific cues to directional hearing. Such an approach is disclosed in U.S. Pat. No. 4,817,149, where a front/back cue is generated by a spectral bias, elevation by a notch filter, and azimuth by a time-shift between the two channels.

BRIEF DISCLOSURE OF THE INVENTION

The present invention is based on intensive research in the field of binaural techniques and provides high quality HTFs as well as a number of other improvements of the binaural techniques and other techniques in which HTFs are used.

Thus, the invention provides, inter alia, new and improved methods for measurement of HTFs, new and improved HTFs, new and improved methods for processing HTFs, new methods of changing, or of maintaining, the directions of the sound sources as perceived by a listener, and as one of the most important utilizations thereof, new methods for binaural synthesis.

One object of the present invention is to provide HTFs for which the differences between the gains, in the frequency domain, of a HTF from one human to another are very low, or the differences between the corresponding time domain descriptions of the HTFs are very low. The inventors have carried out a major study of a number of HTFs for a number of different individuals, for a number of different directions, and for a number of different measurement points in the external ear of the individual, i.e. inside the ear canal or in the vicinity of the entrance to the ear canal. During this study the inventors have improved the measurement method so that it is now possible to measure and/or construct HTFs for which the time domain descriptions are surprisingly short and for which the differences from one individual to the other are surprisingly low.

According to the present invention, a group of HTFs with advantageous features has been provided that can be exploited in any application concerning measurement or reproduction of sound, such as in the design of electronic filters used in the simulation of sound transmission from a sound source to the ear canals of the listener or in the design of an artificial head that is designed so that its HTFs approximate the HTFs of the invention as closely as possible in order to make the best possible representation of humans by the artificial head, e.g. to make artificial head recordings of optimum quality.

Further, the present invention provides methods of extracting or constructing, for each direction of a sound source in relation to the listener, a function that represents the human HTFs of a group of humans which function can be used as the design target in different applications, such as the design of an artificial head or the design of signal processing means.

Still further, the present invention provides a new method of interpolation whereby a virtual distance and direction of a virtual sound source can be created based upon transfer functions corresponding to different directions.

DETAILED DISCLOSURE OF THE INVENTION

One main aspect of the invention relates to a method of generating binaural signals by filtering at least one sound input with at least one set of two filters, each set of two filters having been designed so that the two filters simulate the left ear and the right ear parts of a Head-related Transfer Function (HTF), the method showing at least one of the features a)–c)

a) the HTF is used generally for a population of humans for which the binaural signals are intended, the HTF being determined in such a manner that the standard deviation of the amplitude, in dB, between subjects, over at least a major part of the frequency interval between 1 kHz and 8 kHz is at the most as shown in FIG. 22 for at least one of the curves thereof, b) the duration of the time domain representation of the transfer function of the filters simulating the HTF is at the most 2 ms, c) the value at zero Hertz of the frequency domain description of the transfer function of the filters simulating the HTF is in the range from 0.316 to 3.16.

With respect to feature a):

An important aspect of the invention relates to the utilization of "general" HTFs in binaural synthesis. The term "general" refers to the very desirable fact that it is now possible to generate binaural signals using "general" HTFs that typically differ from the HTFs of a listener and still provide to the listener a high quality auditive experience with a high quality of sound reproduction and a distinct localization of the virtual sound sources. A "general" HTF or a set of general" HTFs can be defined as an HTF for an individual subject of a population or a set of HTFs for individual subjects of a population, for a particular angle of sound incidence, the HTF or HTFs being determined in such a manner that the standard deviation of the amplitude, in dB, between subjects, over at least a major part of the frequency interval between 1 kHz and 8 kHz is at most as shown in FIGS. 22–24 for at least one of the curves the of the figure in question. In the present context, the term "over a major part of the frequency interval" indicates that in the logarithmic representation of FIGS. 22–24, the standard deviation will be at the most a value identical to the value of the curve at the frequency in question over a major part of the frequency interval, seen in the same logarithmic representation. In other words, the condition is complied with when, over at least 51% of the millimeters of X axis representing the frequency range between 1 kHz and 8 kHz, the standard deviation is less than or at the most identical to the value represented by the curve in question. This definition does not indicate that the standard deviation will be higher than the curve value in the range of 100 Hz to 1 kHz which is also shown in the figures—will always or almost always be lower than the curve value or at the most identical with the curve value, but the definition focuses on the part of the curve, between 1 kHz and 8 kHz, which is much more critical with respect to "generality". It is, of course, preferred that the condition is complied with over a higher proportion of the frequency range, such as at least 75% or at least 90%, and most preferred that it is complied with at all frequencies such as is the case in the results reported herein, but even the least stringent condition defined above will represent a high degree of generality.

As appears from FIGS. 22–24 and the appertaining discussion, extremely low variations can be obtained and have been obtained between subjects, in particular for the most important angles of sound incidence. This means that "general" high quality HTFs can now be used for all the various purposes for which HTFs are used, thus very significantly increasing the practical commercial usefulness of HTFs and techniques related thereto, such as binaural techniques, in particular binaural synthesis.

As the anatomy of humans shows a substantial variability from one individual to the other and as the HTFs of a human among other things are determined by diffractions and reflections around the head and pinna and the transmission characteristics through the ear canals, it is intuitively understood that the HTFs are different for different individuals. In the prior art, these differences are considered to be large. Experiments have been performed where binaural signals have been generated using HTFs from another person than the listener, whereby the listeners auditive experience have been disappointing, among other things due to a diminished ability of localizing the virtual sound sources from the binaural signal. Thus, in the art, the variability of HTFs among humans is considered to be a major impediment for the use of one set of HTFs for different listeners. For example, it is reported that: "Substantial intersubject variability in the HRTF for a single source position is to be expected, given differences in head size and pinna shape. This HRTF variability has been reported before (Shaw 1966) and is prominent in our data. (. . .) FIG. 3 shows that variability in HRTF from subject to subject grows with frequency until it reaches a peak of almost 8 dB between 7 and 10 kHz", F. L. Wightman and D. Kistler, "Headphone Simulation of Free-Field Listening, I: Stimulus Synthesis, II: Psychoacoustical Validation," J. Acoust. Soc. Am. Vol. 85(2), pp. 858–878, 1989. The data reported are ⅓ octave noise bands values.

However, it is a major achievement of the present invention that it has now been found that it is possible to provide or determine an HTF (A) for a particular angle of sound incidence which is so close to corresponding individual HTFs that the function HTF (A) will satisfy even critical quality demands by almost all potential users for which the function is intended, in contrast to the widespread belief in the art that HTF would have to be adapted to the individual user to achieve a satisfactory quality in the practical uses of the HTF. In practice, this will mean that the use according to the invention of the HTF (A) will result in a higher quality in almost all situations of use, and thus a general improvement. This is illustrated in more detail later in the description with reference to FIG. 8.

The ability of the HTF (A) to be close to corresponding individual HTFs, or, expressed in another manner, to be member of a group of HTFs determined with a low standard deviation, is quantitatively described by the conditions mentioned above with respect to FIGS. 22–24. The HTFs are considered to have the quality of generality when the standard deviation is at the most as shown in FIG. 22 for at least one of the appropriate curves of FIG. 22.

The properties of the HTF complying with the criteria of FIG. 22 for a population, such as, e.g., U.S. astronauts or Scandinavian teenagers, or, quite generally, a population for which the product of the binaural synthesis is intended or primarily intended, can, thus, also be expressed by the square root of the mean of the squared differences between the amplitude, given in dB for third octave noise, of the HTF and the amplitudes, given in dB for third octave noise for a group of randomly selected individual HTFs of the population, being at the most 2.2 times the standard deviation as shown in FIG. 8 for the majority of the third octave frequencies shown, preferably at the most 1.7 times the standard deviation as shown in FIG. 8, more preferably at the most 1.4 times the standard deviation as shown in FIG. 8, and most preferably at the most 1.2 or even 1.1 times the standard deviation as shown in FIG. 8.

In the assessment of whether an HTF fulfils these "generality" qualities, the individual HTFs (of a representative number of individuals of the population) to be compared with the HTF in question could be determined for a particular angle of sound incidence, a particular distance, a particular reference point for the HTFs, and a particular posture, the determination being performed so that the repeatability of the measurement, expressed in terms of standard deviation of the amplitude, in dB, between repeated measurements, is at the most ½ times the standard deviation shown in FIG. 8. The assessment will, of course, be most appropriate and valuable if providing such parameters with respect to sound incidence, reference point and posture which correspond to the ones used in the original determination of the HTF or the ones which the HTF is adapted to simulate. While the description which follows discloses a number of specific methods for measuring and/or constructing HTFs so that they will comply with the generality criterion, the above assessment principle can be said to be a general way of judging the suitability of a candidate HTF for a particular use, or of judging whether an HTF implemented for a particular use is within the scope of the present invention.

While partial or full conformity, as discussed above, with the criteria illustrated in FIG. 22 can be said to be a basic requirement for the "generality" of an HTF, it is preferred that the HTFs fulfil, at least with respect to one of the curves, the more stringent criteria illustrated in FIG. 23 or even, at least with respect to one of the curves, the still more stringent criteria illustrated into FIG. 24. It should be noted that the reason why the curves relating to the ⅓ octave measurement are positioned lower than the pure tone curves is that the ⅓ octave curves are frequency averages. It will be understood that analogously to the criteria of FIG. 22, it is preferred, on each level of increasing stringency as defined by FIG. 23 and FIG. 24, that the HTFs fulfil the criteria for at least one of the appropriate curves of the figure in question.

It will be understood that while the above conditions or criteria define "general" HTFs for a broad population, there are certain evident criteria for what constitutes a population in the sense of the present disclosure, these criteria being associated with the anatomy of the ears and other anatomic characteristics of the population. Thus, it is presumed that a set of HTFs determined for a group of adults will not be optimal "general" HTFs for a population of small children. However, this does not introduce any uncertainty in the present context, as it has been found, as discussed above, that the generality criteria for a particular population will be fulfilled when the criteria of FIG. 22, preferably FIG. 23 and more preferably FIG. 24 are fulfilled for the population in question, that is, when an assessment as discussed above has been made on a representative (with respect to number and variation) subpopulation of the population in question, e.g. 25 persons of the population, or preferably more persons.

With respect to feature b):

According to the invention, it has surprisingly been found that it is possible, without any significant loss in quality, to reduce the duration of the time domain representation of high quality HTFs, i.e. high quality HIRs, used in binaural synthesis to 2 ms or even lower. This will very considerably reduce the demands to computer power when simulating the HTFs. When generating binaural signals, a sound input signal is typically convoluted with the HIR. The terms "the duration of the time domain representation of a HTF" or equivalently "the duration of the HIR" refer to the length in time of that part of the HIR that is used for convolution of the sound input signal. Reduction of the duration of the time domain representation of a HTF or equivalently reduction of the duration of the HIR refers to the fact that a shorter part of the HIR is used for the convolution of the sound input signal. As short HTFs (or HIRs) have been provided according to the present invention, high quality HTFs implemented by means of digital filters can now be handled by moderate computing resources. The time domain representations of HTFs reported in the prior art range from 2.9 ms and up. When evaluating the duration of Head-related Impulse Responses it is important to study its frequency response. Examples are reported where an apparently short pulse can not be truncated to less than a few milliseconds as the truncation changes its frequency response to an unacceptable extent because the impulse contains essential information over a longer time duration. It has been found that this is not the case for the high quality impulses determined as disclosed herein or otherwise complying with the criteria underlying the present invention, as illustrated below with reference to FIG. 9 and FIG. 10.

The quality of the HTFs obtained by the inventors have been proven by experiments wherein truncated versions of the HTFs obtained have been used for binaural synthesis. A panel of listeners have compared sound reproductions based on the truncated and the non-truncated versions of the same HTF and it was found that the HTFs obtained by the inventors could be truncated to the durations mentioned above without loss of quality of the audible impression perceived by the listener, the listening test being a three-alternative-forced-choice test. It will be understood that in this aspect of the invention, this kind of test is a general test which can be used to assess the truncatability of any HTF.

The literature contains disclosures of certain short impulses which are not proper HTFs according to the general definition. For example transfer functions are reported where the pressures p in the ear canals are not divided by $p_1$ and therefore these measurements are not measurements of the HTFs but measurements of the combined transfer functions of the loudspeaker and the HTFs.

While the use of HTFs of duration of 2 ms is believed to be unique to the present invention, it has been found possible to use even shorter parts of HTFs, such as at the most 1.5 ms or shorter, e.g. at the most 1.2 ms or 1 ms or even down to at the most 0.9 ms or 0.75 ms or at the most 0.5 ms.

One criterion which should normally be observed in connection with the use of such short HTFs is that they should comply with certain requirements with respect to their DC value, such as described below in connection with feature c). While it is possible to use Htfs as short as described above without any DC adjustment, a normal precaution preferred by the inventors as a routine measure is to adjust the DC value of the short HTFs in accordance with the teaching given in connection with feature c).

With respect to feature c):

According to this feature, the value at zero Hz of the frequency domain representation of the HTF is in the range from 0.316 to 3.16, preferably in the range from 0.5 to 2, such as in the range from 0.7 to 1.4, more preferably in the range from 0.8 to 1.2, such as in the range from 0.9 to 1.1, and most preferably in the range from 0.95 to 1.05, and optimally set to 1.0.

Until the present invention, the value at zero Hz of the frequency domain representation of the HTF (the DC value of the HTF) seems to have attracted little or no attention in the art. However, the research and development of the present inventors has revealed that the DC value has a significant influence on the frequency domain representation of the HTF thereby influencing the sound quality, such as coloration, when the HTF is used in sound reproduction.

When HTFs have been measured, the DC value of the HTF is not measured as sound transducers are not able to generate a static sound pressure. Therefore, the DC value measured is related to secondary characteristics of the measurement set-up that often is not accurately controlled, such as DC offsets in the measurement amplifiers, and the DC values measured are not related to the HTFs under measurement.

The theoretical DC value of the HTFs is 1 as static sound pressure is not altered by the presence of the listener. Further, no diffraction occurs around the head at low frequencies and therefore the sound pressures at different points tend to be identical at lower frequencies. Measuring a value different from 1 corresponds to adding a constant in the time domain representation of the HTF or to add a sine function to the frequency domain representation of the HTF which changes the appearance of the frequency response significantly, especially at lower frequencies and this changes the sound quality when the HTF is used for binaural synthesis. This is further illustrated below with reference to FIG. 11 and FIG. 12.

Thus, according to the present invention the DC value of the measured HTF is adjusted to be in the range from 0.316 to 3.16 preferably in the range from 0.5 to 2, such as in the range from 0.7 to 1.4, more preferably in the range from 0.8 to 1.2, such as in the range from 0.9 to 1.1, and most preferably in the range from 0.95 to 1.05, ideally 1, either directly in the frequency domain representation of the HTF or by adding a constant to the time domain representation of the HTF.

Further, the method of adjusting the DC value to be within an adequate range of the correct value of the HTF has the advantage that the frequency values of the HTF between the value of the lowest frequency measured and zero Hz is interpolated between these two values whereas extrapolation has to be used when adjustment of the DC value is not used and extrapolation leads to less accurate results and even in some cases to very poor results.

In many applications of the method of the invention, it is desired to simulate more than one sound source, and thus, for many practical embodiments of the method, the at least one sound input is filtered with at least two sets of two filters, (FIG. 26) each set of two filters having been designed so that the two filters simulate the left ear and the right ear parts of a Head-related Transfer Function (HTF), or with at least three sets of two filters, (FIG 27) each set of two filters having been designed so that the two filters simulate the left ear and the right ear parts of a Head-related Transfer Function (HTF), and so on for at least four sets of two filters, at least five sets, etc.

In the following, a number of measures which have been found by the inventors to be valuable in the measurement and/or construction of HTFs are discussed. As appears from the discussion, these measures, and combinations thereof, have resulted in HTFs of qualities which must be believed to be hitherto unattained, and several such HTFs for a number of angles of sound incidence are disclosed specifically herein, in particular in the drawings. These HTFs and combinations thereof are believed to be novel per se and, like the novel measures for the measurement and/or construction of HTFs, constitute aspects of the present invention. As will be understood, these HTFs show the features identified under a)–c) above and, thus, their use constitutes preferred embodiments of the binaural synthesis aspect of the invention. However, it will also be understood that the invention is not limited to the use of these HTFs or to HTFs measured or constructed using the special techniques disclosed herein, but encompasses the novel use of any HTF or combination of HTFs, irrespective of how it was determined/provided, as long as the HTF or the combination shows the characterizing features defined herein.

As described in the above mentioned tutorial and by Hammershøi and Møller. "Sound Transmission to and within the Human Ear Canal", submitted for the Journal of the Acoustical Society of America, December 1994, the inventors' research and development have revealed that the transmission of sound pressures from one point to another in the ear canal is independent of the angle of sound incidence. The consequence of this is that the physical location of a point, where full directional information is present, may be chosen anywhere from the eardrum to the entrance of the ear canal. Possibly, even points a few millimeters outside the ear canal and in line with it, may be used. It has also been shown that full directional information is present at the entrance to a blocked ear canal. Further, it has been shown by the inventors that a major part of the individual differences of sound transmission to the eardrums of different humans is caused by individual differences of the sound transmission along the ear canal. Therefore, the inventors presently prefer to measure the HTFs at the entrance to the blocked ear canal as full directional information has been shown to be present at this point and the individual differences between the HTFs of different humans have been estimated to be minimal at this point.

According to research of the inventors this is related to the fact that measurements at the entrance of the blocked ear canal is not related to the remaining sound transmission to the eardrum, since statistical analysis reveal that HTFs measured at the entrance of the blocked ear canal is uncorrelated with the remaining part of the sound transmission. According to the inventors this quality is evidently not maintained in measurements at other points in the ear, e.g. at the entrance of the open ear canal.

Measurement at the entrance to the blocked ear canal has previously been demonstrated to reduce the standard deviation between measurements, but the above surprising recognition that it is possible, using inter alia this measure, to arrive at "general" HTFs, realistically useful for a population, as contrasted to the individual approach previously believed to be necessary in high quality binaural synthesis, is novel and important.

The measurement of sound pressures at the entrance to the blocked ear canal has the further advantage that it is relatively easy to mount a microphone at this point. The inventors prefer to integrate the ear plug and the microphone.

Thus, according to a preferred embodiment of the invention, the reference point of the HTF or the HTFs is at the entrance, or close to the entrance, to the blocked ear canal.

The reference point (where the measuring microphone is arranged) may be outside the ear canal, or it may be inside the ear canal. If it is inside the ear canal, the blocking of the ear canal is positioned deeper in the ear canal. The reference point is normally at most 0.8 cm from the entrance to the blocked ear canal. More preferably, it is at most 0.6 cm from the entrance to the blocked ear canal, most preferably at most 0.3 cm from the entrance to the blocked ear canal, and ideally just at the entrance. Typically, the blocking of the ear canal is performed by means of a conventional ear plug, preferably of a compressible foam plastic material which, in the ear canal, will expand to completely fill out the ear canal across.

As mentioned above, the present invention provides a number of quality improvements of the principles according to which HTFs are measured, and the conditions under which they are measured. These improvements are reflected and manifested in the quality and utility of the new HTFs according to the invention. Thus, an aspect of the invention relates to the use of an HTF that has been established using at least one of the following measures a)–h):

a) the sound pressure $p_2$ from a spatially arranged sound source has been measured at the entrance, or close to the entrance, to the blocked ear canal of a person or of an artificial head,
b) the sound pressure $p_1$ from the sound source has been measured at a position between the ears of the test person or of the artificial head, with the test person or the artificial head absent,
c) the frequency domain description of the HTF has been calculated by dividing the frequency domain description of $p_2$ by the frequency domain description of $p_1$, optionally followed by low-pass filtering,
d) the time domain description of the HTF has been obtained by Inverse Fourier transformation of the frequency domain description,
e) for a particular direction in relation to the test person or the artificial head, the left and right ear parts of the HTF have been measured simultaneously,
f) the test person has been standing during the measurement of the HTF,
g) the test person has been monitored by visual means such as video to ensure that the position of the head of the test person was not changed during the measurement of the HTF and/or any measurement of an HTF during which the position of the head differed from the correct position has been discarded,
h) the test person himself monitored the position of his head e.g. by means of mirrors or a video monitor in order to keep his head in the correct position during measurement of the HTF,
i) the measurements were carried out in an anechoic chamber, the measurement time for one HTF being at the most 5 seconds, preferably at the most 3 seconds, more preferably at the most 2 seconds, such as about 1.5 seconds.

In several disclosures of the prior art, the HTFs have been measured in an anechoic chamber, by establishing a sound field using a loudspeaker as the sound source followed by the measurement, frequency by frequency, of $p_2$ and then of $p_1$ or vice versa. The HTF is then calculated by dividing $p_2$ by $p_1$. However, this method only provides the gain of the HTF and the phase remains unknown.

Some prior art literature discloses measurements of the HTFs that do not include measurement of $p_1$. This means that the HTFs disclosed are not real HTFs but transfer functions that combine the transfer function of the loudspeaker used with the transmission of sound pressures from the loudspeaker to the point where the sound pressures has been measured. If the combined transfer function is used to reproduce binaural sound signals the listener will perceive the sound reproduced to be played by this loudspeaker.

Thus, it is an important aspect of the invention that the sound pressure $p_1$ created by a sound source has been measured at a position between the ears of the test person, with the test person absent, and the frequency and time domain representations of the HTF have established as described above.

The optional low-pass filtering is performed to avoid the effect of the relatively low measurement values obtained at frequencies close to half the sampling frequency mainly defined by the frequency characteristics of the loudspeakers and microphones and the anti-aliasing filters used in the measurement set-up. The division of the two sound pressures in this frequency range has been seen to create significant peaks and valleys in the frequency domain representation of the HTF if not followed by the low-pass filtering.

The simultaneous measurement of the two HTFs (for the left and the right ear) ensures that the position and orientation of the head of the test person or the artificial head is not changed between measurement of the HTF and/or that the time references of the measurements of the HTF are identical.

The fact that the time differences between the arrival of sound pressures from a specific sound source to the left ear and the right ear of the listener is one of the most important parameters in sound localization. It is very important to determine this parameter, the interaural time difference, accurately. If the measurement of the HTF is not carried out simultaneously for the two ears, the ears of the test person has to be kept in the same position within millimeters during the two measurements. For example a movement of 1 cm of the head of the test person corresponds to a time difference of 30 $\mu$s and an uncertainty of the determination of the interaural time difference of this magnitude will typically influence the quality of the HTFs significantly. Therefore, the inventors have chosen the more practical and accurate solution to measure the HTF simultaneously for the two ears.

When performing measurements of HTFs, it is most commonly prescribed in the art to use a seated test person during measurements as a seated test person is well supported and thereby in a good position to keep the head in a fixed position during measurements. The disadvantage of this method is that reflections from the knees prolong the impulse responses. As the present inventors have found no indications contradicting the general understanding that there is no difference in sound localization ability of a sitting and a standing person they have preferred to use a standing test person during their measurements to obtain as short impulse responses as possible. However, this solution requires good support of the position of the test person, while simultaneously avoiding reflections from the supporting means. As illustrated in FIG. 6, the test person is supported at the lumbar region where the support does not cause any sound reflections. Further, the duration of a measurement is kept very short which eases the task of the test person of not moving the head during measurement. The duration of a measurement is 1.5 seconds which represents an optimum choice for signal to noise ratio and measurement duration.

Further, the test person has preferably been monitored by visual means, such as video, to ensure that the position of the head of the test person has not been changed during the measurement of the HTF.

If a movement of the head of the test person is detected during a measurement of the HTF, it has been preferred to discard such a measurement.

To assist the test person in keeping his head in a fixed position during the measurement the test set-up included a video monitor so that the test person himself could monitor the position of the head in order to keep the head in a correct position during measurement.

Having measured the HTFs for a group of test persons and for a set of directions to a set of sound sources in relation to the test person it is now possible to construct an HTF (A) that for a given direction represents the measured HTFs corresponding to this direction.

One way of doing this is to select one of the HTFs measured as the HTF (A) after adjustment of the DC value to the range previously described.

The selected HTF (A) should be the one that for most persons provide a sound experience of a high quality when the HTF (A) is used to reproduce sound, e.g. by means of play back of sound recordings through filters with transfer functions that correspond to the selected HTFs (A), as described in more detail below.

One aspect of the invention relates to an HTF (A) obtained from HTFs (B) obtained according to any of methods described above for at least two test objects, a test object being a person or an artificial head, by selecting an HTF which, when used in binaural synthesis, gives a sound impression which, when presented to a test panel, is found to give a high degree of conformity with real life listening to a sound source in the direction in question. Such a test is described in greater detail in the following.

Another related aspect of the invention is an HTF (A) obtained from HTFs (B) obtained according to any of methods described above for at least two test objects, a test object being a person or an artificial head, by selecting an HTF which, when described objectively, e.g. in the frequency or the time domain, shows a high degree of similarity to individual HTFs of a population. Also this aspect is described in greater detail below. For a specific direction one criterion could be to select the HTF as the HTF (A) for which the sum of differences between the appertaining HTF and the other HTFs measured are minimal. The difference can be defined as the absolute value of the difference between two measured values of the corresponding HTFs or the squared value of the difference or any other function of the difference between two measured values of the corresponding HTFs. For a specific direction this means that for each HTF measured the difference between this HTF and each of the other HTFs of the set of HTFs measured is calculated for each time sample (or for each time sample of a selected subset of time samples) of the time domain representation of the HTFs or for each frequency sample (or for each frequency sample of a selected subset of frequency samples) of the frequency domain representation of the HTF are calculated and all the calculated differences are then added to form a resulting sum. When performing the summation weight factors can be multiplied to the calculated values. Then the HTF with the least resulting sum is selected as the HTF (A).

The representing HTF (A) can also be calculated on the basis of the measured HTFs, for at least two test objects, a test object being a person or an artificial head, by averaging, in the frequency domain, the amplitude of the HTFs (B), the amplitude averaging being performed, e.g., on pressure, power or logarithmic basis, followed by minimum phase or zero phase construction to obtain an HTF, the averaging being optionally followed by addition of a linear phase component giving an interaural time difference, the linear phase component or the interaural time difference suitably being obtained in a separate averaging of the linear phase components or the interaural time differences of the original HTFs (B). This method of constructing an HTF (A) is possible only because it has been found feasible, according to the present invention, to obtain measured HTFs which are very similar to each other. As a result of the fact that the deviations between HTFs according to the present invention are very low, it has become possible and relatively easy to recognize and utilize specific features of the HTFs, such as significant peaks and notches of the HIRs, amplitude peaks of the HTF, etc. Thus, an HTF (A) may be obtained from HTFs (B) for at least two test objects, a test object being a person or an artificial head, by averaging characteristic parameters of the HTFs (B), the characteristic parameters for instance being the frequency and the amplitude of characteristic points, e.g. peaks or notches, or the frequency of 3 dB points of peaks or notches, when the HTFs (B) are described in the frequency domain, or, the time and the amplitude of characteristic points, e.g. a characteristic positive peak or a characteristic negative peak, or the time of a characteristic zero crossing, when the HTFs are described in the time domain, or, the coordinates of, or the characteristic frequency and the Q-factor of poles and zeroes, when the HTFs are described in the complex s- or z-domain.

A set of HTFs that represent the HTF (B)s measured for a set of directions to sound sources can be constructed according to the above described methods in such a way that the methods chosen for the construction of HTFs (A) for different specific directions could be chosen to be identical or different as considered advantageous for the actual application.

Further, a set of HTFs (A) could be constructed as described above but where one subset of the HTFs (A) could be constructed from HTFs (B) measured on a group of test persons while other subsets of HTFs (A) could be constructed from HTFs (B) measured on different groups of test persons.

An important aspect of the invention is an HTF (A) obtained from HTFs (B) for at least two test objects, a test object being a person or an artificial head, by averaging in the time domain or in the frequency domain a) the time-aligned HTFs (B), the time alignment being performed, e.g., by
   1) alignment to the onset of the pulse or to the first peak, or
   2) alignment to maximum cross-correlation, or
b) the HTFs (B) from which the linear phase part and/or the all-pass phase part has been removed, the averaging being optionally followed by addition of a linear phase component giving an interaural time difference, the linear phase components or the interaural time difference suitably being obtained in a separate averaging of the linear phase components or the interaural time differences of the original HTFs (B). The frequency axis, or a section or sections thereof, or the time axis, or a section or sections thereof, may have been compressed or expanded individually for each HTF to reduce the differences between the HTFs before the averaging.

A set of HTFs relating to at least two angles of sound incidence may consist of HTFs obtained according to any of the above-described principles. The set may comprise HTFs (A) each of which has been individually selected among HTFs, not necessarily among HTFs from the same origin, preferably using the real life listening selection method mentioned above.

The invention provides a number of specific high quality HTFs which are completely defined. Thus, the invention relates to an HTF (A) which is selected from the group consisting of the 97 HTFs shown in each of FIG. 1, FIG. 2 and FIG. 3. These HTFs, described as in the figures, or in the form of tables, are extremely valuable commercial tools with hitherto unattainable quality, in any kind of technique where HTFs are used.

The invention also provides HTFs which are useful derivatives constructed on the basis of the above specific HTFs, namely HTFs obtained by interpolation between two or more of the 97 HTFs shown in each of FIG. 1, FIG. 2 and FIG. 3, or HTFs which, when used for binaural synthesis gives an audible impression which is not clearly different from the impression given by an HTF (D) shown in any of the figures in question or obtained by interpolation therebetween. In this context, the term "clearly different" means that a panel of inexperienced listeners obtain a score of at least 90 percent, preferably at least 80 and more preferably at least 70 and most preferably at least 50, percent correct answers when the two HTFs (A) and (D) are compared in a balanced four-alternative-forced-choice test, using programme material for which the HTFs are used or for which the HTFs are intended to be used.

For any preferred HTF (A) according to the invention, a) the reference point of the HTF (B) or the HTFs (B) is at the entrance or close to the entrance, to the blocked ear canal, and the HTFs (B) have been obtained from a group of test persons that is representative for the group of users for whom the HTFs (A) are intended, and/or
b) the HTF (A) is one which, when used for binaural synthesis, gives an audible impression which is not clearly different from the impression given by an HTF (D) according to a).

An HTF or a set of HTFs as described herein may be adapted to an individual listener or a group of listeners by modifying the interaural time difference of the HTF or the set of HTFs, the modification being based on a) the physical dimension of the listener or the listeners, such as head diameter, distance between the ears, etc., or
b) a psychoacoustic experiment, where the HTF or the set of HTFs is used for binaural synthesis and the interaural time difference for each angle of a selected set of angles of sound incidence is adjusted so that the sound impression as perceived by the individual listener or the group of listeners is found to give a high degree of conformity with real life listening to a sound source in the direction in question.

Certain aspects of the invention relate to the construction of HTFs by approximation. These aspects are very valuable in many contests, e.g. for small changes in position or orientation of the head. Thus, in one aspect of the invention, an approximate HTF for an angle of sound incidence may be obtained by interpolating HTFs corresponding to neighbouring angles of sound incidence, the interpolation being carried out as a weighted average of neighbouring HTFs, the averaging procedure preferably being performed as described above. In another aspect, an approximated HTF (A) can be made on the basis of a nearby HTF (B) by performing an adjustment of the linear phase of the HTF (B) to obtain substantially the interaural time difference pertaining to the angle of incidence for which the approximated HTF (A) is intended.

One aspect of the invention relates to a method of obtaining an approximate HTF for a short distance between the listener and the sound source, comprising a) combining
   the left ear part of an HTF representing the geometric angle from the source position to the left ear position or optionally, if the left ear is not visible from the source position, the geometric angle from the source position tangentially to the part of the head obscuring the ear, with
   the right ear part of an HTF representing the geometric angle from the source position to the right ear position or optionally, if the right ear is not visible from the source position, the geometric angle from the source position tangentially to the part of the head obscuring the ear, and/or individually adjusting the level of the left ear and the right ear parts of the HTF. The individual adjustment of the level of the left ear and the right ear parts of the HTF may be performed in accordance with the distance law for spherical sound waves, using the geometrical distance to the middle of the head and the geometrical distance to each of the two ears or optionally, where an ear is not visible from the source position, the geometrical distance to the tangent point of the part of the head obscuring the ear or to the ear passing the tangent point and following the curvature of the head.

As described above, one of the applications of the HTF (A) is to use a set of HTFs (A) as a design target for signal processing means, such as a set of digital filter pairs, used to simulate the transmission of sound from a set of (fictive) sound sources to the left and right ears of the listener. The transfer functions of the set of digital filter pairs are designed to correspond to the appertaining HTFs (A). A binaural signal is generated by filtering a set of sound signals corresponding to the set of (fictive) sound sources with the set of digital filter pairs.

Thus, an HTF may be obtained from the above HTFs according to the invention by further processing, such as filtering, equalizing, delaying, modelling, or any other processing that maintains the information contents inherent in the original HTF or set of HTFs, the said further processing being substantially identical for the left and right ear parts of the HTF, or for a set of HTFs corresponding to different angles of sound incidence being substantially identical for the different directions but not necessarily identical for the left and the right ear parts of the HTFs.

Examples of such signal processing which are useful in various applications are signal processings which have been performed so that a) the HTF of a specific angle, e.g. in the frontal plane, has a flat frequency response, or
b) the amplitude of a binaural signal formed by binaural synthesis of a diffuse sound field is substantially identical to the amplitude of the diffuse sound field itself, or
c) the amplitude of a binaural signal formed by binaural synthesis of a specific sound field is substantially identical to the amplitude of the sound field at the $p_1$ reference point.

In some practical uses of the method of the invention, e.g., mixing consoles, at least two sound inputs (1) are combined into one sound input (2) which is filtered with one set of two filters simulating an HTF (FIG. 25). Typically, the sound inputs (1) which are combined are sound inputs belonging together in spatial groups, such as "from the front", "from behind", "from the right side", "from the left side", etc., in relation to the listener.

An important use of the binaural synthesis method of the invention is for simulation of a sound field of a specific environment, such as a room, e.g. a concert hall, wherein transmission of sound from a set of sound sources with specific positions in said environment to a receiving point with a specific position in said environment is simulated by a) forming, for each of a number of transmission paths for each sound source, a binaural signal (A), and
b) combining the binaural signals (A) for each sound source into a binaural signal (B), and
c) combining the binaural signals (B) of the set of sound sources into a resulting binaural signal (C).

Another important utilization of the invention is for noise measurement and/or assessment of the effect of noise, or any other measurement and/or simulation where a description of a sound transmission is involved, in which binaural signals produced according as discussed herein and/or HTFs as characterized herein are utilized to increase the generality.

For some uses of the invention, including, e.g., virtual reality applications or teleconferencing, it is useful to sense position and/or orientation, and/or changes in position and/or orientation, of the head of a listener and modify the electronic signal processing in dependence of the sensed position and/or orientation and/or changes in position and/or orientation. This could, e.g., be used to give the impression that the virtual sources remain in position irrespective of head movements.

The sensing of the position and/or orientation, and/or changes in position and/or orientation, of the head of a listener, may be performed by a) transmitting at least one pulse of energy, such as an ultrasonic wave pulse or an infrared light pulse, adapted to be received by one or more receiving means mounted at and following the movements of the head of the listener,
b) detecting the arrival time or each of the arrival times of the transmitted energy pulse or pulses at the receiving means or each of the receiving means and optionally detecting or recording the time of transmission or each of the times of transmission from the corresponding transmitter or transmitters, and
c) calculating the position and/or orientation of the head of the listener based on the detected arrival time or times and optionally on the detected or recorded time or times of transmissions.

The signal processing in the method of the invention can, if desired, additionally include compensation of transfer characteristics of a signal-to-sound transducer, such as its frequency dependent sensitivity, impedance relations, etc., thereby approaching the perception of an ideal signal-to-sound transducer. Further, the characteristics of the transmission of sound from the signal-to-sound transducer to a specific point, e.g. to a specific point in the ear canal of a listener, could be included in the compensation. On the other hand, many sound reproductions which are perceived as pleasant or interesting do in fact include transfer characteristics or coloration of loudspeakers, or sound modifications characteristic of the room in which the loudspeakers are arranged, and thus, another interesting possibility is to supplement the binaural signal with echoes and/or reverberation and/or coloration to simulate a non-uniform signal response of the virtual signal-to-sound transducers and/or to simulate that the virtual signal-to-sound transducers are arranged in an imaginary room. These additional signals may or may not be coded with directional and/or distance information about their virtual sound sources.

As indicated above, the signal processing may additionally include compensation for the difference in pressure division at the input to the ear canal when the ear is occluded, respectively unoccluded, by a headphone. A way of obtaining a description of the difference in pressure division at the input to the ear canal when the ear is occluded, respectively unoccluded, by a headphone, comprises measuring the transmission from the headphone to the sound pressure at the entrance, or close to the entrance, of the blocked ear canal, and at the entrance, or close to the entrance, of the open ear canal, the ratio of the frequency domain descriptions of these transmissions being obtained as characteristic of the pressure division (X) in this situation, and measuring the transmission from a sound source that does not influence the acoustic radiation impedance of the ear, to the sound pressure at the entrance, or close to the entrance, of the blocked ear canal, and at the entrance, or close to the entrance, of the open ear canal, the ratio of the frequency domain descriptions of these transmissions being obtained as characteristic of the pressure division (Y) in this situation, and obtaining the ratio X/Y which constitutes the frequency domain description of the difference in pressure division.

Any compensation for signal-to-sound transducers such as headphones and loudspeakers may be adapted to the individual listener, by determining the appropriate transfer characteristics for the individual user.

The signals subjected to the signal processing described above could be signals which are adapted to be decoded into sound representing signals, e.g. broadcast signals, by decoding them in the manner corresponding to the coding scheme of the appropriate sound reproducing system and then processing them into a binaural signal as described above. Whether or not a particular broadcast signal is adapted to be decoded in a particular system can easily be assessed by providing the signal to a decoder pertaining to the system and analyse the decoded signals.

Headphones constitute preferred signal-to-sound transducers for the binaural signal. In the present context, the term headphones includes conventional headphones and any other sets of two portable signal-to-sound transducer units adapted to be placed on a human adjacent or close to the ears of the human.

Especially attractive headphones for use in the method of the invention could be wireless headphones adapted for any kind of wireless transmission of the binaural signal, such as electromagnetic, optical, infrared, ultrasonic, etc.

The binaural signal is normally adapted to be emitted by means of headphones, but it is within the scope of the invention to reproduce the signal by means of two loudspeakers. When loudspeakers are used, crosstalk of the loudspeakers may, if desired, be counteracted by supplementing the binaural signal with artificial crosstalk, which may either be incorporated in the binaural signal or consist of additional electrical signals. Crosstalk is caused by the fact that the left ear is able to hear the right loudspeaker and vice-versa in contrast to the headphones.

When two loudspeakers are used to reproduce the sound corresponding to the binaural signal the position of the listener in relation to these loudspeakers is rather critical because of the cross-talk phenomena. However, by sensing the position of the head of the listener and modifying the electronic signal processing in response to the sensing, it will be possible to compensate the cross-talk in accordance with the position of the head of the listener, thereby dramatically improving the quality of the listening experience.

Both in the cases where headphones are used and in the cases where two loudspeakers are used, the position and/or orientation, and/or changes in position and/or orientation, of the head of a listener can, as indicated above, be sensed by means of suitable sensing means, and the electronic signal processing can be modified in dependence of the sensed position and/or orientation and/or changes in position and/or orientation. The effects aimed at in the modification may range from minor corrections or adjustments which are desirable in connection with head movements when listening to binaural sound reproduction, to modifications adapted to impart to the listener the perception that the virtual sound sources remain in position irrespective of the position and/or orientation, and/or changes in position and/or orientation, of the listener's head, or even modifications where special artificial effects are aimed at, such as a perception that the virtual spatial sound field continues to turn a little due to "inertia" after the listener has stopped a turn of the head. As will be understood by a person skilled in the art, such modifications of the electronic processing are possible in particular where the HTFs are implemented by digital filters, such as is described in detail in the following.

One way of sensing the parameters of the position and orientation of the listener mentioned above is to apply a known varying magnetic field to the surroundings of the listener and applying a set of crossing coils to the head of the listener. When the magnetic field applied to the listening room is known it is possible to derive the position and orientation of the listener's head from the voltages generated in the crossing sensing coils. Analogous methods could be used for other kinds of fields, such as ultrasonic fields, applied to the listening room, with appropriate detectors applied to the listener's head, or equipment based on video cameras coupled to image recognition means could be utilized.

Other aspects of the invention relate to applications of the HTFs used for binaural synthesis utilizing the generality aspect of these HTFs for example in designing artificial heads, in designing frequency response of headphones, in computer models of the human binaural sound localization or perception in general, etc.

In accordance with what is discussed above, an embodiment of the invention comprises transmitting the binaural signals in the form of modulated ultrasonic waves, the waves being received by a listener equipped with two receiving means each of which is mounted close to the appertaining ear of the listener, changes in orientation of the listener's head relative to a reference orientation being compensated on the basis of the difference of the travel time of the ultrasonic wave pulses between the two receiving means so that the listener will perceive that virtual sound sources remain in a reference position irrespective of the orientation of the listener's head, the compensation being automatic or carried out by involving electronic signal processing.

For a number of practical uses, such as in air traffic control, in control of cabs or trucks, in messenger offices, in life saving stations, in central offices of watchmen, in telephone meetings, in meetings using audio-visual communication means, etc., the method of the present invention can be applied for communication, comprising transforming, by signal processing means, signals ($A_1 \ldots A_n$) of a t least one single channel communication system and/or at least one multichannel communication system which signals are adapted for being supplied to at least one signal-to-sound transducer, or signals which are adapted for being decoded into such signals ($A_1 \ldots A_n$)

into a binaural signal (C), so that the binaural signal, when reproduced, is capable of imparting to a receiver of the communication a perception of listening to a spatial sound field with a set of n individually positioned virtual sound sources, each of which transmits one of the signals ($A_1 \ldots A_n$).

In connection with this, a valuable embodiment is where the position and orientation of the receiver's head is monitored, and head position and head orientation data obtained in the monitoring is used to enable the receiver to selectively transmit a message to one of the transmitters corresponding to one of the signals ($A_1 \ldots A_n$) by turning his head in the direction of the virtual sound source corresponding to said transmitter.

A special utilization of the method of the invention is for multichannel sound reproduction, e.g., Dolby Surround, Stereo, Quadrophony, or any HDTV multichannel specification, comprising transforming, by signal processing means, signals ($A_1 \ldots A_n$) of a multichannel sound reproducing system which signals are adapted for being supplied to n different signal-to-sound transducers of the multichannel sound reproducing system, or signals which are adapted for being decoded into such signal s ($A_1 \ldots A_n$)

into a binaural signal (C) by the method of the invention so that the binaural signal, when reproduced, is capable of imparting to a listener a perception of listening to a spatial sound field similar to the sound field which would have resulted from listening to the n signal-to-sound transducers spatially arranged in a room.

A range of uses of the method of the invention are related to the situations where the binaural signals are used for positioning a set of sounds at specific virtual positions in relation to an operator, such as, e.g., operators of industrial processes, pilots and astronauts, fight controllers, video game players, users of interactive TV, surgeons operating patients, etc.

One example of this is where a moving virtual sound source with a characteristic sound moves continuously or discontinuously between specific positions of a set of virtual sound sources, the operator being enabled to communicate a specific message to the system according to a particular virtual sound source by prompting the system when the moving virtual sound source is positioned substantially at the position of said virtual sound source. The position of the moving virtual sound source may be controlled by the operator, and/or by the orientation and/or position of the head of the operator, and/or the positions may be dynamically controlled by a computer in accordance with a set of rules or a predefined scheme.

One application hereof is in guidance of the movement of an object, such as a robot, or a person, such as a blind person, where the method is used for controlling or assisting the movement and/or position of an object and/or a living being by dynamically positioning a virtual sound source in relation to the object and/or living being, so as to guide the object and/or the living being in relation to the position of the virtual sound source.

In any embodiment of the invention, the binaural signal may, of course, be stored on an audio storage medium or broadcast. As a special feature, each sound input (2) representing a combination of more than one sound inputs (1) may be stored or broadcast separately, such as in a separate track or in a separate channel, respectively, the binaural filtering being carried out before or after storing or broadcasting.

A number of aspects of the invention comprise the use of HTFs of the generality obtained according to the present invention in computer modelling or analysing the cerebral human binaural sound localization ability.

Another such aspect comprises a method for designing headphones, wherein adapting the transfer characteristics of the headphones are adapted to resemble an HTF characterized according to the invention for a given direction, e.g., the frontal direction, or to resemble weighted averages of such HTFs corresponding to averages of given directions.

A further such aspect relates to an artificial head having HTFs which correspond substantially to HTFs determined according the invention for all angles of sound incidence, or at least for angles of sound incidence which constitute part of the total sphere surrounding the artificial head, such as the upper hemisphere or the frontal region. This can be done by adapting the geometric characteristics of the artificial head and/or the acoustic properties of the materials used so as to approximate the HTFs of the artificial head to HTFs according to the invention for all angles of sound incidence, or at least for angles of sound incidence which constitute part of the total sphere surrounding the artificial head, such as the upper hemisphere or the frontal region.

In the following, the invention will be described in more detail, by way of example, with reference to the accompanying drawings, in which:

FIGS. 1 (1)–(6) shows the time domain description of a set of HTFs (1) of a specific person according to the invention, and (7)–(12) shows the frequency domain description of the HTFs (1), FIGS. 2 (1)–(6) shows the time domain description of a set of HTFs (2) according to the invention, obtained as an average across HTFs for 40 persons, by averaging the minimum phase approximation in decibels frequency by frequency, followed by the addition of the average linear phase parts of the HTFs and, (7)–(12) shows the frequency domain description of the HTFs (2), FIGS. 3 (1)–(6) shows the time domain description of a set of HTFs (3) according to the invention, obtained as an average across 40 persons, by averaging the time aligned time domain representations of the HTFs sample by sample, followed by the addition of the average delays of the HTFs, and (7)–(12) shows the frequency domain description of the HTFs (3), FIG. 4 is a photo of a miniature microphone mounted in the ear of a test person to measure the pressure ($p_2$) at the blocked ear canal, FIG. 5 shows the placement of a microphone at the blocked entrance to an ear canal, FIG. 6 is a photo of the measurement set-up in anechoic chamber for measurement of an HTF, FIG. 7 shows graphs of the frequency domain representation and the time domain representation of a specific HTF for one test person, FIG. 8 shows the standard deviation of the gain of HTFs for different groups of test persons for comparison of measurements performed according to the present invention with measurements performed according to prior art, FIG. 9 shows an example of a Head-related Impulse Response, FIG. 10 shows the frequency domain representation of the Head-related Impulse Response of FIG. 9 truncated to different lengths, FIG. 11 shows an example of a Head-related Impulse Response adjusted for different DC values, FIG. 12 as FIG. 11 but for the frequency domain representations, FIG. 13 shows an example of averaging the time domain representations of a set of HTFs, FIG. 14 as FIG. 13, but for the frequency domain representations, FIG. 15 shows an example of logarithmic averaging the frequency domain representations of a set of HTFs, FIG. 16 shows an example of a minimum phase representation and an example of a zero phase representation of an averaged set of Head-related Impulse Responses, FIG. 17 shows an example of averaging the time domain representations of a set of HTFs after time alignment, FIG. 18 as FIG. 17, but for the frequency domain representations of the HTFs, FIG. 19 shows an example of interpolation of the time domain representations of the HTFs to create a new HTF corresponding to a direction that is in between four directions corresponding to four known HTFs, FIG. 20 as FIG. 19, but for the frequency domain representations, FIGS. 21 (*a*)–(*d*) shows an example of obtaining an approximate HTF for a short distance between the listener and the sound source, FIGS. 22, 23, 24 show standard deviations of the amplitude, in dB, FIG. 25 is a schematic diagram showing two sound inputs combined into a single sound input that is filtered by one set of two filters respectively simulating left and right HTFs; and FIGS. 26 and 27 are schematic diagrams showing a sound input that is filtered by two and three of two filters, respectively, wherein each set of two filters respectively simulates left and right HTFs.

FIGS. 1–3 show three different sets of HTFs obtained by different methods according to the present invention, one in each figure. In each the figures, the descriptions of the HTFs are characterized by their angle of incidence, stated as (azimuth, elevation). In each of time domain descriptions, the upper curve pertains to the left ear, and the lower curve pertains to the right ear. In each of the frequency domain descriptions, the thick line curve pertains to the left ear, and the thin curve pertains to the right ear. The "tag" at each side of the frequency domain curves represents 0 dB.

The HTFs shown in FIGS. 1–3 are examples of HTFs according to the current invention, the HTFs of FIG. 1 being a single person's HTFs, whereas the HTFs of FIG. 3 and FIG. 2 are averages across a large number of persons, and have been obtained according aspects of invention. The average HTFs of FIG. 2 has been obtained as an average across HTFs for 40 persons, by averaging the minimum phase approximation in decibels frequency by frequency, followed by the addition of the average linear phase parts of the HTFs. The HTFs of FIG. 3 has been obtained as an average across 40 persons, by averaging the time aligned time domain representations of the HTFs sample by sample, followed by the addition of the average delays of the HTFs.

FIG. 6 shows a set-up for a measurement of the HTFs according to the present invention performed in an anechoic chamber. A known signal is sent to a loudspeaker positioned in the direction corresponding to the HTF to be measured. A miniature microphone of the type Sennheiser KE 4-211-2 is placed at each of the blocked entrances to the ear canals of the test person as shown in FIG. 4 and FIG. 5.

The KE 4-211-2 is a pressure microphone of the back electret type, and it has a built-in FET amplifier. The microphone itself has a sensitivity of approximately 10 mV/Pa Coupled with a gain as suggested in the data sheet, the sensitivity increases to approximately 35 mV/Pa. A small battery box was used, and in order to increase the output signal and to reduce the output impedance, a 20 dB amplifier was built into the same box. Two selected microphones were used throughout the experiment, one for each ear.

The reference sound pressure $p_1$ from the loudspeaker was measured with each of the miniature microphones. The microphone was placed at the position where the middle of the test person's head would be during measurement. In order to disturb the field as little as possible, the microphones were fixed by a thin wire and with an orientation giving 90° incidence of the soundwave from the loudspeaker. In this way, the $p_1$ measurement was minimally influenced by the presence of the microphone in the sound field.

During measurement of the sound pressure $p_2$ at the entrance to the blocked ear canal, the microphone was mounted in an EAR earplug placed in the ear canal. The microphone was inserted in a hole in the earplug, and then the soft material of the earplug was compressed during insertion in the ear canal. As the earplug relaxed, the outer end of the ear canal was completely filled out. The end of the earplug and the microphone were mounted flush with the ear canal entrance (see FIG. 4 and FIG. 5).

The measurements were carried out in an anechoic chamber with a free space between the wedges of 6.2 m (length) by 5.0 m (width) by 5.8 m (height). The test person was standing on a platform in a natural upright position, and a small backrest mounted on the platform helped the test person to stand still.

To assist in the control of horizontal position and orientation of the test persons head, the test person had a paper marker on top of the head. This marker was observed through a video camera placed right in front of the test person and shown on a moveable monitor to the test person. Using this, the test person could correct position and azimuth.

The operators had a similar monitoring for observation of the test persons exact position and for controlling that the test person did not move during each single measurement. If movements were observed, the measurement was discarded and redone.

The loudspeakers used were 7 cm membrane diameter midrange unit (Vifa M10MD-39) mounted in 15.5 cm diameter hard plastic balls.

The general purpose measuring system known as MLSSA (Maximum Length Sequence System Analyzer) was used. Maximum length sequences are binary two level pseudo-random sequences. The basic idea of MLS technique is to apply an analogue version of the sequence to the linear system under test, sample the resulting response, and then determine the system impulse response by cross-correlation of the sampled response with the original sequence.

The above method of performing measurements using maximum length sequences offers a number of advantages compared to traditional frequency and time domain techniques. The method is basically noise immune, and combined with averaging, the achieved signal to noise ratio is high. A thorough review of the MLS method is given by Rife and Vanderkooy: "Transfer-function measurement with maximum-length sequences", Journal of the Audio Engineering Society, vol. 37, no. 6.

For the purpose of measuring at both ears simultaneously, two MLSSA systems were used, coupled in a master-slave configuration by a purpose made synchronization unit allowing sample synchronous measurements.

The 4 V peak-to-peak stimulus signal from the master MLSSA board was sent to the power amplifier (Pioneer A-616) that was modified to have a calibrated gain of 0.0 dB. From the output it was directed through a switch-box to the loudspeaker in the measurement direction. The free field sound had a level of 75 dB(A) at the test persons position, a level where the stapedius was assumed to be relaxed.

From the microphone the signal was sent through a measuring amplifier, B&K 2607.

The sampling frequency of 48 kHz was provided by an external clock. To avoid frequency aliasing, the 20 kHz Chebyshev low pass filter of the MLSSA board and the 22.5 kHz low pass filter of the measuring amplifier were used. Also the 22.5 Hz high pass filter on the measuring amplifier was active.

Preliminary measurements on the free field setup using the maximum MLS length offered by MLSSA, 65535 points, showed that a length of 4095 points was sufficient to avoid time aliasing. In order to achieve a high signal to noise ratio, the recording was averaged 16 times, called pre-averaging in the MLSSA system. Even with this averaging the total time for a measurement was as short as 1.45 seconds. During this period the test persons were normally able to stand still. All measured impulse responses were very short, and only the first 768 samples of each impulse response, corresponding to 16 milliseconds, were computed and saved.

Results of the measurements were impulse responses for the transmission from input to the power amplifier to output of the measuring amplifier. The post processing needed to obtain the wanted information was carried out in MATLAB.

The measured impulse responses all included an initial delay, corresponding to the propagation time from the loudspeaker to the measuring point (approximately 6 milliseconds). All responses were very short, duration only a few milliseconds. therefore, only samples from 256 through 511 were processed (time from 5.33 ms to 10.65 ms). The restriction to this time window eliminated reflections from the monitor in the anechoic chamber.

For determination of the HTF ($P_2/P_1$) the selected portion of the $p_1$ and $p_2$ impulse responses were Fourier transformed, and a complex division was carried out in the frequency domain. As the same equipment was involved during measurement of $p_1$ and $p_2$, the influence of equipment cancels out in the division.

If it is desirable to simulate the HTF using analog filters, then the frequency domain representation of the HTF can form the basis for the synthesis of analog implementations of the filters as described in any text book on filter synthesis.

The impulse response of the HTF was determined through an inverse Fourier transform of $P_2/P_1$. Before the transformation, $P_2/P_1$ was filtered by a 4'th order Butterworth filter (bilinearly transformed) in order to prevent from frequency aliasing.

If its desirable to simul ate the HTF using digital technique, then the Head-related Impulse Responses can be digitised and stored in the storage(s) of the digital implementations of the filters.

An example of the frequency domain representation and the time domain representation of a specific HTF for one test person is shown in FIG. 7. To benefit from these advantageous HTFs it is important to understand that the signal to sound transducer, such as headphones, has to be calibrated correctly.

As already mentioned the entrance to the blocked ear canal has been chosen as the measurement point because the individual differences between HTFs of different test persons have been found to be very low among other things because of this choice. It has been shown that a major part of the differences between individual HTFs are added by the transmission of the sound pressures through the individual ear canals. Thus, it is important to be able to reproduce the sound pressures, e.g. by headphones, at the reference point of the measurement at the entrance to t he blocked ear canal without adding any individual differences to the sound pressures. This means that the transfer function describing the characteristics of transmission of a sound signal from the terminals of the headphones to the reference point at the blocked ear canal must have a flat frequency response so that the frequency domain representations of the HTFs will not be distorted.

Further, the headphone must be open, as defined in the above mentioned tutorial by Henrik Miller, or which is equivalent to having a free field equivalent coupling to the ear as it has later been denoted, so that the impedance looked out into from the ear is not changed when the headphone is applied to the ear, or alternatively the headphones should be adjusted to compensate for its transmission impedance.

FIG. 8 shows the standard deviation of the gain of HTFs for different groups of test persons for comparison of measurements performed according to the present invention with measurement performed according to prior art. The graphs of FIG. 8 are based on measurements of the HTFs of a significant number of test persons. The prior art measurements are disclosed in: F. L. Wightman and D. Kistler, "Headphone Simulation of Free-Field Listening, I: Stimulus Synthesis, II: Psychoacoustical Validation," J. Acoust. Soc. Am. 85(2), 858–878, 1989 and in: P. A. Hellström and A. Axelsson, "Miniature microphone probe tube measurements in the external auditory canal", J. Acoust. Soc. Am. 93(2), 907–919, 1993. The graphs show the standard deviation of the gain as a function of frequency averaged for all directions in ⅓ octave bands. It is seen that the present invention provides an improvement by approximately a factor of 2 over the known methods, and thereby provides a significant improvement compared to prior art techniques.

FIG. 9 shows a typical example of a Head-related Impulse Response. Different lengths of this impulse response (starting from t=0 in FIG. 9) are Fourier transformed and the results are shown in FIG. 10. The DC adjustments described below are performed before each Fourier transformation after truncation of the impulse response. It is seen from FIG. 10 that no significant changes in the frequency domain representation of the impulse response occur for impulses longer than 1 ms. As explained earlier, when evaluating the duration of the part of the Head-related Impulse Responses used in the simulation, it is important to study its frequency response. Examples are reported where an apparently short impulse can not be truncated to a few milliseconds as the truncation changes its frequency response to an unacceptable extent because the impulse contain essential information over a longer time duration. FIGS. 9 and 10 illustrate that this is not true for the impulses of the present invention.

As mentioned before, until the present invention, the value at zero Hz of the frequency domain representation of the HTF (the DC value of the HTF) seems to have attracted little or no attention in the art. However, the research and development of the present inventors have revealed that the DC value has a significant influence on the frequency domain representation of the HTF thereby influencing the sound quality, such as coloration, when the HTF is used in sound reproduction. FIG. 11 shows an example of a Head-related Impulse Response adjusted for different DC values and FIG. 12 shows the corresponding frequency domain representations. It is interesting to note that the influence on the time domain representations of the HTFs are barely seen while simultaneously the influence in the frequency domain representations are significant.

Figure 4:
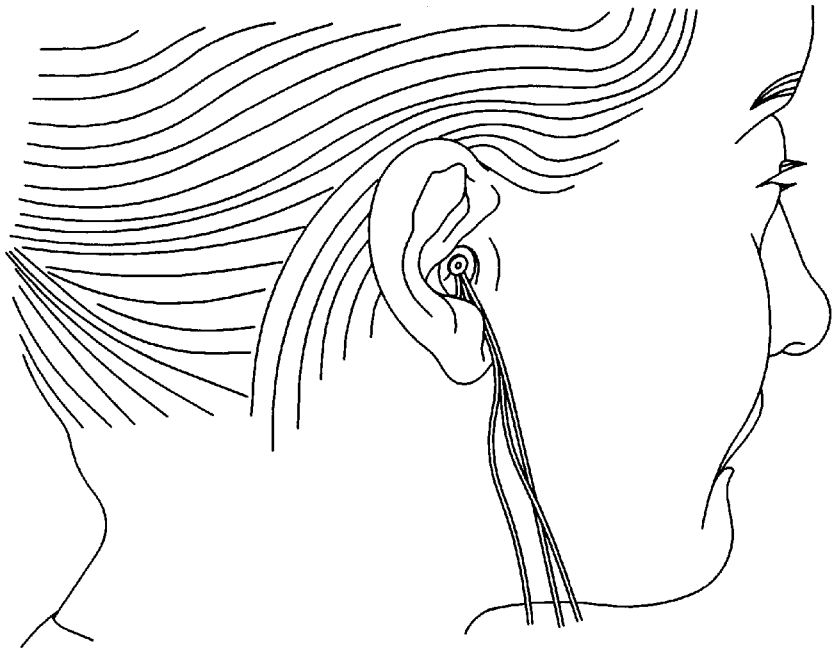
Figure 5:
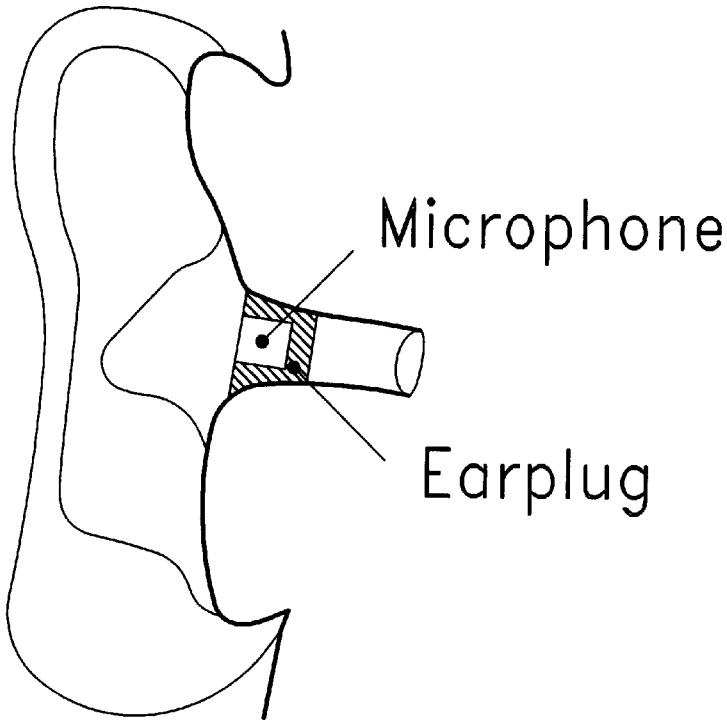
Figure 6:
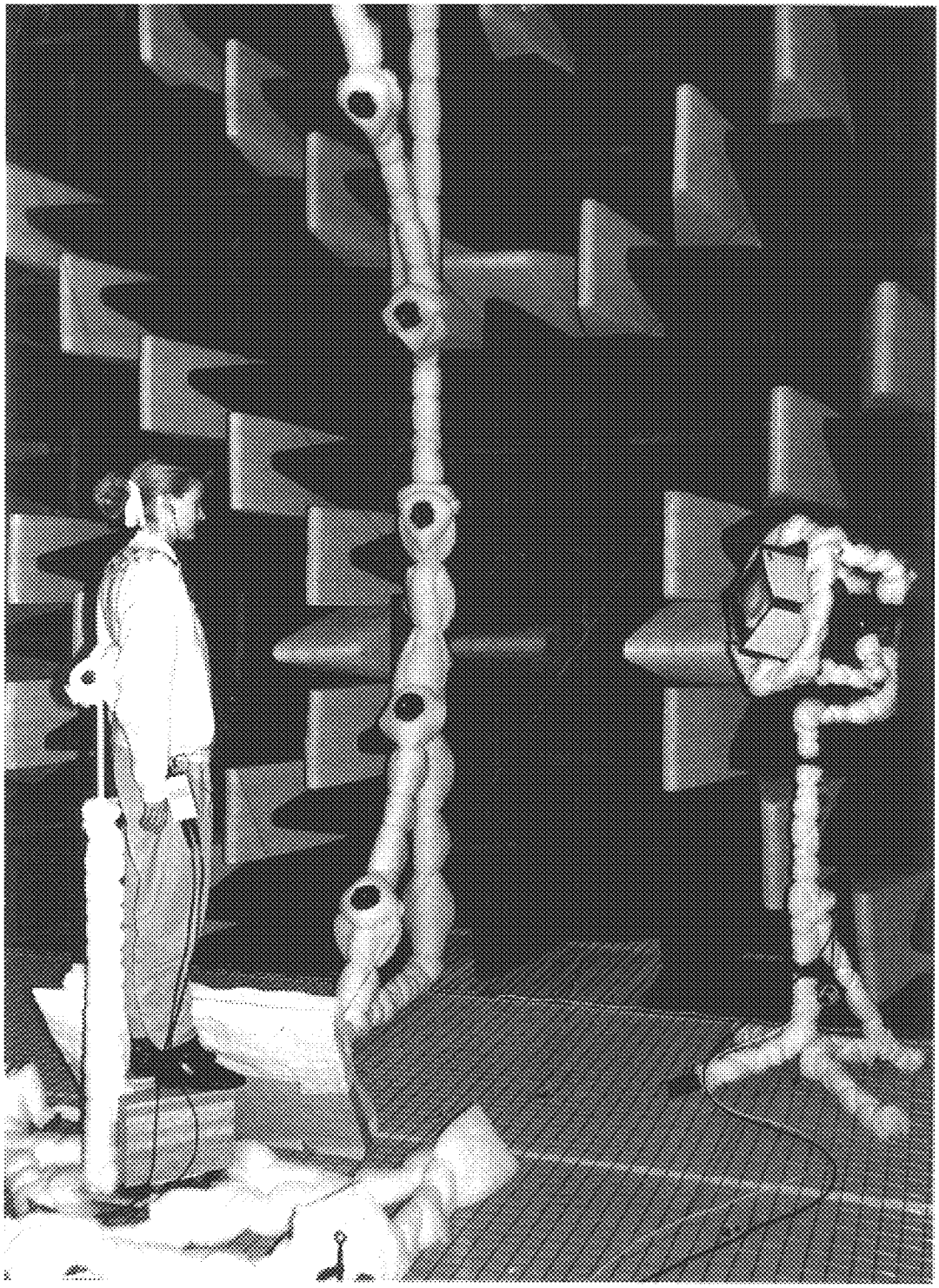
Figure 8:
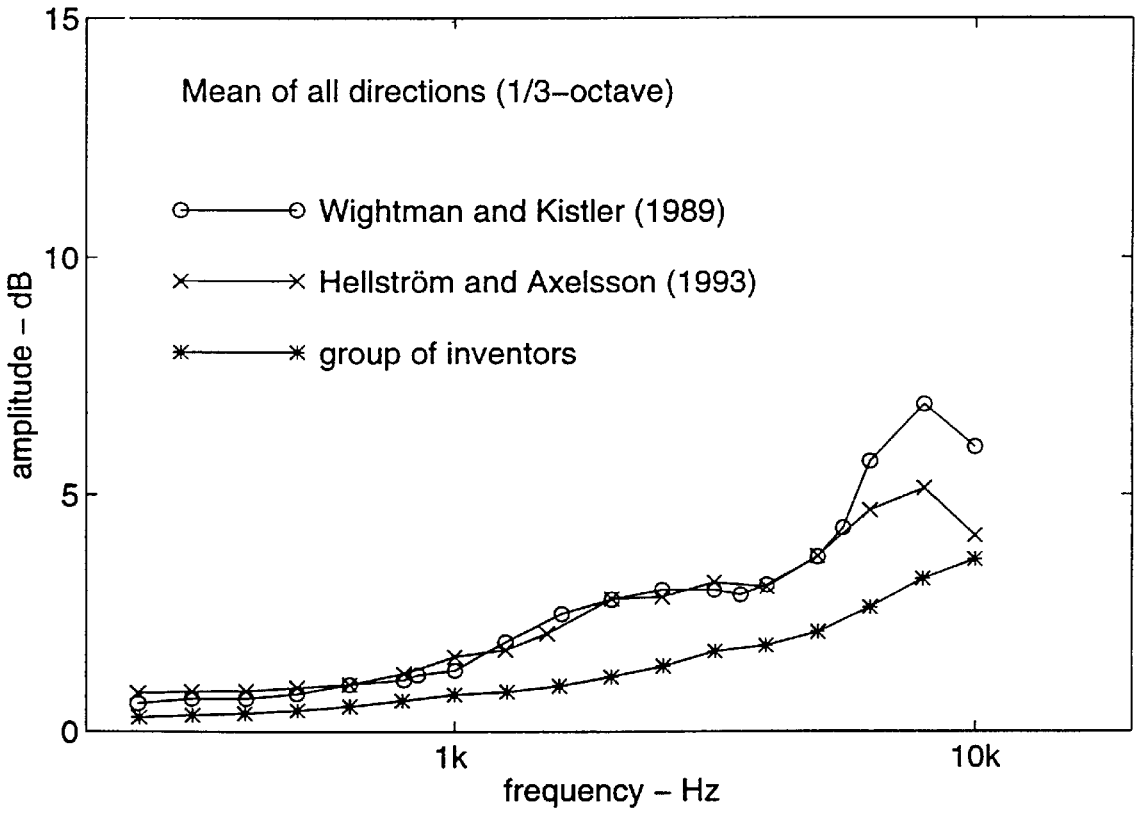
Figure 9:
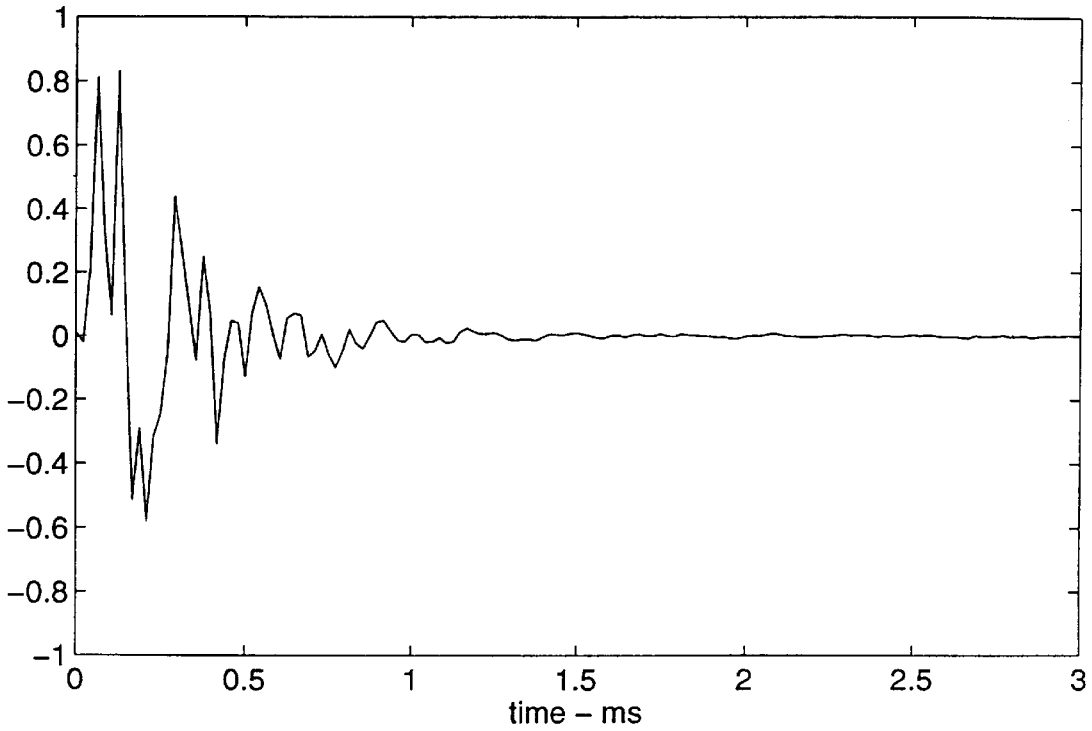
Figure 10:
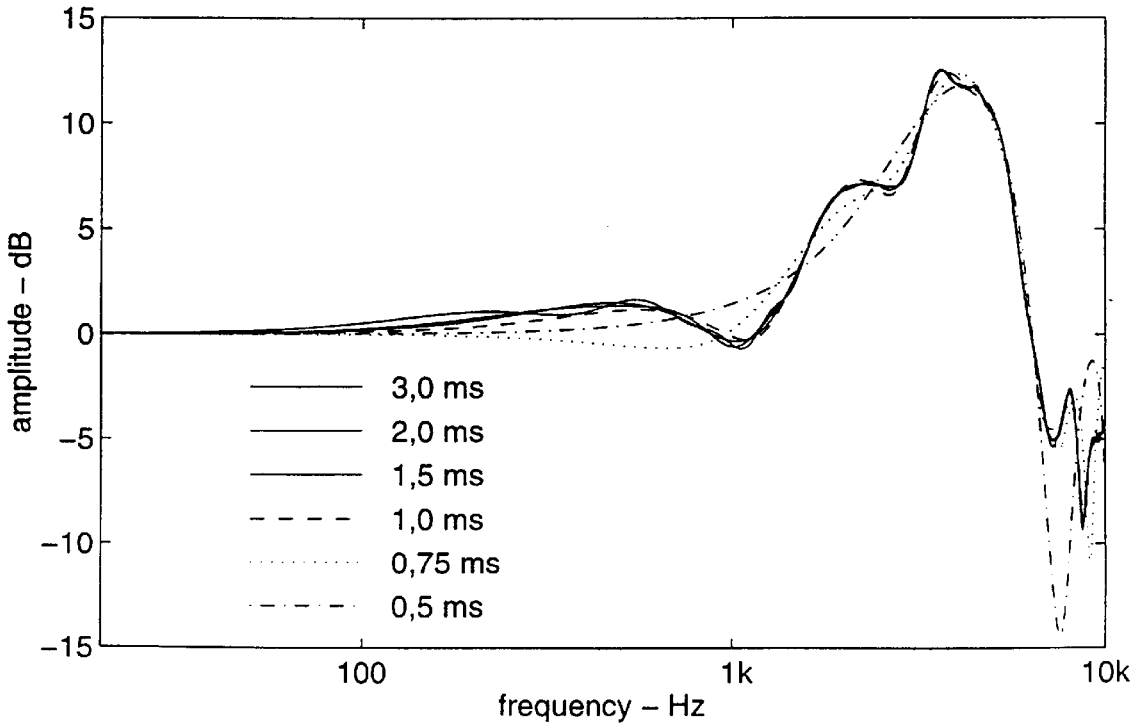
Figure 11:
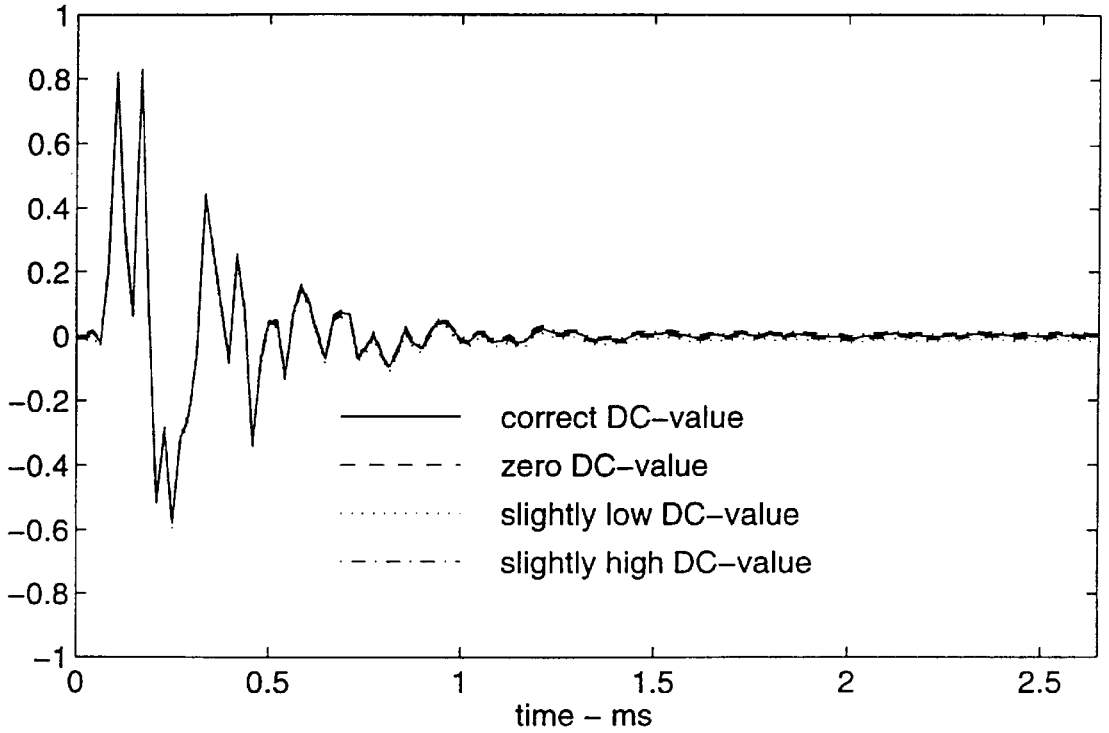
Figure 12:
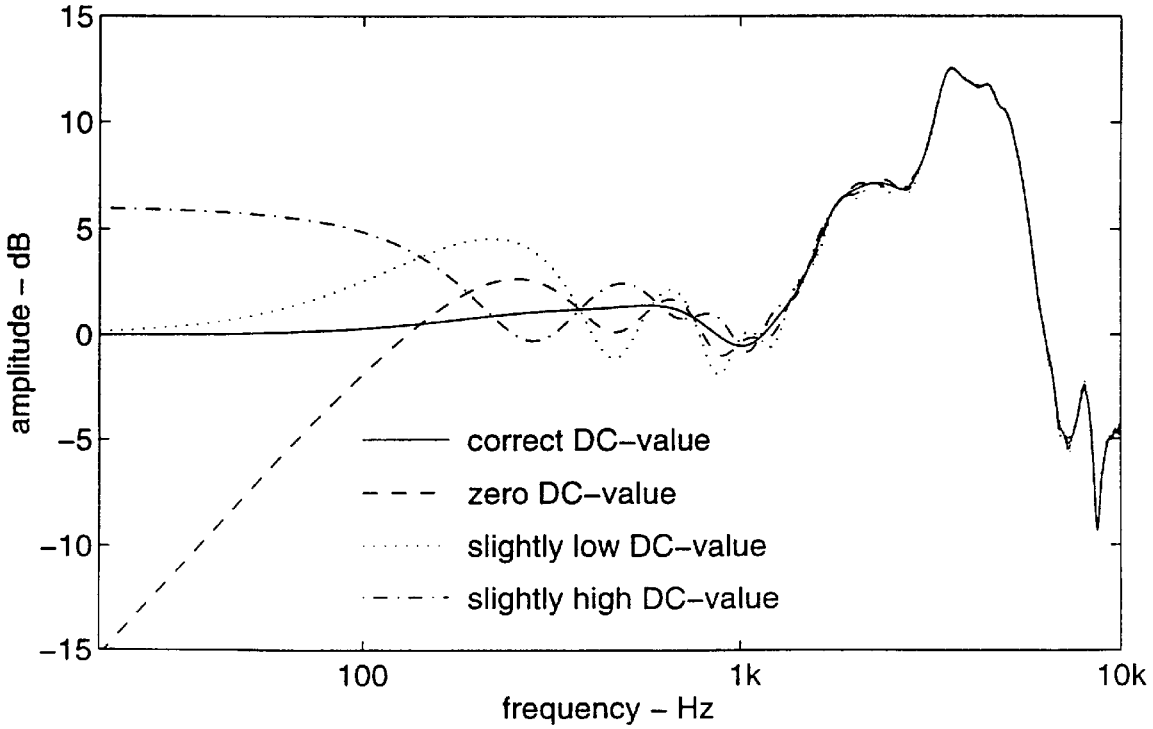
Figure 13:
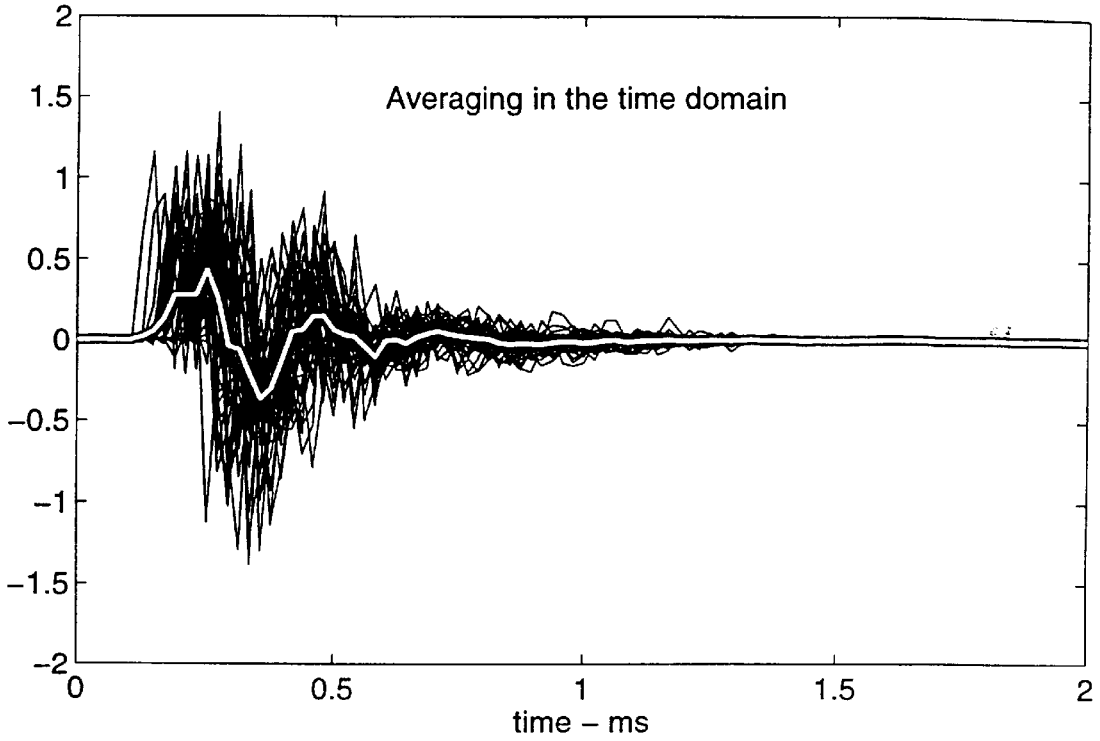
FIG. 13 shows the time domain representations of the HTFs of a specific direction for one ear for a group of test persons and also the average value of these HTFs is shown (in this context the term averaging means the averaging of any function of the pressures measured, such as the pressure itself or the logarithmic pressure, or $p^2$ (the power average), etc.).
Figure 14:
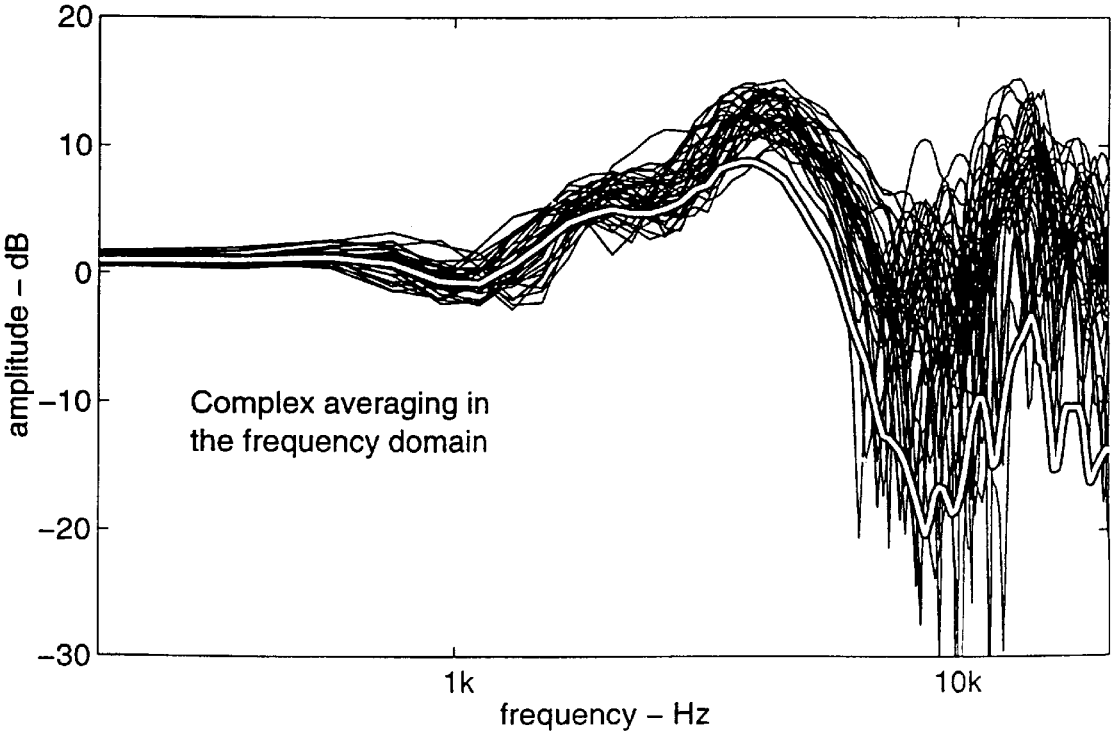
FIG. 14 shows the gain of the corresponding frequency domain representations of the HTFs of FIG. 13 and also the average gain is indicated.
Figure 15:
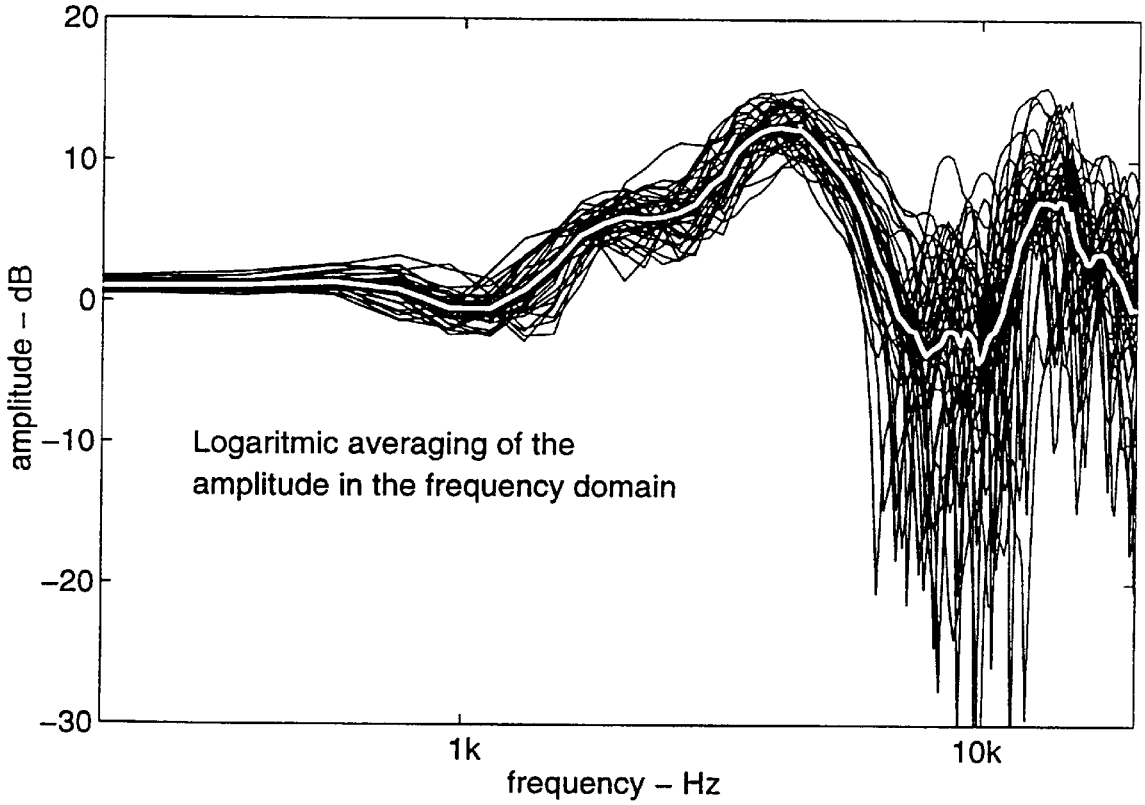
FIG. 15 shows the gain of the HTFs shown in FIG. 14 but with the logarithmic average also shown. It will be noted that the logarithmic average seems to represent the group of HTFs better than the average shown in FIG. 14.
Figure 16:
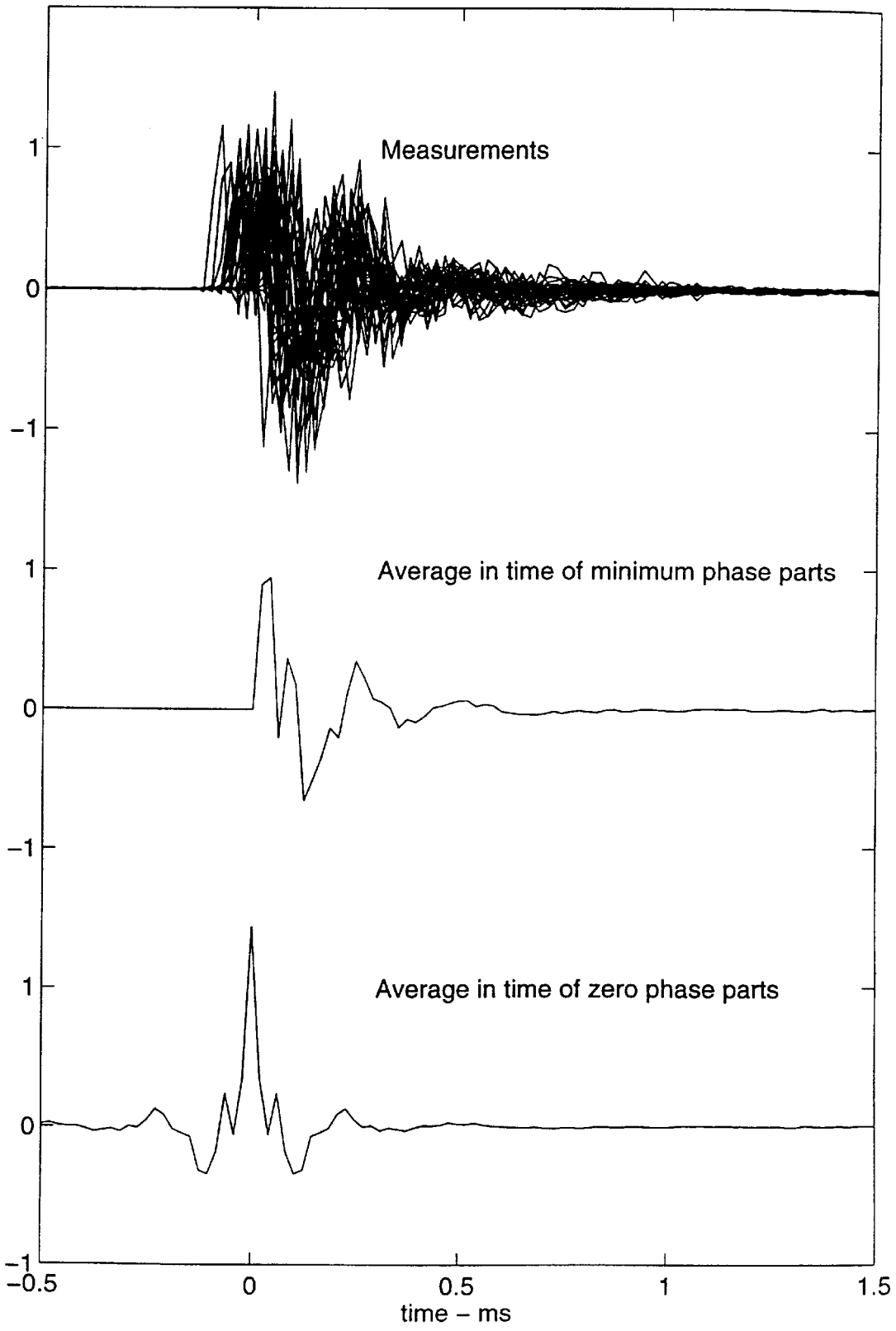

In FIG. 14 and FIG. 15 only the gain is averaged which leaves the phase to be defined. Several possibilities exist. FIG. 16 shows the time domain representation of the averaged HTFs with the minimum phase added and also the corresponding average with a zero phase is shown.

Figure 17:
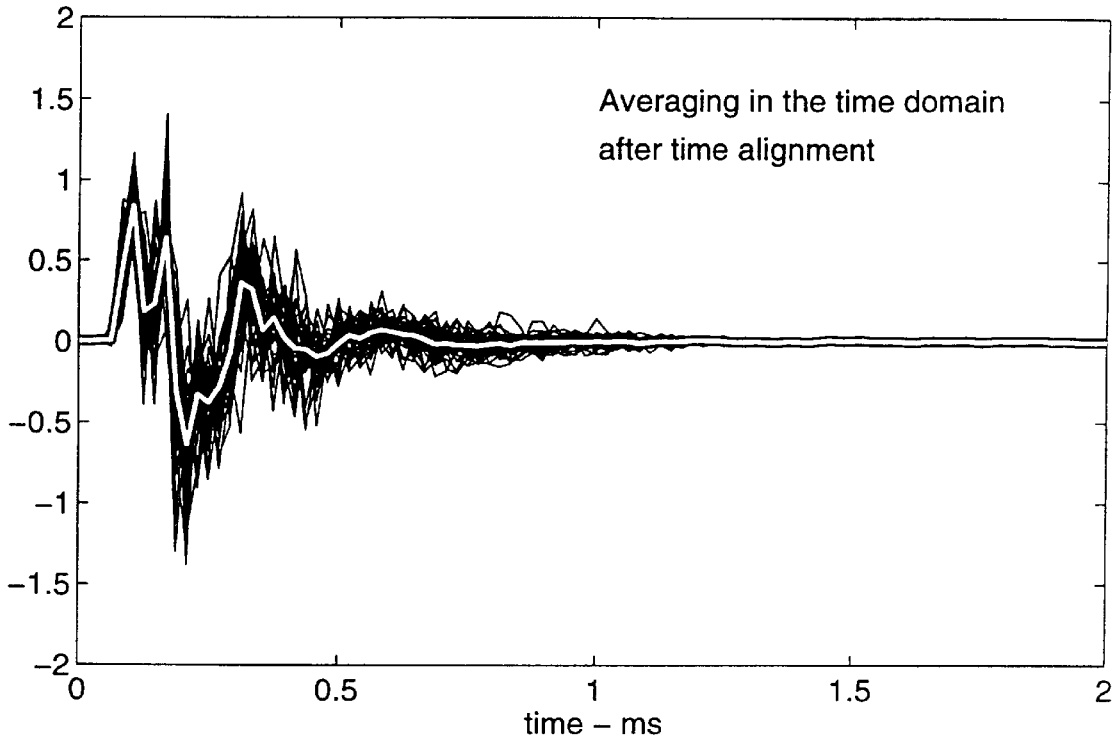
Figure 18:
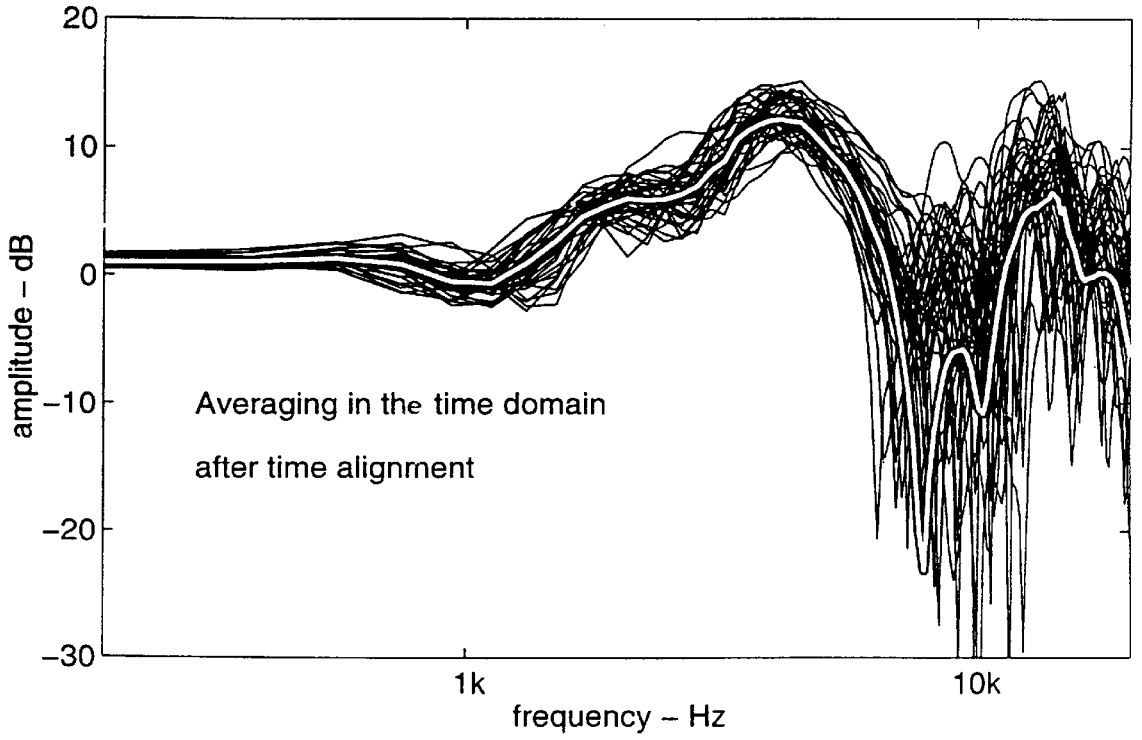

FIG. 17 and FIG. 18 shows the time domain representations and the frequency domain representations of the HTFs of a specific direction for one ear for a group of test persons and also the average value of these HTFs is shown but after time alignment. The time alignment being performed, as the name indicates, in the time domain, e.g., by alignment to the onset of the pulses or alignment to the first peak, or alignment to maximum cross-correlation. In FIG. 17 and FIG. 18 the impulses are aligned to the onset of the impulses. It will be seen that the averages provided this way seem to reproduce more features of the HTFs than the averages without the time alignment.

The time alignment can be performed for the transfer functions of both ears together or independently for the transfer functions of each ear.

After time alignment and averaging a linear phase is added to the averaged functions to account for the interaural time difference. The linear phase contribution to the function is calculated on the basis of the measured appertaining HTFs, such as the average of the linear phase contributions of all the HTFs.

Yet another way of averaging the HTFs of a specific direction is to perform a sort of a parametric averaging by aligning the time domain representations according to significant features, e.g. aligning peaks and valleys of the HTFs either in the time domain or in the frequency domain including stretching or compressing the x-axis (time or frequency) in between peaks and valleys, followed by an averaging of the resulting functions and followed by the addition of the calculated, e.g. averaged phase contribution.

In many applications, e.g. in virtual reality applications, it is desirable to be able to simulate a huge number of HTFs. According to the invention it is possible to simulate HTFs from a set of specific HTFs using interpolation.

Figure 19:
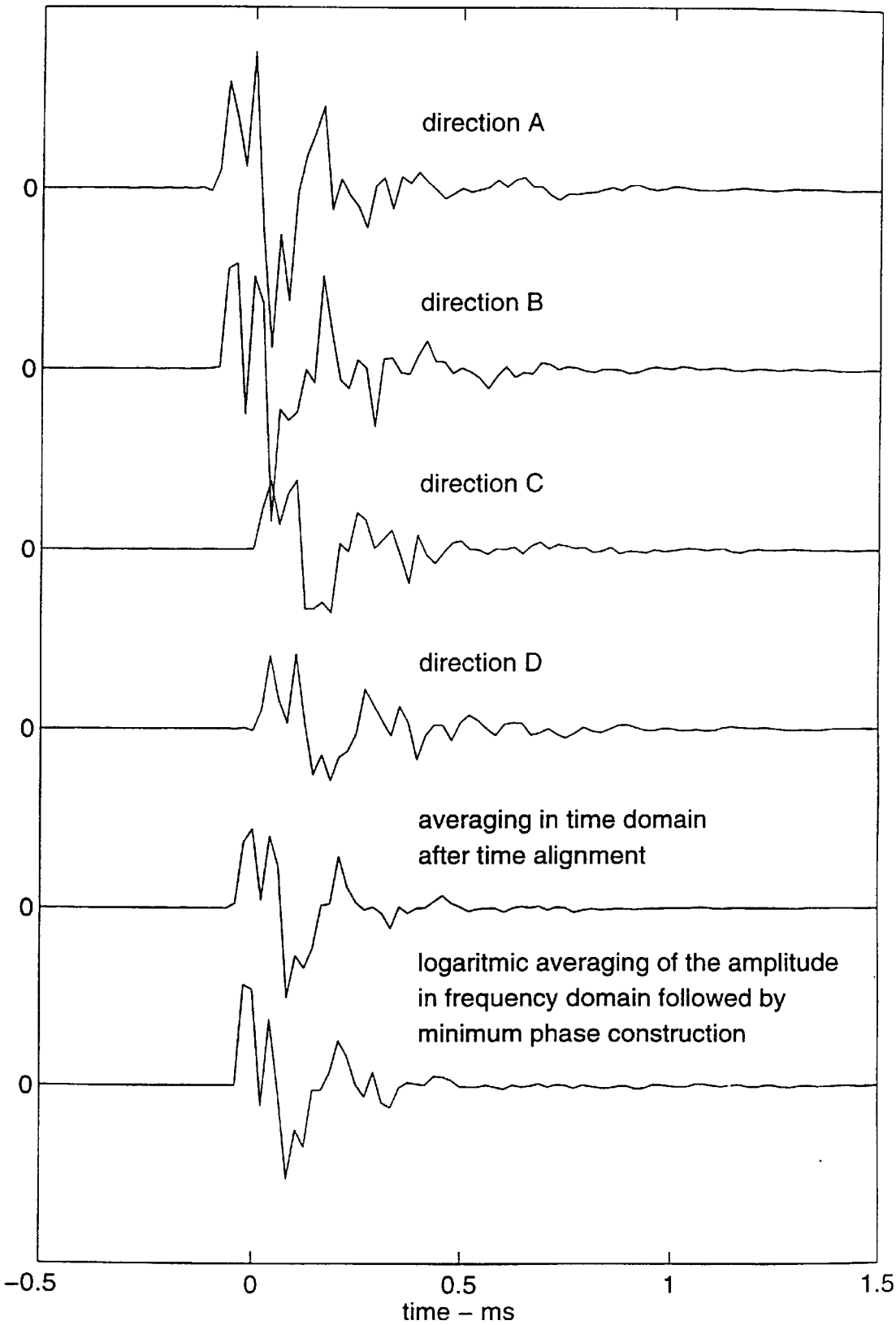
Figure 20:
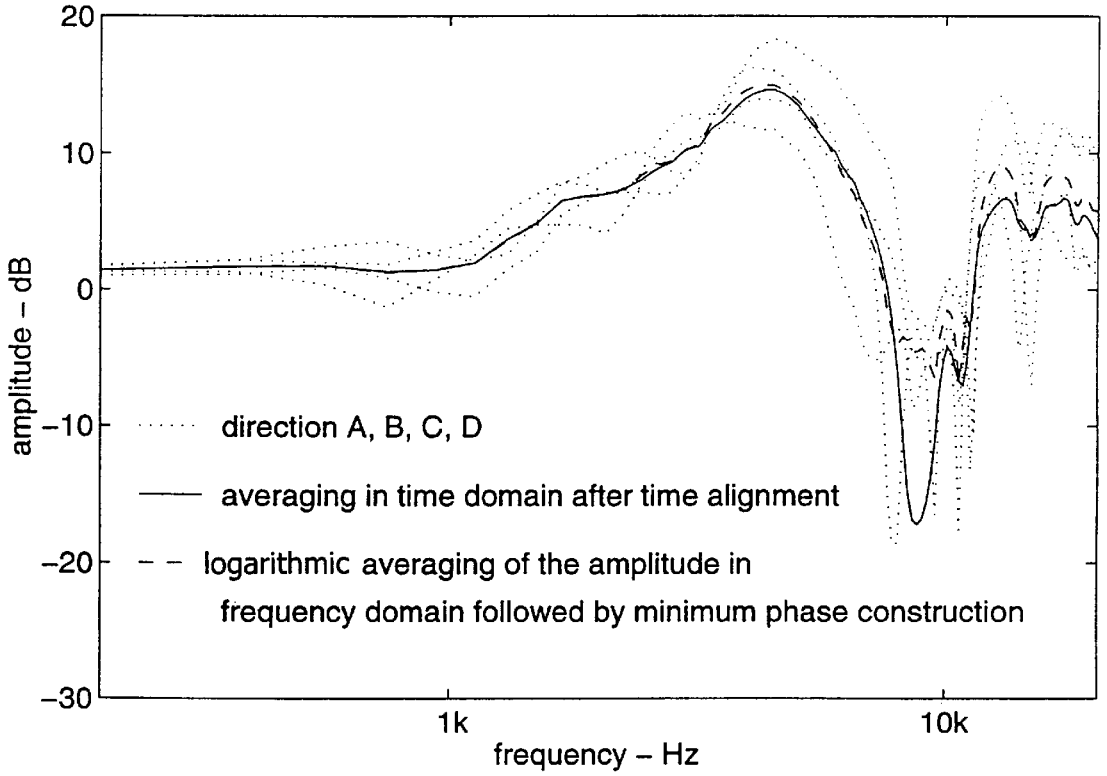
Figure 21A:
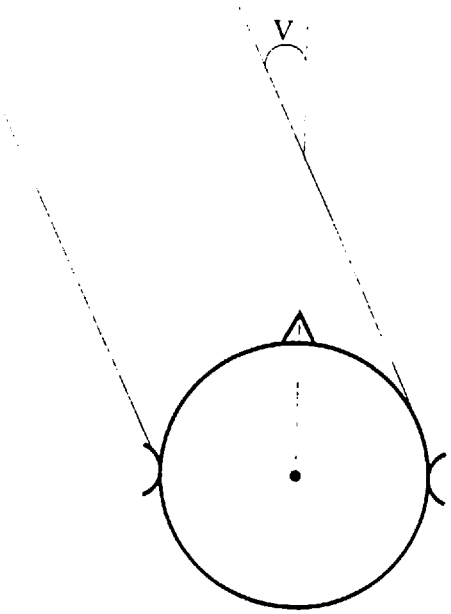
Figure 21B:
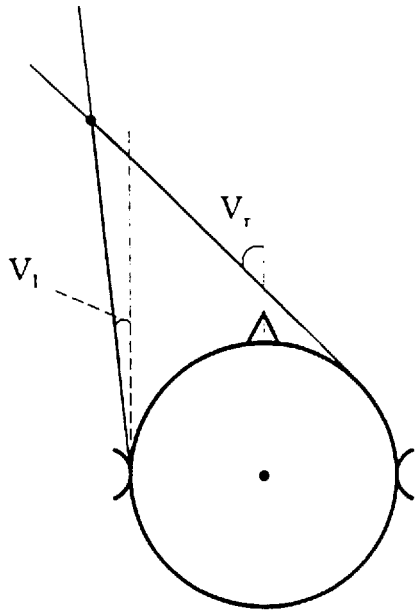
Figure 21C:
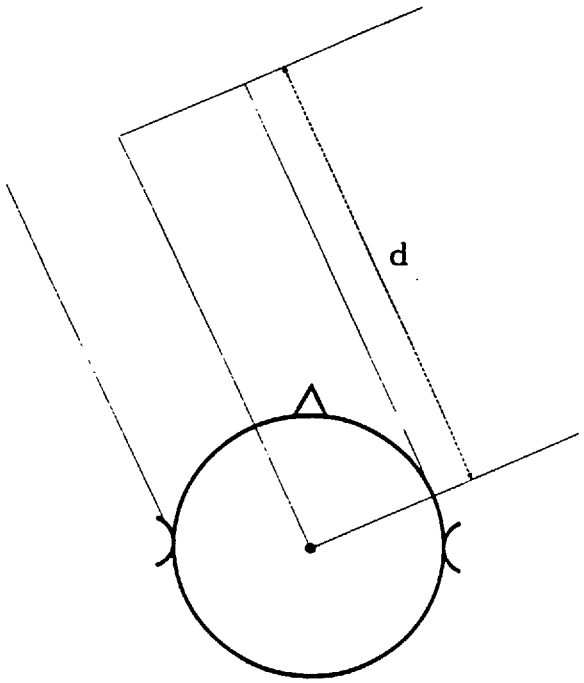
Figure 21D:
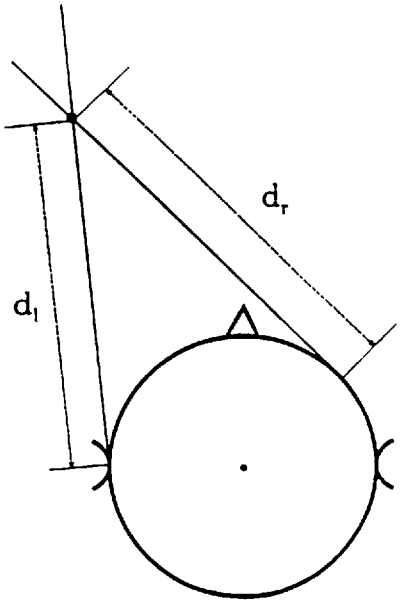

For example an HTF corresponding to a specific direction that lies in between the directions corresponding to four known HTFs could be calculated according to any of the calculation methods described above in the sections concerning averaging techniques. FIG. 19 and FIG. 20 shows examples of this in the time domain and in the frequency domain.

Figure 22:
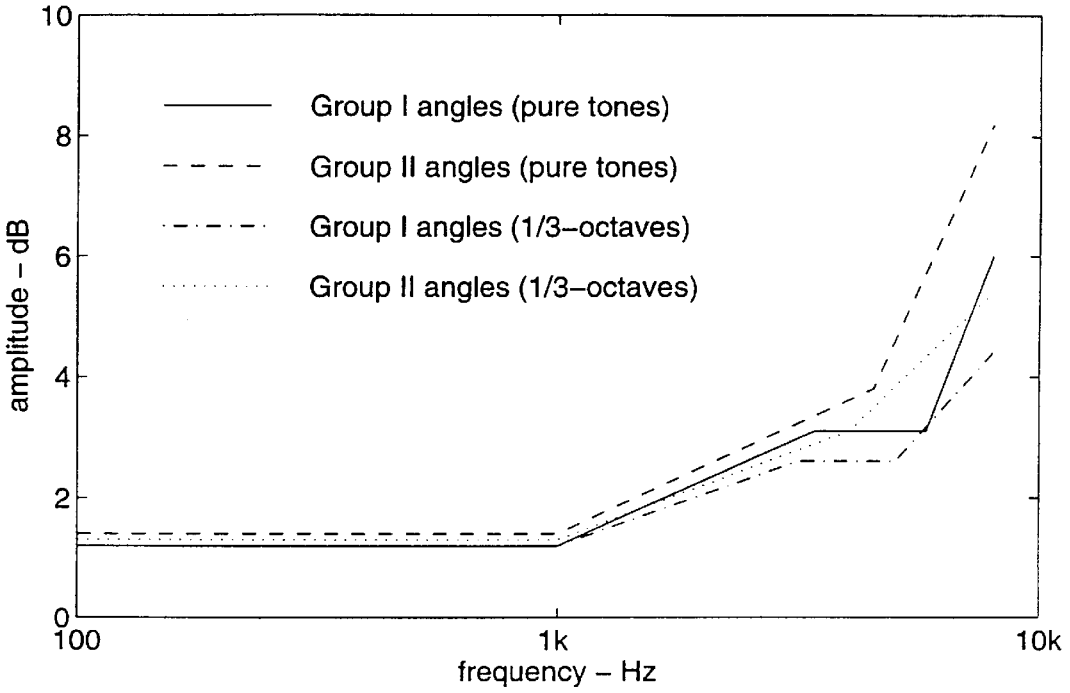
Figure 23:
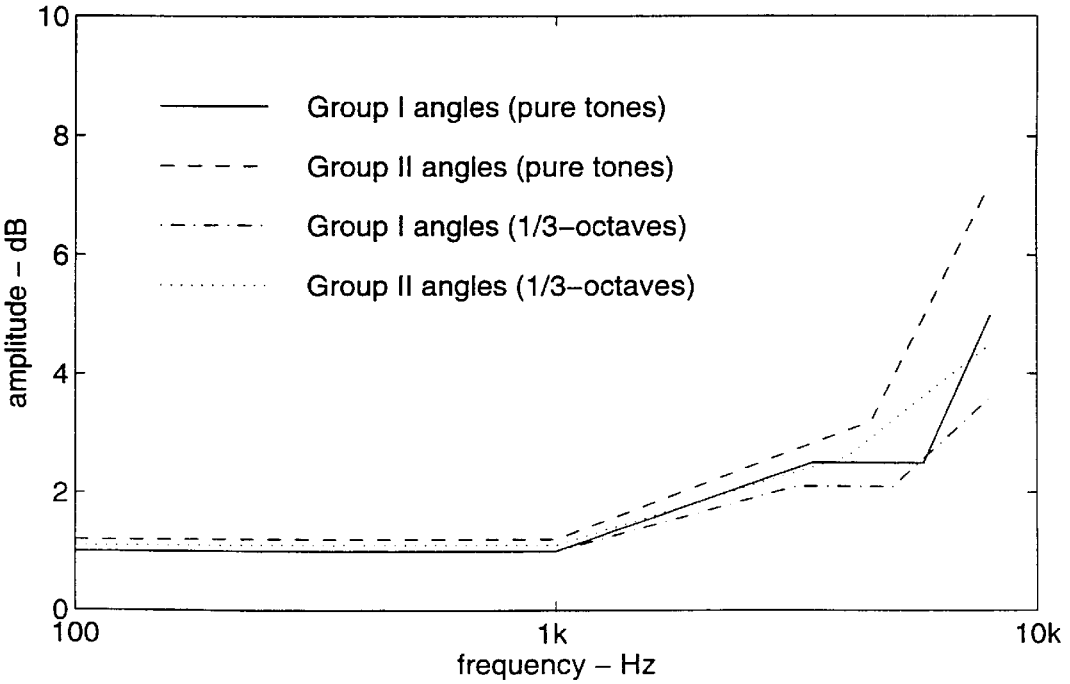
Figure 24:
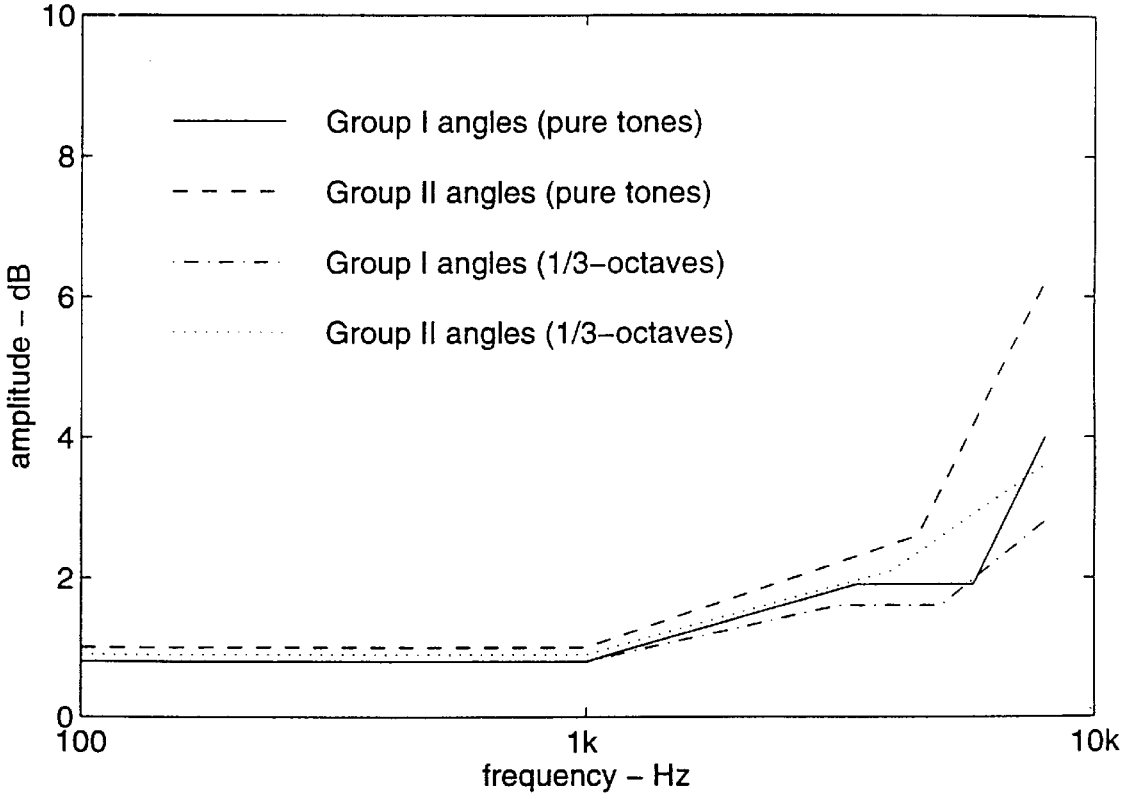

In FIG. 22, FIG. 23 and FIG. 24 Group I angles designate angles above horizontal plane and at the same side as the ear (including the horizontal plane and the median), and Group II angles designate the remaining angles.

We claim:

1. A method of generating binaural signals by filtering at least one sound input with at least one set of two filters, each set of two filters having been designed so that the two filters simulate the left ear and the right ear parts of a Head-related Transfer Function (HTF), the method having at least one of the following features (a), (b), and (c):

(a) the HTF is used generally for a population of humans for which the binaural signals are intended, the HTF being determined in such a manner that the standard deviation of the amplitude, in dB, between subjects is less than a limit selected from the group consisting of limit (i), limit (ii), limit (iii), and limit (iv), wherein:

limit (i) is at the most about 1.4 dB between 100 Hz and 1 kHz, and is at the most about 1.4 dB at 1 kHz, linearly increasing, on a logarithmic frequency axis, to about 3.2 dB at 4 kHz, and is at the most about 3.2 dB at 4 kHz, linearly increasing, on a logarithmic frequency axis, to about 6.0 dB at 8 kHz over at least a major part of the frequency interval between 1 kHz and 8 kHz, when determined with pure tones for first angles on and above the horizontal plane of the ears of said humans and on the same side of the ears of said humans;

limit (ii) is at the most about 1.4 dB between 100 Hz and 1 kHz, and is at the most about 1.4 dB at 1 kHz, linearly increasing, on a logarithmic frequency axis, to about 2.75 dB at 4 kHz, and is at the most about 2.75 dB at 4 kHz, linearly increasing, on a logarithmic frequency axis, to about 4.5 dB at 8 kHz over at least a major part of the frequency interval between 1 kHz and 8 kHz, when determined with ⅓ octave noise bands for first angles on and above the horizontal plane of the ears of said humans and on the same side of the ears of said humans;

limit (iii) is at the most about 1.5 dB between 100 Hz and 1 kHz, and is at the most about 1.5 dB at 1 kHz, linearly increasing, on a logarithmic frequency axis, to about 4.0 dB at 4 kHz, and is at the most about 4.0 dB at 4 kHz, linearly increasing, on a logarithmic frequency axis, to about 8.5 dB at 8 kHz over at least a major part of the frequency interval between 1 kHz and 8 kHz, when determined with pure tones for all angles other than said first angles; and limit (iv) is at the most about 1.5 dB between 100 Hz and 1 kHz, and is at the most about 1.5 dB at 1 kHz, linearly increasing, on a logarithmic frequency axis, to about 3.0 dB at 4 kHz, and is at the most about 3.0 dB at 4 kHz, linearly increasing, on a logarithmic frequency axis, to about 5.5 dB at 8 kHz over at least a major part of the frequency interval between 1 kHz and 8 kHz, when determined with ⅓ octave noise bands for all angles other than said first angles;

(b) the duration of the time domain representation of the transfer function of the filter simulating the HTF is at the most 2 msec; and (c) the value at zero Hertz of the frequency domain description of the transfer function of the filters simulating the HTF is in the range from 0.316 to 3.16.

2. The method according to claim 1, wherein the HTF has been determined in such a manner that the standard deviation of the amplitude, in dB, between subjects is less than a limit selected from the group consisting of limit (v), limit (vi), limit (vii), and limit (vii), wherein:

limit (v) is at the most about 1.0 dB between 100 Hz and 1 kHz, and is at the most about 1.0 dB at 1 kHz, linearly increasing, on a logarithmic frequency axis, to about 2.5 dB at 4 kHz, and is at the most about 2.5 dB at 4 kHz, linearly increasing, on a logarithmic frequency axis, to about 5.0 dB at 8 kHz over at least a major part of the frequency interval between 1 kHz and 8 kHz, when determined with pure tones for first angles on and above the horizontal plane of the ears of said humans and on the same side of the ears of said humans;

limit (vi) is at the most about 1.0 dB between 100 Hz and 1 kHz, and is at the most about 1.0 dB at 1 kHz, linearly increasing, on a logarithmic frequency axis, to about 2.25 dB at 4 kHz, and is at the most about 2.25 dB at 4 kHz, linearly increasing, on a logarithmic frequency axis, to about 3.0 dB at 8 kHz over at least a major part of the frequency interval between 1 kHz and 8 kHz, when determined with ⅓ octave noise bands for first angles on and above the horizontal plane of the ears of said humans and on the same side of the ears of said humans;

limit (vii) is at the most about 1.25 dB between 100 Hz and 1 kHz, and is at the most about 1.25 dB at 1 kHz, linearly increasing, on a logarithmic frequency axis, to about 3.0 dB at 4 kHz, and is at the most about 3.0 dB at 4 kHz linearly increasing, on a logarithmic frequency axis, to about 7.0 dB at 8 kHz over at least a major part of the frequency interval between 1 kHz and 8 kHz, when determined with pure tones for all angles other than said first angles; and limit (viii) is at the most about 1.1 dB between 100 Hz and 1 kHz, and is at the most about 1.1 dB at 1 kHz, linearly increasing, on a logarithmic frequency axis, to about 2.5 dB at 4 kHz, and is at the most about 2.5 dB at 4 kHz, linearly increasing, on a logarithmic frequency axis, to about 4.5 dB at 8 kHz over at least a major part of the frequency interval between 1 kHz and 8 kHz, when determined with ⅓ octave noise bands for angles other than said first angles.

3. The method according to claim 2, wherein the HTF has been determined in such a manner that the standard deviation of the amplitude, in dB, between subjects is less than a limit selected from the group consisting of limit (ix), limit (x), limit (xi), and limit (xii), wherein:

limit (ix) is at the most about 0.8 dB between 100 Hz and 1 kHz, and is at the most about 0.8 dB at 1 kHz, linearly increasing, on a logarithmic frequency axis, to about 2.0 dB at 4 kHz, and is at the most about 2.0 dB at 4 kHz, linearly increasing, on a logarithmic frequency axis, to about 4.0 dB at 8 kHz over at least a major part of the frequency interval between 1 kHz and 8 kHz, when determined with pure tones for first angles on and above the horizontal plane of the ears of said humans and on the same side of the ears of said humans;

limit (x) is at the most about 0.8 dB between 100 Hz and 1 kHz, and is at the most about 0.8 dB at 1 kHz, linearly increasing, on a logarithmic frequency axis, to about 1.6 dB at 4 kHz, and is at the most about 1.6 dB at 4 kHz, linearly increasing, on a logarithmic frequency axis, to about 2.75 dB at 8 kHz over at least a major part of the frequency interval between 1 kHz and 8 kHz, when determined with ⅓ octave noise bands for first angles on and above the horizontal plane of the ears of said humans and on the same side of the ears of said humans;

limit (xi) is at the most about 1.0 dB between 100 Hz and 1 kHz, and is at the most about 1.0 dB at 1 kHz, linearly increasing, on a logarithmic frequency axis, to about 2.5 dB at 4 kHz, and is at the most about 2.5 dB at 4 kHz, linearly increasing, on a logarithmic frequency axis, to about 6.2 dB at 8 kHz over at least a major part of the frequency interval between 1 kHz and 8 kHz, when determined with pure tones for all angles other than said first angles; and limit (xii) is at the most about 0.9 dB between 100 Hz and 1 kHz, and is at the most about 0.9 dB at 1 kHz, linearly increasing, on a logarithmic frequency axis, to about 2.0 dB at 4 kHz, and is at the most about 2.0 dB at 4 kHz, linearly increasing, on a logarithmic frequency axis, to about 3.5 dB at 8 kHz over at least a major part of the frequency interval between 1 kHz and 8 kHz, when determined with ⅓ octave noise bands for angles other than said first angles.

4. The method according to claim 1, wherein the duration of the time domain representation of the transfer function of the filters simulating the HTF is at the most 1.5 msec.

5. The method according to claim 4, wherein the duration of the time domain representation of the transfer function of the filters simulating the HTF is at the most 1.2 msec.

6. The method according to claim 5, wherein the duration of the time domain representation of the transfer function of the filters simulating the HTF is at the most 1 msec.

7. The method according to claim 6, wherein the duration of the time domain representation of the transfer function of the filters simulating the HTF is at the most 0.9 msec.

8. The method according to claim 7, wherein the duration of the time domain representation of the transfer function of the filters simulating the HTF is at the most 0.75 msec.

9. The method according to claim 8, wherein the duration of the time domain representation of the transfer function of the filters simulating the HTF is at the most 0.5 msec.

10. The method according to claim 1, wherein the value at zero Hertz of the frequency domain description of the transfer function of the filters simulating the HTF is in the range from 0.5 to 2.

11. The method according to claim 10, wherein the value at zero Hertz of the frequency domain description of the transfer function of the filters simulating the HTF is in the range from 0.7 to 1.4.

12. The method according to claim 11, wherein the value at zero Hertz of the frequency domain description of the transfer function of the filters simulating the HTF is in the range from 0.8 to 1.2.

13. The method according to claim 12, wherein the value at zero Hertz of the frequency domain description of the transfer function of the filters simulating the HTF is in the range from 0.9 to 1.1.

14. The method according to claim 13, wherein the value at zero Hertz of the frequency domain description of the transfer function of the filters simulating the HTF is in the range from 0.95 to 1.05.

15. The method according to claim 1, wherein the HTF has been determined using at least one of the following measures (A) through (I):

(A) the sound pressure P2 from a spatially arranged sound source, measured at a reference point at the entrance, or close to the entrance, of a blocked ear canal of a person or of an artificial head;

(B) the sound pressure $p_1$ from a sound source, measured at a position between the ears of the person or of the artificial head, with the person or the artificial head absent;

(C) the frequency domain description of the HTF has been calculated by dividing the frequency domain description of $p_2$ by the frequency domain description of $p_1$;

(D) the time domain description of the HTF has been obtained by inverse Fourier transformation of the frequency domain description;

(E) for a particular direction in relation to the person or the artificial head, the left and right ear parts of the HTF have been measured simultaneously;

(F) the person has been standing during the measurement of the HTF;

(G) the person has been monitored by visual means to ensure that the position of the head of the person was not changed during the measurement of the HTF, and any measurement of an HTF during which the position of the head of the person differed from the correct position has been discarded;

(H) the person himself monitored the position of his head in order to keep his head in the correct position during measurement of the HTF; and (I) the measurements were carried out in an anechoic chamber, the measurement time for one HTF being at the most about 5 seconds.

16. The method according to claim 15, wherein the reference point is at most 0.8 cm from the entrance to the blocked ear canal.

17. The method according to claim 16, wherein the reference point is at most 0.6 cm from the entrance to the blocked ear canal.

18. The method according to claim 17, wherein the reference point is at most 0.3 cm from the entrance to the blocked ear canal.

19. The method according to claim 18, wherein the reference point is at the entrance to the blocked ear canal.

20. The method according to claim 1, wherein the HTF has been obtained from HTFs (B), defined as HTFs that have been determined for at least two test objects, a test object being a person or an artificial head, by selecting an HTF which, when used in binaural synthesis, gives a sound impression which, when presented to a test panel, is found to give a high degree of conformity with real life listening to a sound source in the direction in question.

21. The method according to claim 1, wherein the HTF has been obtained from HTFs(B), defined as HTFs that have been determined for at least two test objects, a test object being a person or an artificial head, by selecting an HTF which shows a high degree of similarity to individual HTFs of a population.

22. The method according to claim 20, wherein the HTFs relating to at least two angles of sound incidence have been individually selected among HTFs(B).

23. The method according to claim 1, wherein the HTF has been obtained from HTFs (B), defined as HTFs that have been determined for at least two test objects, a test object being a person or an artificial head, by averaging, in the frequency domain, the amplitude of the HTFs (B).

24. The method according to claim 1, wherein the HTF has been obtained from HTFs (B), defined as HTFs that have been determined for at least two test objects, a test object being a person or an artificial head, by averaging in the time domain, the time-aligned HTFs (B).

25. The method according to claim 23, wherein at least a portion of the frequency axis has been either compressed or expanded individually for each HTF to reduce the differences between the HTFs before the averaging.

26. The method according to claim 24, wherein at least a portion of the time axis has been either compressed or expanded individually for each HTF to reduce the differences between the HTFs before the averaging.

27. The method according to claim 1, wherein the HTF has been obtained from HTFs (B), defined as HTFs that have been determined for at least two test objects, a test object being a person or an artificial head, by averaging characteristic parameters of the HTFs (B).

28. The method according to claim 27, wherein the characteristic parameters are the frequency and the amplitude of characteristic points when the HTFs (B) are described in the frequency domain.

29. The method according to claim 27, wherein the characteristic parameters are the time and the amplitude of characteristic points when the HTFs are described in the time domain.

30. The method according to 27, wherein the characteristic parameters are the coordinates of poles and zeroes when the HTFs are described in the complex s- or z-domain.

31. The method according to claim 1, wherein the HTF is an HTF (D), defined as an HTF that has been obtained from an HTF that has been selected from the group consisting of the 97 HTFs shown in each of FIGS. 1, 2, and 3.

32. The method according to claim 31, wherein the HTF (D) has been produced by further signal processing of an HTF selected from the group consisting of the 97 HTFs shown in each of FIGS. 1, 2, and 3.

33. The method according to claim 32, wherein the HTF, when used for binaural synthesis, gives an audible impression that is not clearly different from the impression given by an HTF (D), wherein the term "clearly different" means that a panel of inexperienced listeners obtains a score of at least 90 percent correct answers, when the HTF is compared to an HTF (D) in a balanced, four-alternative-forced-choice test, using program material for which the binaural signals are used, or for which the binaural signals are intended to be used.

34. The method according to claim 33, wherein the term "clearly different" means that the panel of inexperienced listeners obtains a score of at least 80 percent correct answers.

35. The method according to claim 34, wherein the term "clearly different" means that the panel of inexperienced listeners obtains a score of at least 70 percent correct answers.

36. The method according to claim 35, wherein the term "clearly different" means that the panel of inexperienced listeners obtains a score of at least 50 percent correct answers.

37. The method according to claim 1, wherein the HTF is adapted to at least one listener, comprising the further step of modifying the interaural time difference of the HTF, the modification being based on the physical dimension of the at least one listener.

38. The method according to claim 1, wherein the HTF is adapted to at least one listener, comprising the further step of modifying the interaural time difference of the HTF, the modification being based on a psychoacoustic experiment, where the HTF is used for binaural synthesis, and the interaural time difference is adjusted so that the sound impression as perceived by the at least one listener is found to give a high degree of conformity with real life listening to a sound source in the direction intended.

39. The method according to claim 1, wherein the HTF has been obtained as an approximate HTF for any specific angle of sound incidence, by interpolating neighboring HTFs, the interpolation being carried out as a weighted average of neighboring HTFs.

40. The method according to claim 39, wherein the averaging is an averaging procedure wherein the HTF has been obtained from HTFs (B), defined as HTFs that have been determined for at least two test objects, a test object being a person or an artificial head, by averaging, in the frequency domain, the amplitude of the HTFs (B).

41. The method according to claim 1, wherein the HTF has been obtained as an approximate HTF on the basis of a nearby HTF (B), by performing an adjustment of the linear phase of the HTF (B) to obtain substantially the interaural time difference pertaining to the angle of incidence for which the approximate HTF is intended, wherein an HTF (B) is defined as an HTF that has been determined for at least two test objects, a test object being a person or an artificial head.

42. A method of obtaining an approximate short distance HTF for a short distance between a listener and a sound source for use in methods of generating binaural signals, comprising the steps of:

(1) determining (a) a left ear part HTF representing the geometric angle from the source position to the left ear position, or, if the left ear is not visible from the source position, the geometric angle from the source position tangentially to the part of the head obscuring the left ear, and (b) a right ear part HTF representing the geometric angle from the source position to the right ear position, or, if the right ear is not visible from the source position, the geometric angle from the source position tangentially to the part of the head obscuring the right ear; and (2) combining the left ear part HTF with the right ear part HTF.

43. The method according to claim 42, further comprising the step of individually adjusting the levels of the left ear part HTF and the right ear part HTF.

44. The method according to claim 1, wherein the method is performed using an HTF produced by combining (a) the left ear part of an HTF representing the geometric angle from the source position to the left ear position, or, if the left ear is not visible from the source position, the geometric angle from the source position tangentially to the part of the head obscuring the left ear, with (b) the right ear part of an HTF representing the geometric angle from the source position to the right ear position, or, if the right ear is not visible from the source position, the geometric angle from the source position tangentially to the part of the head obscuring right ear.

45. The method according to claim 44, further comprising the step of individually adjusting the levels of the left ear and the right ear parts of the HTF.

46. A method of generating binaural signals by filtering at least one sound input with one set of two filters, the set of two filters having been obtained from an HTF as defined in claim 1, by further processing which maintains the information contents inherent in the original HTF, the further processing of the left and right ear parts of the HTF being substantially identical.

47. A method of generating binaural signals by filtering at least one sound input with at least two sets of two filters, the sets of two filters having been obtained from HTFs as defined in claim 1, by further processing that maintains the information contents inherent in the original set of HTFs, the said further processing being substantially identical for the various angles, but not necessarily being substantially identical for the left and right ear parts of the sets of HTFs.

48. The method according to claim 46, further comprising the step of signal processing that has been performed so that the amplitude of a binaural signal formed by binaural synthesis of a particular sound field is substantially identical to the amplitude of the particular sound field itself.

49. The method according to claim 1, wherein at least two first sound inputs are combined into one second sound input which is filtered with one set of two filters simulating an HTF.

50. The method according to claim 49, wherein the first sound inputs are sound inputs belonging together in spatial groups in relation to the listener.

51. The method according to claim 1, wherein the binaural signals are supplemented with supplementing signals corresponding to reflections.

52. The method according to claim 1, wherein the at least one sound input is filtered with at least two sets of two filters, each set of two filters having been designed so that the two filters simulate the left ear and the right ear parts of an HTF.

53. The method according to claim 52, wherein the at least one sound input is filtered with at least three sets of two filters, each set of two filters having been designed so that the two filters simulate the left ear and the right ear parts of an HTF.

54. The method according to claim 1, wherein the binaural signals are used for simulation of a sound field of a specific environment, wherein transmission of sound from a set of sound sources with specific positions in said environment to a receiving point with a specific position in said environment is simulated by:

(i) forming, for each of a number of transmission paths for each sound source, a first binaural signal;

(ii) combining the first binaural signals for each sound source into a second binaural signal; and (iii) combining the second binaural signals of the set of sound sources into a resulting third binaural signal.

55. A method for sound measurement or assessment, where a description of sound transmission is involved, comprising the step of using binaural signals produced according to the method of claim 1.

56. The method according to claim 1, further comprising the steps of:

sensing at least one property selected from the group consisting of (i) the position of the head of a listener, (ii) orientation of the head of a listener, (iii) changes in the position of the head of a listener, and (iv) changes in the orientation of the head of a listener; and modifying the electronic signal processing in response to the sensed property.

57. The method according to claim 56, further comprising the steps of:

transmitting at least one pulse of energy adapted to be received by receiving means mounted at and following the movements of the head of the listener;

detecting the arrival time of each of the transmitted energy pulses at the receiving means and optionally detecting or recording the time of transmission of each of the pulses; and c) calculating at least one of the position and orientation of the head of the listener based on the detected arrival time or times and optionally on the detected or recorded time or times of the transmissions.

58. The method according to claim 56, wherein the modification of the electronic signal processing is adapted to impart to the listener the perception that virtual sound sources remain in position irrespective of the sensed property of the listener's head.

59. The method according to claim 56, wherein the signal processing is modified using an approximation method, wherein the HTF has been obtained as an approximate HTF on the basis of a nearby HTF (B), by performing an adjustment of the linear phase of the HTF (B) to obtain substantially the interaural time difference pertaining to the angle of incidence for which the approximate HTF is intended, wherein an HTF (B) is defined as an HTF that has been determined for at least two test objects, a test object being a person or an artificial head.

60. The method according to claim 1, further comprising the step of transmitting the binaural signals in the form of modulated ultrasonic waves, the waves being received by a listener equipped with two receiving means, each of which is mounted close to the appertaining ear of the listener, with changes in the orientation of the listener's head relative to a reference orientation being, compensated on the basis of the difference of the travel time of the ultrasonic wave pulses between the two receiving means, so that the listener will perceive that virtual sound sources remain in a reference position irrespective of the orientation of the listener's head.

61. The method of generating binaural signals according to claim 1, wherein the sound inputs to be filtered by Head-related Transfer Functions are signals ($A_1, \ldots, A_n$) of a communication system, which signals are adapted for being supplied to at least one signal-to-sound transducer, so that the binaural signal, when reproduced, is capable of imparting to a listener a perception of listening to a spatial sound field with a set of n individually positioned transmitters, each of which transmits one of the signals ($A_1, \ldots, A_n$) and each of which corresponds to a virtual sound source.

62. The method according to claim 61, wherein the position and orientation the listener's head are monitored, and head position and head orientation data obtained in the monitoring are used to enable the listener to selectively transmit a message to one of the transmitters corresponding to one of the signals ($A_1, \ldots, A_n$) by turning his or her head in the direction of the virtual sound source corresponding to said transmitter.

63. The method according to claim 61, wherein the sound inputs to be filtered by Head-related Transfer Functions are generated in connection with communicating with a multitude of units.

64. The method of generating binaural signals according to claim 1, wherein the sound inputs to be filtered by Head-related Transfer Functions are signals ($A_1, \ldots, A_n$) of a multichannel sound reproducing system, which signals are adapted for being supplied to n different signal-to-sound transducers of the multichannel sound reproducing system, so that the binaural signal, when reproduced, is capable of imparting to a listener a perception of listening to a spatial sound field similar to the sound field that would have resulted from listening to the n signal-to-sound transducers spatially arranged in a room.

65. The method according to claim 64, wherein the multichannel sound reproducing system is selected from the group consisting of a Dolby® Surround System and an N channel sound system pertaining to HDTV.

66. The method according to claim 64, wherein the multichannel sound reproducing system is a stereo system.

67. The method according to claim 1, wherein the binaural signals are used for positioning a set of sounds at specific virtual positions in relation to an operator.

68. The method according to claim 67, wherein a moving virtual sound source with a characteristic sound moves between specific positions of a set of virtual sound sources, the operator being enabled to communicate a specific message to the system according to a particular virtual sound source by prompting the system when the moving virtual sound source is positioned substantially at the position of said particular virtual sound source.

69. The method according to claim 68, wherein the position of the moving virtual sound source is controlled by the operator.

70. The method according to claim 68, wherein the position of the moving virtual sound source is controlled by the orientation of the head of the operator.

71. The method according to claim 67, wherein the positions are dynamically controlled by a computer.

72. The method according to claim 71, when used for controlling the movement of an object by dynamically positioning a virtual sound source in relation to the object, so as to guide the object in relation to the position of the virtual sound source.

73. The method according to claim 1, further comprising the step of compensating transfer characteristics of a signal-to-sound transducer.

74. The method according to claim 73, wherein sound pressure at the entrance, or close to the entrance, to a blocked ear canal is considered as the output of the signal-to-sound transducer.

75. The method according to claim 1, wherein the binaural signal is emitted by means of headphones.

76. The method according to claim 75, wherein the binaural signal is transmitted to the headphones by wireless means.

77. The method according to claim 74, further comprising the step of compensating for the difference in pressure division at the input to the ear canal when the ear is respectively occluded and unoccluded by a headphone.

78. The method according to claim 77, wherein a description of the difference in pressure division at the input to the ear canal when the ear is respectively occluded and unoccluded by a headphone is obtained by:

(a) measuring the transmission from the headphone to the sound pressure (i) at the entrance, or close to the entrance, of the blocked ear canal, and (ii) at the entrance, or close to the entrance, of the open ear canal, the ratio of the frequency domain descriptions of these transmissions being obtained as characteristic of a first pressure division "X";

(b) measuring the transmission from a sound source that does not influence the acoustic radiation impedance of the ear, to the sound pressure (i) at the entrance, or close to the entrance, of the blocked ear canal, and (ii) at the entrance, or close to the entrance, of the open ear canal, the ratio of the frequency domain descriptions of these transmissions being obtained as characteristic of a second pressure division "Y"; and (c) obtaining the ratio X/Y which constitutes the frequency domain description of the difference in pressure division.

79. The method according to claim 1, wherein the binaural signal is emitted by means of loudspeakers.

80. The method according to claim 1, wherein the step of compensating is adapted to the individual listener.

81. The method according to claim 1, wherein the binaural signal is stored in an audio storage medium.

82. The method according to claim 49, wherein the binaural signal is stored in an audio storage medium, and wherein each of the second sound inputs to be filtered by Head-related Transfer Functions representing a combination of more than one of the first sound inputs is stored separately, the binaural filtering being carried out before or after storing.

83. A method of computer modeling or analyzing the cerebral human binaural sound localization ability, comprising the step of using binaural signals obtained according to the method of claim 1.

84. A method of computer modeling or analyzing the cerebral human binaural sound localization ability, comprising the step of using HTFs as characterized in claim 1.

85. A method for designing headphones, comprising the step of adapting the transfer characteristics thereof to resemble an HTF, as characterized in claim 1, for a given direction or to resemble weighted averages of such HTFs corresponding to averages of given directions.

86. An artificial head having HTFs which correspond substantially to HTFs according to claim 1 for at least angles of sound incidence which constitute part of the total sphere surrounding the artificial head.

87. A method for producing an artificial head having HTFs which correspond substantially to HTFs according to claim 1 for at least angles of sound incidence which constitute part of the total sphere surrounding the artificial head, comprising the step of adapting the geometric characteristics of the artificial head so as to approximate the HTFs of the artificial head to HTFs according to claim 1 at least for angles of sound incidence which constitute part of the total sphere surrounding the artificial head.

* * * * *